US011286104B2

(12) United States Patent
Corbett et al.

(10) Patent No.: US 11,286,104 B2
(45) Date of Patent: Mar. 29, 2022

(54) CONTAINERS FOR PARTICULATE MATERIALS

(71) Applicant: ECO.LOGIC BRANDS INC., Manteca, CA (US)

(72) Inventors: Julie Corbett, Oakland, CA (US); Robert Watters, Ottawa (CA); Romeo Graham, Ottawa (CA); Michael Sirois, Ottawa (CA); Glenn May, Livermore, CA (US)

(73) Assignee: ECO.LOGIC BRANDS INC., Manteca, CA (US)

( * ) Notice: Subject to any disclaimer, the term of this patent is extended or adjusted under 35 U.S.C. 154(b) by 234 days.

(21) Appl. No.: 15/084,931

(22) Filed: Mar. 30, 2016

(65) Prior Publication Data

US 2017/0021995 A1 Jan. 26, 2017

Related U.S. Application Data

(63) Continuation of application No. PCT/US2014/058808, filed on Oct. 2, 2014.
(Continued)

(51) Int. Cl.
*B65D 85/00* (2006.01)
*B65D 21/02* (2006.01)
(Continued)

(52) U.S. Cl.
CPC ..... *B65D 85/70* (2013.01); *B65D 1/0246* (2013.01); *B65D 1/34* (2013.01); *B65D 11/00* (2013.01); *B65D 11/02* (2013.01); *B65D 11/16* (2013.01); *B65D 11/22* (2013.01); *B65D 15/00* (2013.01); *B65D 21/022* (2013.01);
(Continued)

(58) Field of Classification Search
CPC ..... B65D 1/0246; B65D 15/22; B65D 71/70; B65D 41/04; B65D 21/0231; B65D 77/068
See application file for complete search history.

(56) References Cited

U.S. PATENT DOCUMENTS 1,452,039 A 4/1923 Gravell
D99,757 S 5/1936 Dallas
(Continued)

FOREIGN PATENT DOCUMENTS

DE 4401719 A1 7/1994
DE 20220109 U1 4/2004
(Continued)

OTHER PUBLICATIONS

International search report and written opinion dated Jan. 14, 2015 for PCT Application No. PCT/US2014/058808.
(Continued)

*Primary Examiner* — Andrew T Kirsch
(74) *Attorney, Agent, or Firm* — Cantor Colburn LLP

(57) ABSTRACT

Containers for holding particulate materials are provided. The containers may be formed from molded pulp. The containers may included molded pulp shaped or threaded features formed integrally on the container that may aid in providing closure to the device. The containers may optionally include a fitment and/or liner, or may be free of fitments and liners. The containers may optionally have inner load bearing members. The containers may be stackable.

25 Claims, 35 Drawing Sheets

Related U.S. Application Data

(60) Provisional application No. 61/886,010, filed on Oct. 2, 2013.

(51) Int. Cl.

| | |
|---|---|
| ***B65D 6/10*** | (2006.01) |
| ***B65D 51/18*** | (2006.01) |
| ***B65D 8/00*** | (2006.01) |
| ***B65D 25/16*** | (2006.01) |
| ***B65D 25/02*** | (2006.01) |
| ***B65D 6/34*** | (2006.01) |
| ***B65D 25/28*** | (2006.01) |
| ***B65D 43/16*** | (2006.01) |
| ***B65D 77/06*** | (2006.01) |
| ***B65D 81/36*** | (2006.01) |
| ***B65D 39/10*** | (2006.01) |
| ***B65D 71/00*** | (2006.01) |
| ***B65D 77/20*** | (2006.01) |
| ***B65D 25/20*** | (2006.01) |
| ***B65D 77/04*** | (2006.01) |
| ***B65D 25/18*** | (2006.01) |
| ***B65D 1/34*** | (2006.01) |
| ***B65D 25/32*** | (2006.01) |
| ***B65D 65/46*** | (2006.01) |
| ***B65D 71/70*** | (2006.01) |
| ***B65D 1/02*** | (2006.01) |
| ***B65D 6/00*** | (2006.01) |
| ***B65D 25/14*** | (2006.01) |
| ***B65D 41/04*** | (2006.01) |
| ***B65D 43/02*** | (2006.01) |
| *B65D 81/26* | (2006.01) |

(52) U.S. Cl.

CPC ..... *B65D 21/0219* (2013.01); *B65D 21/0231* (2013.01); *B65D 25/02* (2013.01); *B65D 25/14* (2013.01); *B65D 25/16* (2013.01); *B65D 25/18* (2013.01); *B65D 25/20* (2013.01); *B65D 25/28* (2013.01); *B65D 25/2835* (2013.01); *B65D 25/2873* (2013.01); *B65D 25/2882* (2013.01); *B65D 25/32* (2013.01); *B65D 39/10* (2013.01); *B65D 41/04* (2013.01); *B65D 43/0204* (2013.01); *B65D 43/166* (2013.01); *B65D 51/18* (2013.01); *B65D 65/466* (2013.01); *B65D 71/0096* (2013.01); *B65D 71/70* (2013.01); *B65D 77/046* (2013.01); *B65D 77/06* (2013.01); *B65D 77/2024* (2013.01); *B65D 81/365* (2013.01); *B65D 81/26* (2013.01); *B65D 2251/0015* (2013.01); *B65D 2251/0093* (2013.01); *B65D 2571/00043* (2013.01); *B65D 2577/043* (2013.01)

(56) References Cited

U.S. PATENT DOCUMENTS

| | | | | |
|---|---|---|---|---|
| 2,562,389 | A | 7/1951 | Piazze | |
| 2,822,965 | A | 2/1958 | Smith | |
| 2,954,901 | A | 10/1960 | Winstead | |
| 3,017,049 | A | 1/1962 | Powell | |
| D192,535 | S | 4/1962 | Laudano | |
| 3,119,543 | A | 1/1964 | Walker | |
| D198,404 | S | 6/1964 | Busch | |
| D198,407 | S | 6/1964 | Busch | |
| D201,213 | S | 5/1965 | Petitto | |
| 3,255,932 | A | 6/1966 | Hunter et al. | |
| 3,297,191 | A * | 1/1967 | Eastman | B65D 5/5059 206/427 |
| 3,450,254 | A | 6/1969 | Gilbert | |
| D217,439 | S | 5/1970 | Platte et al. | |
| 3,567,104 | A | 3/1971 | Vincent et al. | |
| 3,610,455 | A | 10/1971 | William et al. | |
| D229,485 | S | 12/1973 | Petersen | |
| D233,829 | S | 12/1974 | Balbach et al. | |
| 3,941,301 | A | 3/1976 | Jorgensen | |
| 4,133,462 | A * | 1/1979 | Lindstrom | B65D 47/128 215/214 |
| D258,117 | S | 2/1981 | Bashour | |
| 4,282,984 | A | 8/1981 | Curry, Jr. | |
| 4,330,066 | A | 5/1982 | Berliner | |
| RE32,354 | E | 2/1987 | Savage | |
| 4,709,528 | A | 12/1987 | Merkus | |
| 4,817,830 | A | 4/1989 | Yavorsky | |
| 4,837,849 | A | 6/1989 | Erickson et al. | |
| 4,838,429 | A | 6/1989 | Fabisiewicz et al. | |
| D305,980 | S | 2/1990 | Binder | |
| 5,122,399 | A * | 6/1992 | Farrell | B65D 23/0864 215/12.2 |
| 5,203,470 | A | 4/1993 | Brown | |
| 5,257,865 | A | 11/1993 | Tani | |
| 5,288,531 | A | 2/1994 | Falla et al. | |
| 5,363,966 | A | 11/1994 | Czech et al. | |
| D354,914 | S | 1/1995 | Newman | |
| 5,429,263 | A | 7/1995 | Haubenwallner | |
| 5,474,212 | A | 12/1995 | Ichikawa et al. | |
| 5,477,974 | A | 12/1995 | Reil et al. | |
| D368,660 | S | 4/1996 | Terwilleger | |
| D372,429 | S | 8/1996 | Slezak | |
| D373,533 | S | 9/1996 | Lathrop | |
| D373,535 | S | 9/1996 | Lathrop | |
| 5,553,704 | A | 9/1996 | Gordon et al. | |
| D374,179 | S | 10/1996 | Lathrop | |
| D376,761 | S | 12/1996 | Lathrop | |
| 5,715,992 | A | 2/1998 | Andrews, Sr. et al. | |
| 5,735,422 | A | 4/1998 | Binter | |
| D401,506 | S | 11/1998 | Collins | |
| 5,860,530 | A | 1/1999 | Simmons et al. | |
| 5,860,555 | A | 1/1999 | Mayled | |
| D408,742 | S | 4/1999 | Goettner | |
| 5,890,616 | A | 4/1999 | Cravens et al. | |
| 5,909,841 | A | 6/1999 | Andrews, Sr. et al. | |
| 5,996,427 | A | 12/1999 | Masek et al. | |
| D426,469 | S | 6/2000 | Mankowski | |
| D429,465 | S | 8/2000 | Weeden | |
| 6,142,344 | A | 11/2000 | Kai | |
| 6,196,406 | B1 | 3/2001 | Ennis | |
| 6,196,452 | B1 | 3/2001 | Andrews, Sr. et al. | |
| 6,223,945 | B1 | 5/2001 | Giblin et al. | |
| 6,237,308 | B1 | 5/2001 | Quintin et al. | |
| 6,290,124 | B2 | 9/2001 | Andrews et al. | |
| D451,401 | S | 12/2001 | Silvers | |
| 6,375,040 | B1 | 4/2002 | Allanson et al. | |
| 6,398,076 | B1 | 6/2002 | Giblin et al. | |
| 6,431,401 | B1 | 8/2002 | Giblin et al. | |
| 6,454,134 | B1 | 9/2002 | Aujesky | |
| 6,464,106 | B1 | 10/2002 | Giblin et al. | |
| 6,510,965 | B1 | 1/2003 | Decottignies et al. | |
| D471,111 | S | 3/2003 | Kuzma | |
| 6,619,505 | B1 | 9/2003 | Decottignies et al. | |
| 6,783,277 | B2 | 8/2004 | Edwards et al. | |
| 6,794,053 | B2 | 9/2004 | Quintin et al. | |
| 6,826,892 | B2 | 12/2004 | Basque et al. | |
| 6,857,779 | B2 | 2/2005 | Olin | |
| 6,874,299 | B2 | 4/2005 | Basque | |
| D508,206 | S | 8/2005 | Meeker | |
| 7,048,975 | B1 * | 5/2006 | Tojo | B65D 1/0207 428/213 |
| 7,076,935 | B2 | 7/2006 | Basque | |
| D543,466 | S | 5/2007 | Little | |
| D543,852 | S | 6/2007 | Warren | |
| D607,743 | S | 1/2010 | Eble | |
| D608,211 | S | 1/2010 | Eble | |
| D633,808 | S | 3/2011 | Titherington | |
| D645,754 | S | 9/2011 | Corbett et al. | |
| D645,755 | S | 9/2011 | Corbett et al. | |
| 8,430,262 | B2 | 4/2013 | Corbett et al. | |

(56) References Cited

U.S. PATENT DOCUMENTS

| | | | | |
|---|---|---|---|---|
| 8,453,860 | B2 * | 6/2013 | Otero | B65D 23/001 215/391 |
| D692,768 | S | 11/2013 | Corbett et al. | |
| D692,769 | S | 11/2013 | Corbett et al. | |
| D694,635 | S | 12/2013 | Corbett et al. | |
| 8,746,453 | B1 * | 6/2014 | Hall | B65D 21/0202 206/504 |
| 8,807,377 | B2 | 8/2014 | Corbett et al. | |
| D720,227 | S | 12/2014 | Corbett et al. | |
| 8,991,635 | B2 | 3/2015 | Myerscough | |
| 9,452,857 | B2 | 9/2016 | Corbett et al. | |
| 2003/0089735 | A1 | 5/2003 | Iwatsubo | |
| 2005/0133578 | A1 | 6/2005 | Farha et al. | |
| 2005/0167319 | A1 | 8/2005 | Girondi et al. | |
| 2006/0062497 | A1 | 3/2006 | Murray | |
| 2006/0111224 | A1 | 5/2006 | Caudle | |
| 2006/0230588 | A1 | 10/2006 | Sprehe | |
| 2007/0211967 | A1 | 9/2007 | Murray | |
| 2008/0083695 | A1 | 4/2008 | Nievierowski | |
| 2008/0083777 | A1 | 4/2008 | Lips | |
| 2008/0142466 | A1 * | 6/2008 | Balitski | B65D 23/12 215/6 |
| 2008/0210584 | A1 | 9/2008 | Barthel et al. | |
| 2008/0267540 | A1 | 10/2008 | Ashworth | |
| 2009/0045157 | A1 * | 2/2009 | Panchal | B65D 21/0231 215/10 |
| 2009/0057381 | A1 | 3/2009 | Gokhale | |
| 2010/0252617 | A1 * | 10/2010 | Dayton | B31C 9/00 229/4.5 |
| 2011/0036846 | A1 * | 2/2011 | Corbett | B65D 77/06 220/495.03 |
| 2011/0220652 | A1 | 9/2011 | Corbett et al. | |
| 2012/0024897 | A1 | 2/2012 | Corbett et al. | |
| 2012/0145710 | A1 | 6/2012 | Corbett et al. | |
| 2013/0020277 | A1 | 1/2013 | Berk et al. | |
| 2014/0252032 | A1 | 9/2014 | Corbett et al. | |
| 2015/0314916 | A1 | 11/2015 | Corbett et al. | |
| 2016/0185500 | A1 | 6/2016 | Corbett et al. | |
| 2017/0029191 | A1 | 2/2017 | Corbett et al. | |

FOREIGN PATENT DOCUMENTS

| | | | |
|---|---|---|---|
| DE | 202004010291 | U1 | 9/2004 |
| EP | 0134142 | A2 | 3/1985 |
| EP | 0134142 | A3 | 5/1986 |
| EP | 0302600 | A1 | 2/1989 |
| EP | 0590424 | A1 | 4/1994 |
| EP | 0785023 | A1 | 7/1997 |
| EP | 1306314 | A1 | 5/2003 |
| EP | 1739025 | A1 | 1/2007 |
| EP | 2338807 | A1 | 6/2011 |
| EP | 2361847 | A1 | 8/2011 |
| FR | 1153193 | A | 3/1958 |
| FR | 1287487 | A | 3/1962 |
| GB | 191516490 | A | 6/1916 |
| GB | 1207421 | A | 9/1970 |
| GB | 0524789.5 | | 12/2005 |
| GB | 0611137.1 | | 6/2006 |
| GB | 2432829 | A | 6/2007 |
| GB | 0807697.8 | | 4/2008 |
| GB | 0807698.6 | | 4/2008 |
| GB | 0811098.3 | | 6/2008 |
| GB | 0818551.4 | | 10/2008 |
| JP | S5089191 | A | 7/1975 |
| JP | H0532272 | A | 2/1993 |
| JP | H1159726 | A | 3/1999 |
| JP | 2001287260 | A | 10/2001 |
| JP | 2001354242 | A | 12/2001 |
| JP | 2002542992 | A | 12/2002 |
| JP | 2009196644 | A | 9/2009 |
| JP | 2010247891 | A | 11/2010 |
| JP | 5098689 | B2 | 12/2012 |
| KR | 200379463 | Y1 | 3/2005 |
| TW | M269271 | U | 7/2005 |
| WO | WO-9114630 | A1 | 10/1991 |
| WO | WO-9315967 | A1 | 8/1993 |
| WO | WO-9419242 | A1 | 9/1994 |
| WO | WO-9419255 | A1 | 9/1994 |
| WO | WO-9746465 | A1 | 12/1997 |
| WO | WO-9902415 | A1 | 1/1999 |
| WO | WO-03033376 | A1 | 4/2003 |
| WO | WO-2005054068 | A1 | 6/2005 |
| WO | WO-2006040637 | A1 | 4/2006 |
| WO | WO-2007060450 | A2 | 5/2007 |
| WO | WO-2007066090 | A1 | 6/2007 |
| WO | WO-2007126044 | A1 | 11/2007 |
| WO | WO-2008103649 | A2 | 8/2008 |
| WO | WO-2008103649 | A3 | 11/2008 |
| WO | WO-2009133355 | A1 | 11/2009 |
| WO | WO-2009133359 | A1 | 11/2009 |
| WO | WO-2009153558 | A1 | 12/2009 |
| WO | WO-2010030958 | A2 | 3/2010 |
| WO | WO-2011112712 | A1 | 9/2011 |
| WO | WO-2011141696 | A1 | 11/2011 |
| WO | WO-2011153577 | A1 | 12/2011 |
| WO | WO-2011157999 | A2 | 12/2011 |
| WO | WO-2011158000 | A1 | 12/2011 |
| WO | WO-2011157999 | A3 | 2/2012 |
| WO | WO-2012078929 | A2 | 6/2012 |
| WO | WO-2013036695 | A1 | 3/2013 |
| WO | WO-2015051107 | A1 | 4/2015 |

OTHER PUBLICATIONS

GreenBottle. Is It The End For Plastic Bottles? Flyer. Nov. 3, 2009.

EP14851129.8 The Extended European Search Report dated Mar. 2, 2017.

Communication pursuant to Article 94(3) EPC; Application No. 14851129.8-1009; dated Nov. 20, 2020; pp. 1-6.

PCT International Preliminary Report on Patentability; International Application No. PCT/US2014/058808; International Filing Date: Oct. 2, 2014; dated Apr. 5, 2016; pp. 1-11.

* cited by examiner with liner without liner without liner

CONTAINERS FOR PARTICULATE MATERIALS

CROSS-REFERENCE

This application claims the benefit of U.S. Provisional Application No. 61/886,010 filed Oct. 2, 2013, which application is incorporated herein by reference in its entirety.

BACKGROUND OF THE INVENTION

Currently granular products or litter are dispensed in blow molded container with a resealable screw cap, or a molded container with a removable lid, or sometimes a cardboard box with a bag within to keep particulate from leaking.

These packages represent a lot of plastic. Or in the case of the box, are not ergonomic and easily managed.

Thus, a need exists for improved containers for holding materials.

SUMMARY OF THE INVENTION

An aspect of the invention is directed to a container for holding particulate materials comprising: a molded pulp shell body comprising (1) a hinged pulp shell that is foldable to form an enclosed body or (2) multiple pulp shells including a first pulp shell and a second pulp shell joined together to form the enclosed body, wherein the molded pulp shell body is configured to contain particulate materials within the enclosed body; and an orifice in the molded pulp shell body configured to permit passage of the particulate materials through the orifice into or out of the molded pulp shell body, wherein (1) at least a portion of a first side of the hinged pulp shell forms an overlap with a second side of the hinged pulp shell, or (2) at least a portion of the first pulp shell forms the overlap with the second pulp shell, to provide a substantially flat surface at the overlap.

An additional aspect of the invention is directed to a container for holding materials comprising: a molded pulp shell configured to contain the materials therein; molded pulp threads integrally formed on the molded pulp shell; and a threaded closure configured to mate with the molded pulp threads.

Additional aspects and advantages of the present disclosure will become readily apparent to those skilled in this art from the following detailed description, wherein only exemplary embodiments of the present disclosure are shown and described, simply by way of illustration of the best mode contemplated for carrying out the present disclosure. As will be realized, the present disclosure is capable of other and different embodiments, and its several details are capable of modifications in various obvious respects, all without departing from the disclosure. Accordingly, the drawings and description are to be regarded as illustrative in nature, and not as restrictive.

INCORPORATION BY REFERENCE

All publications, patents, and patent applications mentioned in this specification are herein incorporated by reference to the same extent as if each individual publication, patent, or patent application was specifically and individually indicated to be incorporated by reference.

BRIEF DESCRIPTION OF THE DRAWINGS

The novel features of the invention are set forth with particularity in the appended claims. A better understanding of the features and advantages of the present invention will be obtained by reference to the following detailed description that sets forth illustrative embodiments, in which the principles of the invention are utilized, and the accompanying drawings of which:

DETAILED DESCRIPTION OF THE INVENTION

Figure 1:
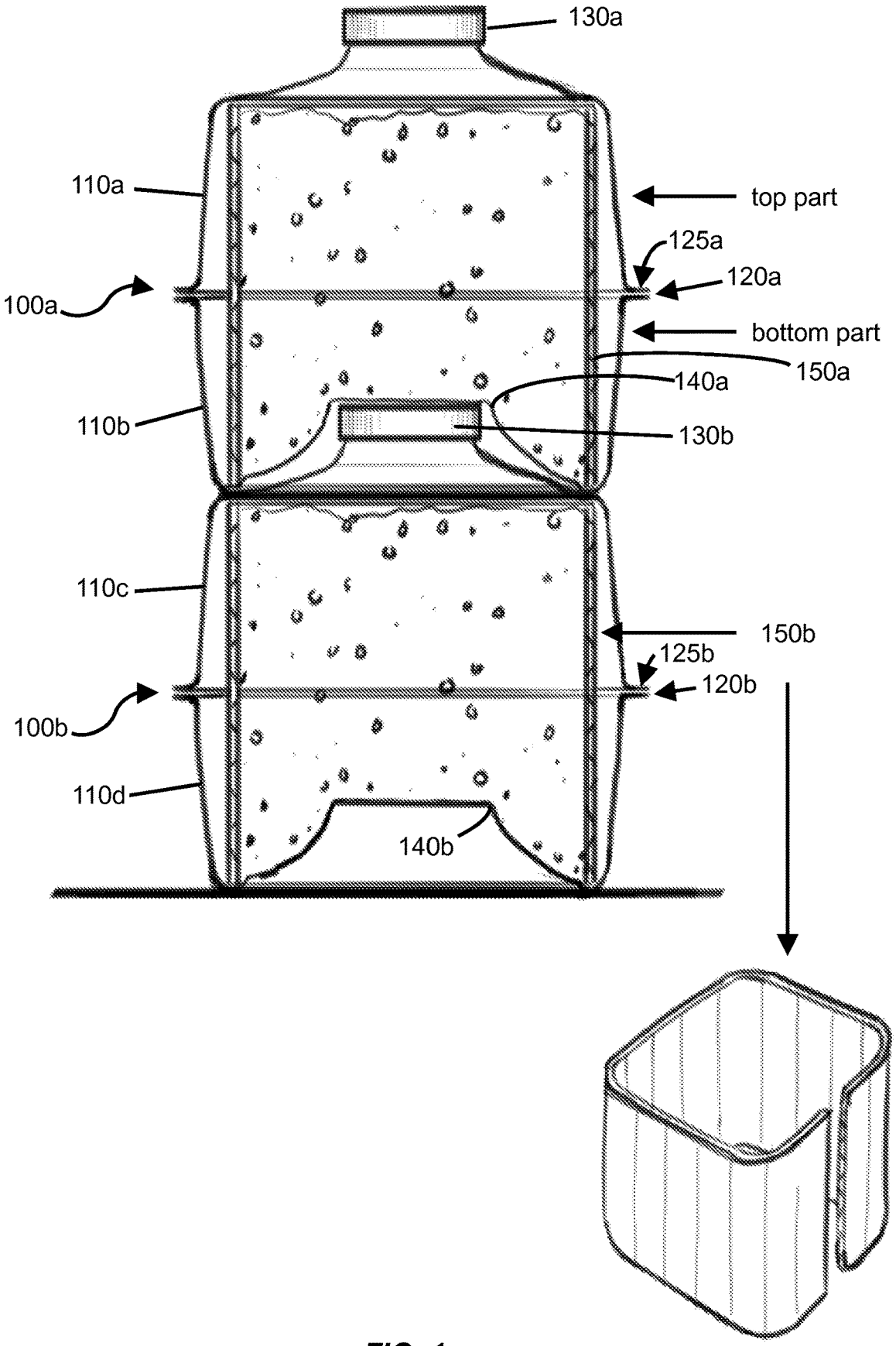
FIG. 1 shows examples of containers that may be stacked on top of one another in accordance with an embodiment of the invention.

While preferable embodiments of the invention have been shown and described herein, it will be obvious to those skilled in the art that such embodiments are provided by way of example only. Numerous variations, changes, and substitutions will now occur to those skilled in the art without departing from the invention. It should be understood that various alternatives to the embodiments of the invention described herein may be employed in practicing the invention.

The invention provides containers for particulate materials. Various aspects of the invention described herein may be applied to any of the particular applications set forth below or for any other types of containers or materials in containers. The invention may be applied as a standalone device, or as part of an integrated packaging system. It shall be understood that different aspects of the invention can be appreciated individually, collectively, or in combination with each other.

A molded pulp container may be configured to contain materials. In some instances, the materials can particulate materials. Particulate materials may include granular products, such as litter (e.g., cat or other animal litter), food, pellets, pebbles, grains, powders, or other materials. Particulate materials may include solid materials.

The container may be formed of any material having a desired material property. For example, the container can comprise biodegradable materials and/or compostable materials, such as molded fiber or pulp or paper. The container can be a molded pulp container. The material used for forming the container may be but need not be food-grade. For example, the container may comprise 100% post-consumer fiber or pulp feedstock. The container described herein can include virgin pulp fiber. The container can comprise type-2 molded fiber, type-2A thermoformed fiber, type-3 thermoformed fiber, type-4 thermoformed fiber, molded fiber, matched tool molded fiber, X-RAY formed fiber, infrared formed fiber, microwave formed fiber, vacuum formed fiber, structural fiber, compression formed fiber, wet press fiber, wet press with hot after press formed fiber, sheet stock, recycled plastic or any other structural material.

In some embodiments, the container may be formed of any agri-fiber, such as pulp. The container may be formed from one of more processed forms of agri-fiber suitable for molding and/or thermoforming. In some instances, the container may be formed of a material other than cardboard or paper (e.g., corrugated fiberboard and newspaper), because, for example, cardboard may be too rigid and paper may be too flexible/compliant to undergo the molding and/or thermoforming process desired. Any of the materials that may be used to form the container may be used in any of the embodiments described herein. Any discussion of pulp herein may also apply to any of the materials (e.g., fiber molding, natural fibers, biodegradable or compostable materials) that may be used to form a container. Additives may be used to impart added characteristics such as strength, moisture resistance, odor control, fungal or bacterial-growth resistance. The container may be formed from a combination of materials, or different components of the container may be formed from the same material or different materials.

The container may be formed from pulp mold thermoforming. In some instances, the part used in thermoforming may have a depth. In some instances, the depth may be less than or equal to 12 inches, 10 inches, 8 inches, 6 inches, 4 inches, 2 inches or 1 inch. The parts may need a draft angle condition on certain surfaces to facilitate part release from the tool.

In some instances, a part thickness from pulp mold thermoforming is less than 2 mm max. The part thickness may be less than or equal to 5 mm, 4 mm, 3 mm, 2 mm, 1 mm. In other instances such as wet molded pulp, thickness may be greater than or equal to 2 mm, 6 mm, 10 mm, or 20 mm.

In some instances, material used to form the container may be treated. For instance, treatment of the pulp molded surface/shell may be provided. Spray treatment to an internal shell may help seal the pulp. The interior and/or exterior surface of the container may be sprayed. In some instances, a vacuum formed layer of thin film may be provided. The thin film may be provided on an interior and/or exterior surface of the container. In some instances a Nano particulate treatment to the film can be added for additional barrier. Application of a nano-particulate coating, as an example a vermiculite clay platelet nano particle, can be applied directly to the pulp formed surfaces in order to decrease the permeability of the pulp formed parts to liquid, powder, air, aroma or gases.

Treatment to the pulp-molded container shell may be used to make the shell waterproof or water resistant. Alternatively, the treatment may be used to prevent fine particulate materials from escaping from the container. Alternatively, no extra treatment to the shell may be required.

A molded pulp container may have a resealable closure. In some embodiments, the molded pulp container does not have a liner or a fitment. For instance, the materials in the container may directly contact an interior molded pulp surface of the container. Not having a liner or fitment may advantageously reduce costs by getting necessary functionality out of molded pulp components. Alternatively a liner (e.g., polymer liner or bag) and/or fitment (e.g., polymer fitment attached to the bag) may be provided.

In some embodiments, fitments and/or liners can be formed from polymers that belong to a group of polymers that may be recycled together, or formed from the same type of polymer. Formation from the same type of polymer or from polymers belonging to one recycling group can allow for simplified and/or reduced-cost recycling. A type of polymer can comprise polyethylene terephthalate (PET), high-density polyethylene (HDPE), polyvinyl chloride (PVC), low density polyethylene (LDPE), polypropylene (PP), polystyrene (PS), nylon (PA), Ethylene vinyl alcohol (EVOH) and other polymers. The polymer can be an FDA-approved plastic. In some embodiments, biopolymers may be used. The recycling groups can comprise plastic identification codes 1, 2, 3, 4, 5, 6, and 7. A recycling group can comprise a set of plastic or polymer types that can be recycled together using a recycling process that does not require separation of the plastic or polymer types prior to the recycling process. Alternatively, the fitment and/or polymer may be formed from other materials, including those described elsewhere herein.

Optionally, a molded pulp container may have a fitment to help with resealability and dispensing but with no liner. The pulp construction of the container may be siftless (fine powder does not leak out).

The container may be configured to contain and enclose materials that may be heavy. The container may be able to bear heavy loads. The container may be able to accommodate heavy particulate materials (e.g., granules, litter). In some instances, the container may be able to support contents having a weight of 1 kg or greater, 2 kg or greater, 3 kg or greater, 4 kg, or greater, 5 kg or greater, 6 kg or greater, 7 kg or greater, 8 kg or greater, 9 kg or greater, 10 kg or greater, 12 kg or greater, 15 kg or greater, 20 kg or greater, or 25 kg or greater.

Figure 3:
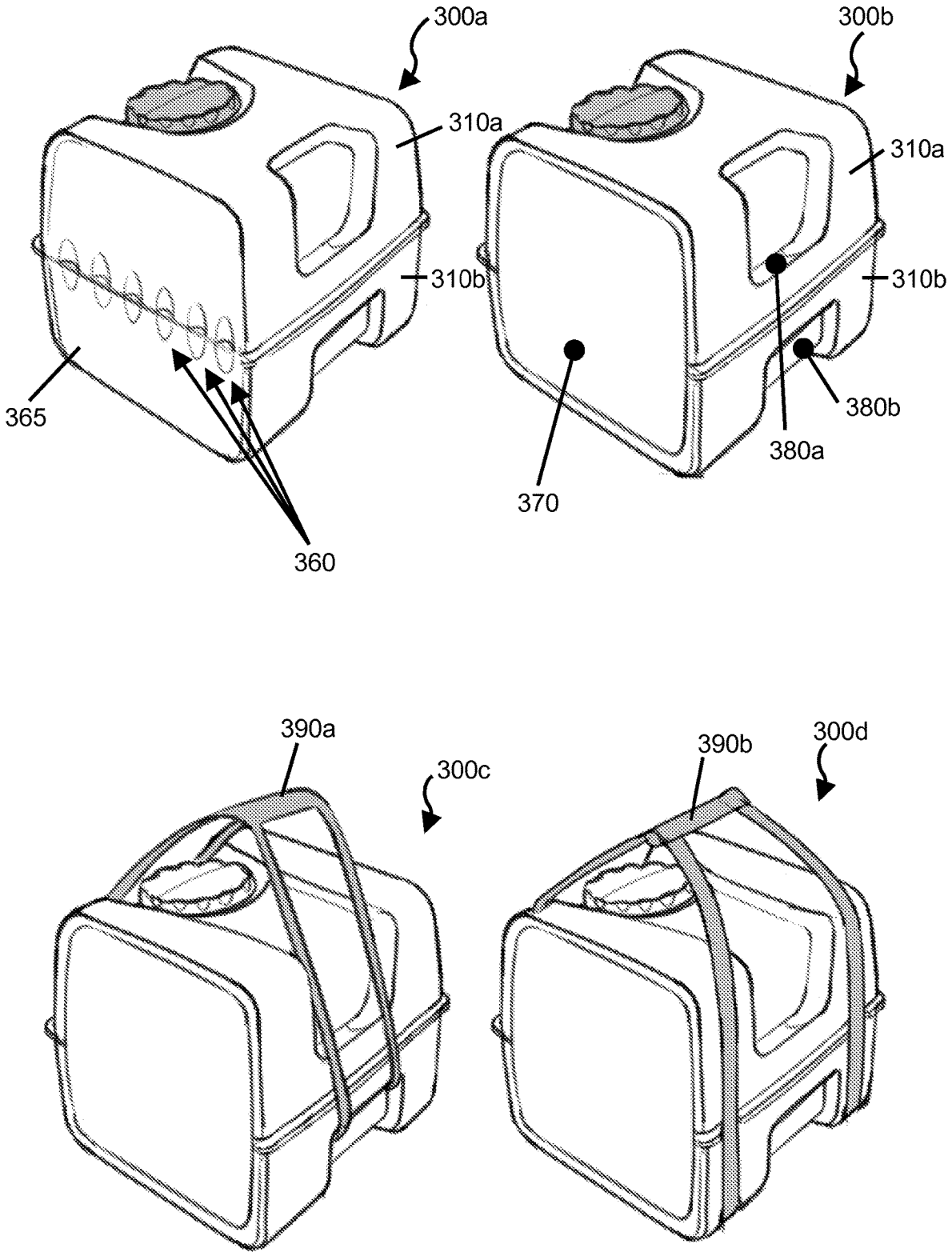
FIG. 3 shows examples of features that may be provided on containers in accordance with an embodiment of the invention.
Figure 34:
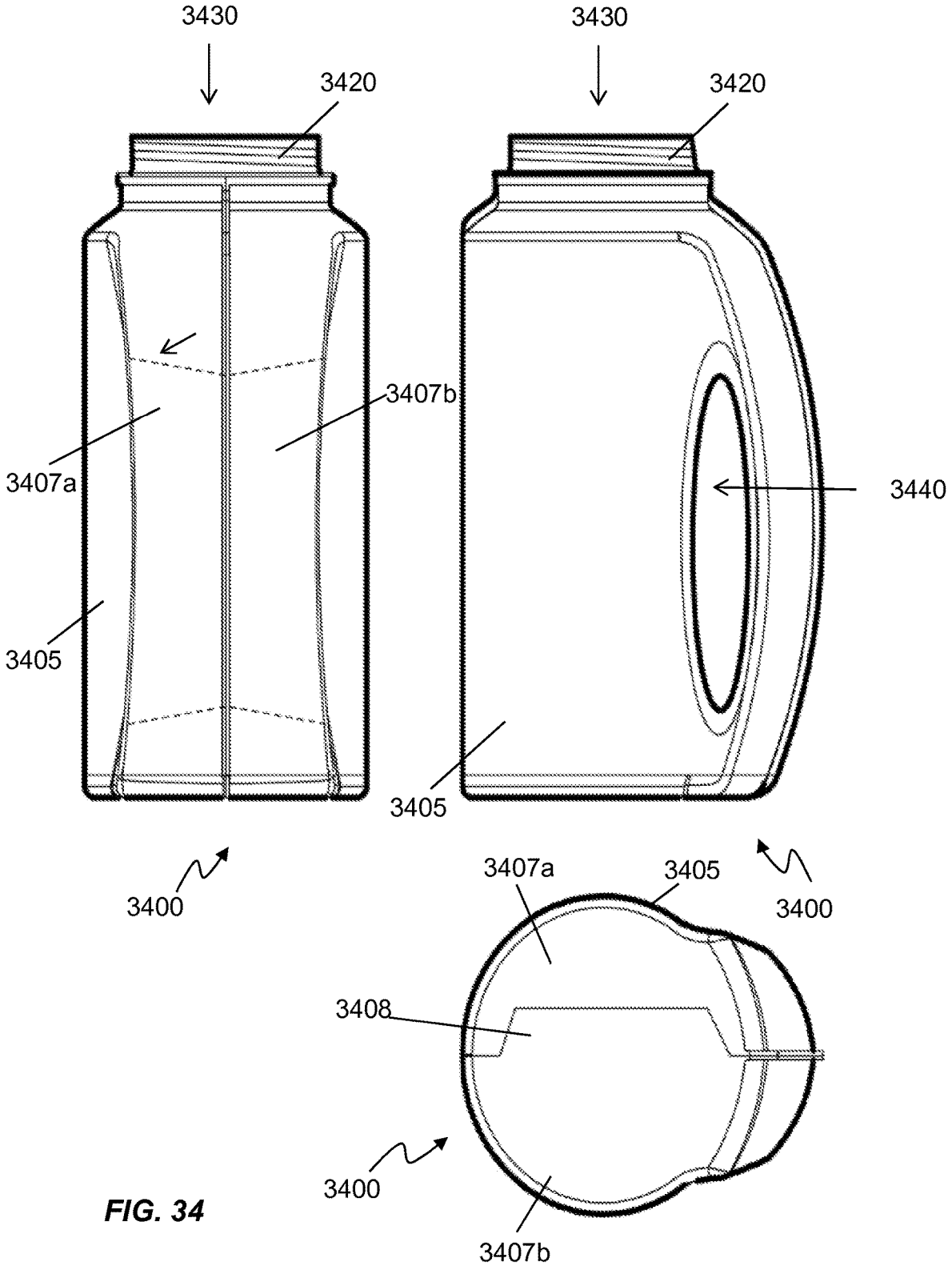
FIG. 34 provides an example of a container that can be used to hold particulate materials in accordance with an embodiment of the invention.

In some instances, the contents of the container may be poured out. The container may optionally have gripping features that may facilitate pouring the contents. For instance, a user may grasp the container at the gripping features to tip the container over to pour the contents. Such gripping features may include indentations, protrusions, high friction components or other features that may facilitate grasping of the container. FIG. 3 provides an example of indented features that can create a grip area. FIG. 34 shows an example of an integrally molded handle.

The container may include one or more features. The features may be formed from the molded pulp. In one example, integral threads may be provided on the container. The integral threads may be formed from molded pulp. The integral threads may be configured to mate with complementary threads from a screw cap or other closure device. Integral threads may be molded directly into the container from pulp. A heat molding or other molding process described elsewhere herein may be used to form the threads. The molded pulp threads may be of sufficient density to screw a cap on tightly. The molded pulp threads may be of a sufficient strength and/or density so that the container can be suspended by the screwed in screw cap with the contents within the container.

Molding integral threads in the molded pulp container may occur in one piece or multiple pieces. In some embodiments, to mold the thread features the final threaded neck may be formed from two or more parts (or hinged). Similarly, the containers (with neck features) may be made out of two or more parts (or hinged).

The pulp threads can be made out of one part set and the container parts out of other part sets. These may be joined (different molding directions to best suit each).

Figure 35:
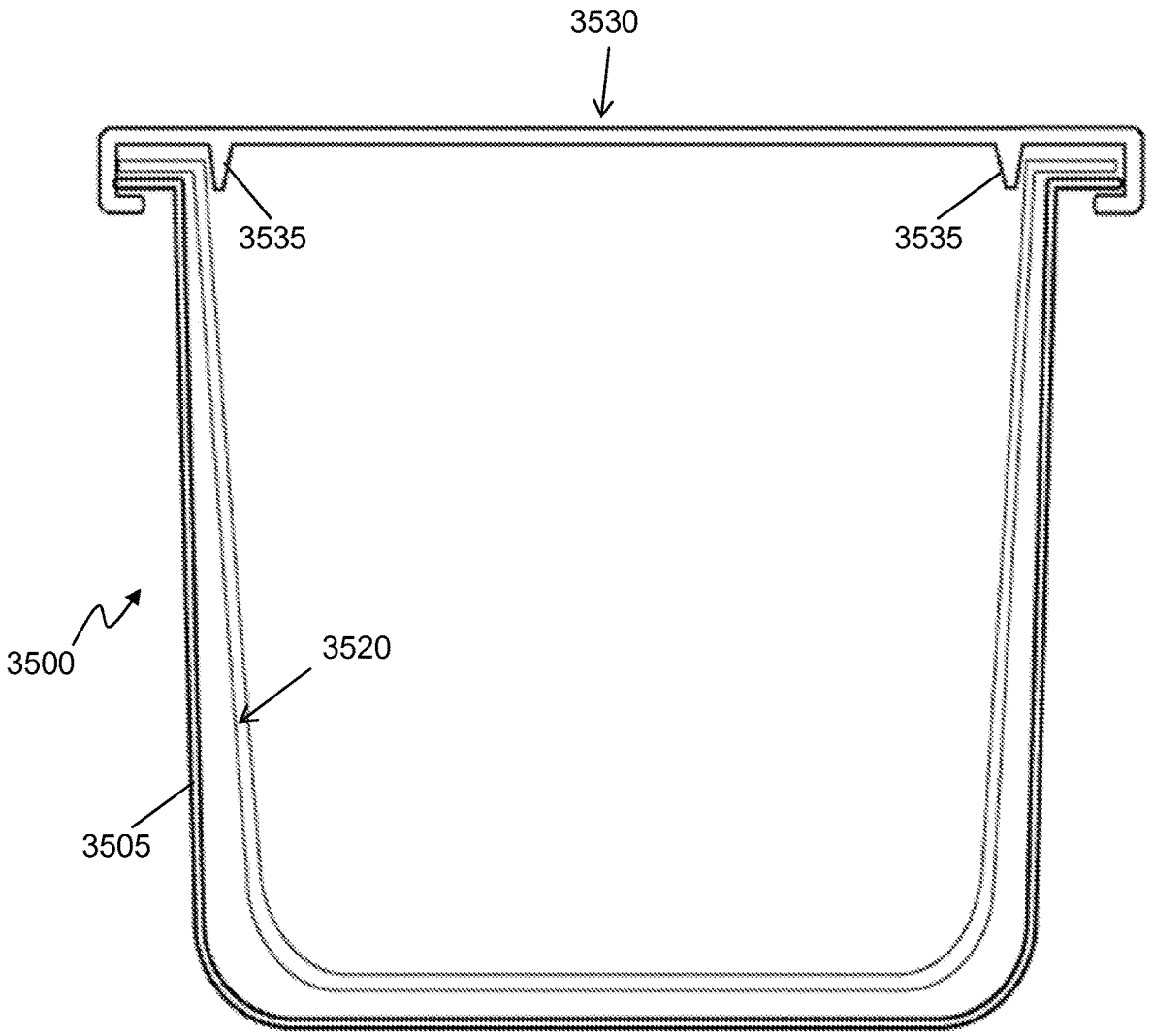
FIG. 35 shows a cap with a feature to support a structure of a container in accordance with an embodiment of the invention.

Optionally, a bit of support may be provided behind the pulp thread (this could be another part or even wall that comes down from the cap that gets threaded on). FIG. 35 provides an example of a cap that when installed supports the neck/orifice area.

The container may provide siftless construction (i.e., does not leak fine particles and dust). The container may be siftless even without a plastic liner. The container may be sufficiently enclosed to prevent leaking of particulate materials, even when particulate materials are very fine. Examples of such very fine materials that may be enclosed within the container may include materials of less than or equal to 5000 μm, 3000 μm, 1000 μm, 750 μm, 500 μm, 300 μm, 250 μm, 200 μm, 150 μm, 100 μm, 75 μm, 50 μm, 25 μm, 20 μm, 15 μm, 10 μm, 5 μm, or 1 μm.

The container may keep the particulate matter inside without allowing dust or particles to exit the container through the pulp walls or through joints between pulp parts.

The container may have double pulp walls or overlaps. The double walls or overlaps may help with bearing loads or protect glued areas. The double walls and/or overlaps may assist with the siftless construction. The double walls may both be formed from molded pulp. In some instances, the overlaps may both be formed from molded pulps. The double walls and/or overlaps may lay flush against one another.

The container design may permit the containers to stack efficiently (to palletize) for shipping. In some instances, containers may be stacked on top of one another. The containers may be stacked to form vertical columns. Optionally, they can be stacked onto a pallet and wrapped without the need to place small numbers in shipping cartons.

For some stacked containers, top loading may be provided. Load may be transferred through stacked containers. Registration of top to bottom units may be provided to make the stack stable. For instance, a bottom of a container may include an indentation and a top of the container may include a protrusion that fits into the indentation. Registration features may be provided at the top and/or bottom of containers so that when containers are stacked on one another they do not shift laterally. One or more top/bottom interlocking interfaces may be provided.

Containers may be stacked such that vulnerable areas are protected (such as the fitment area).

FIGS. 1-35 provide illustrations and examples of containers in accordance with embodiments of the invention. One or more features of the containers may be combined in various embodiments. The figures provide illustrations of all-pulp concepts (e.g., the entire container formed out of molded pulp). The containers may be formed without polymer components, such as a liner and/or polymer fitment. In some instances, a pulp container may have a fitment. The fitment may be formed from polymer, molded pulp, molded from starch based plastic, biopolymer, or any other material. In some instances, containers having a pulp-molded shell may have a fitment and a liner. The fitment and/or liner may be formed from molded pulp, polymer, or any other material.

In some embodiments, fitments may be shaped to receive threaded caps. In other embodiments, fitments may receive snap components, such as lids, flip lids, funnels, spouts, handles, etc. The fitments may interface with a closure mechanism. The fitment may be formed from molded pulp, polymer, biologically derived material or any other material. The closure mechanisms may permit opening and closing of the container. The closure mechanisms may be siftless (e.g., particulate matter in the container would not leak out, even if the container was inverted). The fitment may be provided at a top of the container. The fitment may be provided at an end of the container opposing an end of the container designed to rest on a surface. The fitment may be arranged for pouring the contents. The fitment may be arranged so that the use scoops out the container contents.

The container may have any shape. In some instances, the containers may be round. Alternatively, the containers may be cubic or rectilinear. The containers may have sharp corners or may have rounded corners.

The containers may have inserts that can be attached to the pulp. Inserts can be formed of molded pulp, polymer, sheet material, or any other material described elsewhere herein.

In some instances, the container may be used to hold particulate matter, such as litter for cats. In some instances, the container that is used to hold litter can be used for other purposes. A component of the container, after all of the litter has been dispensed, could be used as a litter tray, as a cat toy, as a cat house or any other device.

A one-time use version may be envisioned where the molded pulp container transports litter, and is then modifiable by the user. For instance, the tray functions as a litter, and then the unit is then configured for composting of the entire unit.

FIG. 1 shows examples of containers 100*a*, 100*b* that may be stacked on top of one another. The containers may be formed from one, two or more molded pulp shells 110*a*, 110*b*, 110*c*, 110*d*. In one example, two shells may be attached to one another to form the container body. The shells may meet at a parting line 120*a*, 120*b*. A parting line flange 125*a*, 125*b* may extend around the circumference of the body. Alternatively, no parting line is provided and an overlap is provided flat against the body of the container. The shells may form a top part 110*a* and bottom part 110*b*. Alternatively, the shells may form a front part and a back part.

In some instances, the top of the container may have a feature such as a cap 130*a*, 130*b*. The feature at the top of the container may extend or protrude from the container body. A bottom portion of the container may have a corresponding indentation 140*a*, 140*b*. Thus, when the containers are stacked, the top of the underlying container may fit into the indentation provided on the bottom of the overlying container.

The containers may optionally have an inner load bearing part 150*a*, 150*b*. The inner load bearing part may be enclosed within the molded pulp shells. The inner load bearing part may be made from the same material or different materials as the molded pulp shells. The inner load bearing part may be formed from cardboard, paperboard, molded pulp, polymer, or any other material described elsewhere herein. The inner load bearing part may be a corrugated material. The inner load bearing part may contribute to a siftless container by providing a mechanical barrier between the particulate and dust, and any openings between the parts of the assembled container. The inner load bearing part can reduce a requirement for a liner or coatings on the inside of the molded pulp shells. In some embodiments, the molded pulp shells may be unlined or uncoated on their interior and/or exterior surfaces.

In some embodiments, when containers are stacked on top of one another, the inner load bearing parts may be vertically aligned above one another. Much of the weight of the overlying container may rest upon the inner load bearing part.

Figure 2:
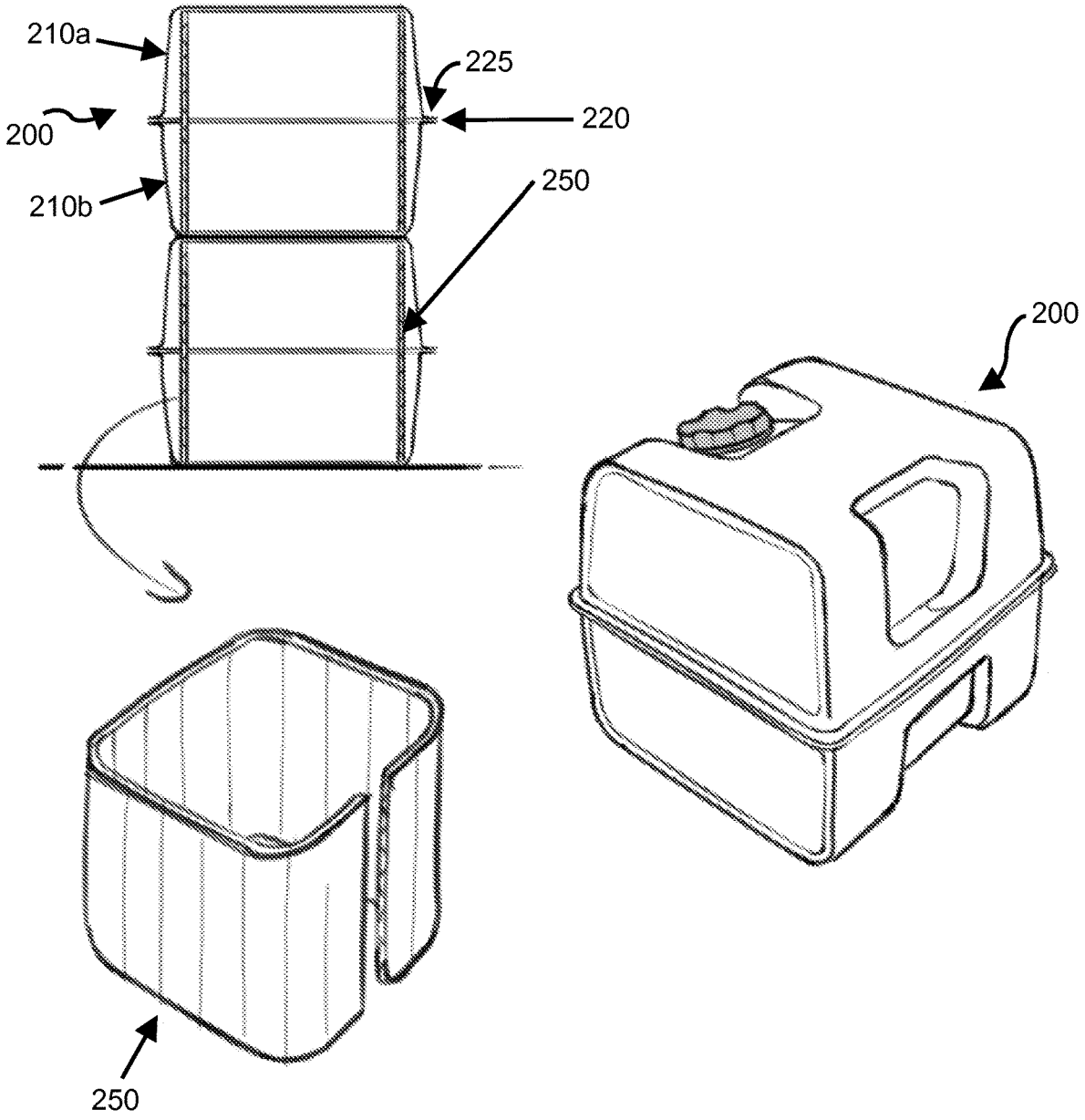
FIG. 2 shows additional examples of containers with load bearing parts in accordance with an embodiment of the invention.

FIG. 2 shows an additional view of a container 200 with an inner load bearing part 250. The outer shells 210*a*, 210*b* may be connected via adhesive. The adhesive may be a hot melt adhesive, latex contact adhesive, or pressure cure adhesive. For example, a flange 225 may be formed at a parting line 220, and adhesive may be disposed between the edges of the shells forming the flange. A secure connection may be provided between shells. The secure connection, which may use an adhesive, may aid in containing particulate materials within a container body. The outer shells may be formed from molded pulp or other materials described elsewhere herein. The inner load bearing part may be formed from corrugate, heavy, Type I molded pulp, Type II molded pulp, paperboard, or any other material described elsewhere herein. The inner load bearing part can form many shapes, such as square, rectangular, hexagonal, cylindrical, elliptical, etc. In some instances, the inner load bearing part can be formed from a sheet that is bent into the desired shape.

The inner load bearing part 250 may enable a reduction in outer secondary packaging (e.g., corrugate shippers). This may occur by creating a similar structural element inside the container. This arrangement may incorporate a vertical load-bearing function of the shipper into the container 200. Furthermore, the container may have features that positively register the containers laterally (e.g., like a shipping box), which may prevent the containers from sliding off one another when stacked. This arrangement may permit reduction or elimination of external shipping containers when shipping particulate materials on pallets in this container.

The molded pulp shells can be formed so a bottom shell 210*b* and a top shell 210*a* are provided. The bottom shell may be arranged like a pan so that particulate matter held within the container does not escape through gaps, joints, or other openings in the bottom part of the assembled container. The particulate material may include dust, powder, pellets, grains, or other materials described elsewhere herein. The bottom shell may be formed from a single integral piece that has been molded into a desired shape. Similarly, the top shell can be formed from the single integral piece molded into the desired shape.

FIG. 3 shows an example of additional features that may be provided on containers 300*a*, 300*b*, 300*c*, 300*d* for holding particulate materials. For example, one or more indentations 360 may be provided on the shells 310*a*, 310*b*. The indentations may have scalloped shapes, or any other shapes. One or more flat surfaces 365 may be provided on a surface of the container. In some embodiments, the flat surface does not have a parting line flange extending from the surface. The indentations can create a surface for adhesives to be used to attach the shells. A label 370 may be affixed to the flat surface. In some instances, one, two, three, four or more of the surfaces of the containers may be flat without a parting line flange.

Indented features 380*a*, 380*b* on the shells 310*a*, 310*b* may form a grip area. The grip area may be in the lower pulp-formed part 310*b* or lower 380*b* and upper 380*a* indented features may create a handle between the features where a user's grasp may force the upper and lower portions together structurally.

In some embodiments, handles may be provided on the container. Various possible configurations of handles are illustrated. In some instances, the handles 390*a*, 390*b* may be formed from a polymer. The handles may wrap around the entire container 300*d* or a portion of the container 300*c*.

The handles may support a bottom of the container or from a central portion of the container. In some instances, the handles may be provided around the exterior of the container. Alternatively, the handles may penetrate the shell of the container and pass through or be connected to an interior portion of the container. In some instances the handle is located such that the carrying load is advantageously carried by the molded pulp while minimizing or reducing the forces that may cause separation of a connection or a glued joint.

Figure 4:
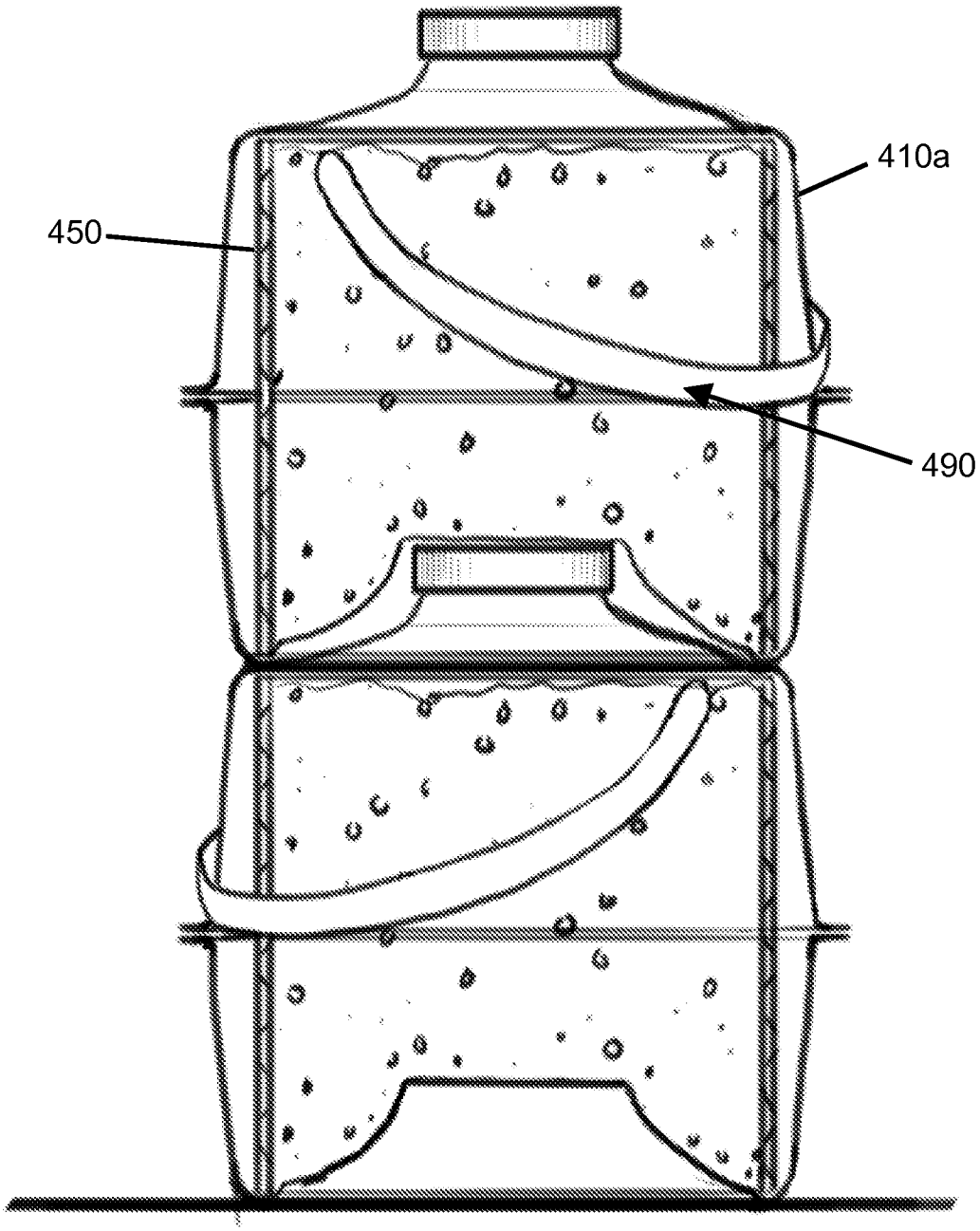
FIG. 4 shows an example of a pail handle for a container in accordance with an embodiment of the invention.

FIG. 4 shows an example of a pail handle 490 which may attach to an inner structural wall. For instance, the pail handle may pass through the outer shell 410*a* and be attached to the inner load bearing structure 450.

Figure 5:
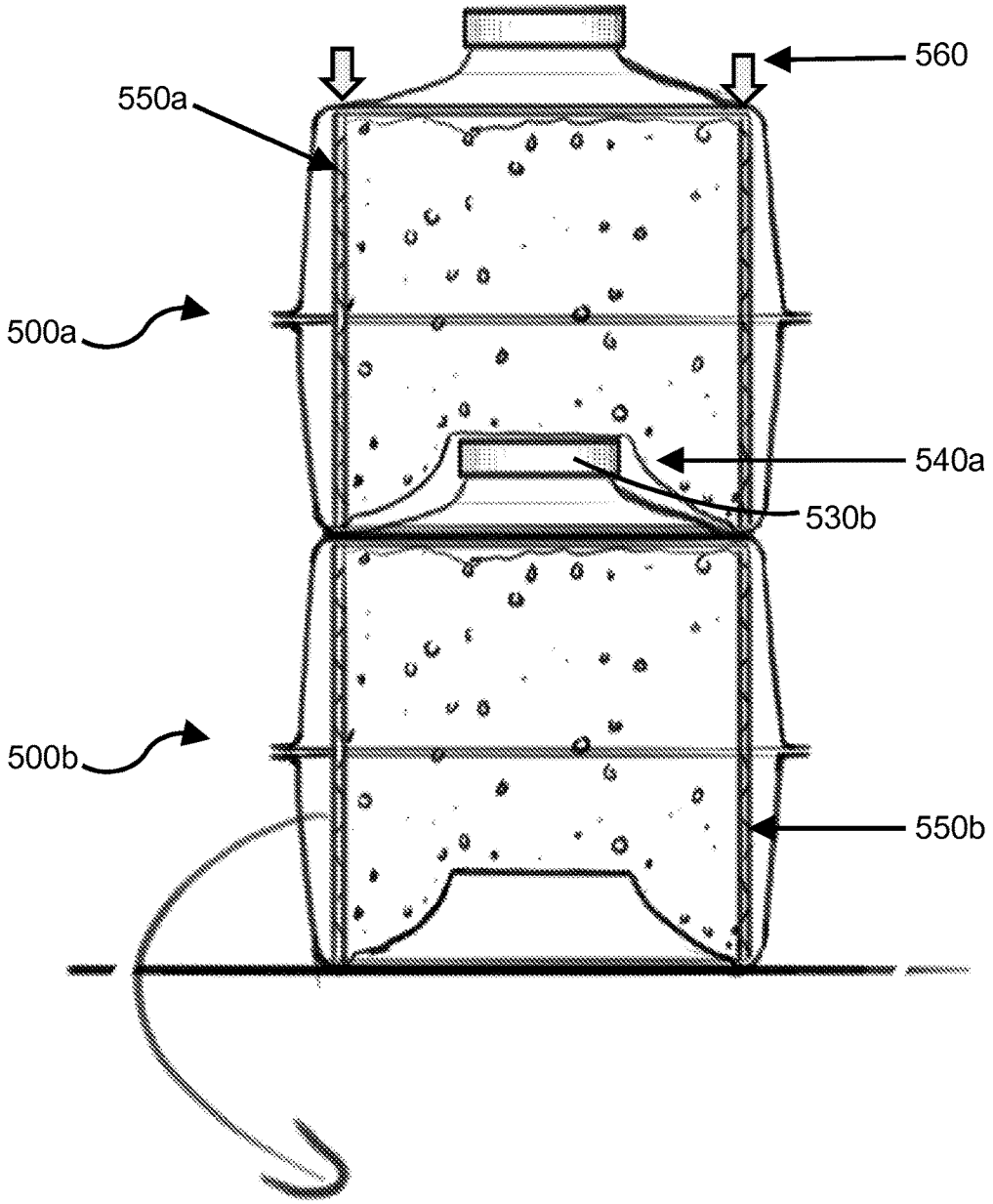
FIG. 5 shows an example of stacked container bearing a load in accordance with an embodiment of the invention.

FIG. 5 shows an example of stacked containers 500*a*, 500*b*. As previously described, an inner load bearing portion 550*a*, 550*b* may be used which may take advantage of its vertical configuration. The inner load bearing portion may be formed from a corrugate material, molded fiber, Type II molded fiber, or any other material described elsewhere herein. Nesting may occur between the top and bottom surfaces of the containers. For example, a bottom of a first container 500*a* may include an indentation 540*a* or other feature shaped to accommodate the top portion 530*b* of a second container 500*b*. The top portion may include a fitment, closure, shoulder features, or other features. This may permit the containers to be stacked on top of one another and for the vertical load bearing portions to directly take on the weight. The load bearing path may direct the load through the wall to the ground. The load may be a vertical load 560 that presses down on the containers. In some optional embodiments, the container may be formed without the inner load bearing member. In some embodiments, the indentation 540*a* may permit little or no load to be transferred to the top portion 530*b* when they containers are stacked on top of one another. At least some of the load on the lower container 500*b* provided by the upper container 500*a* may bypass the upper protruding portion 530*b* due to the indentation 540*a*.

Figure 6:
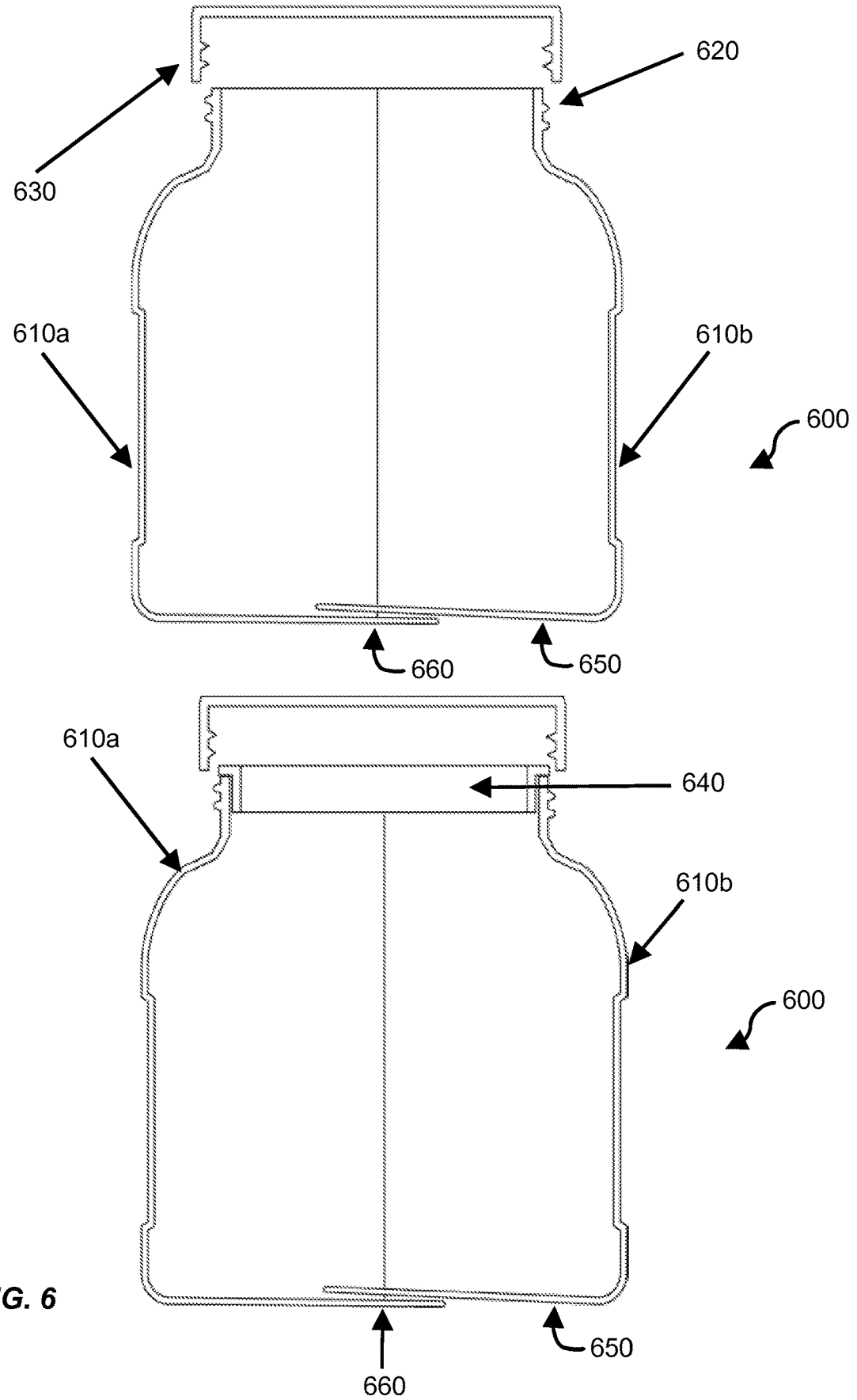
FIG. 6 shows an additional example of a container that may be used to hold materials in accordance with an embodiment of the invention.

FIG. 6 shows an additional example of a container 600 that may be used to hold materials, such as particulate materials. The container may be formed from one, two, or more molded pulp shells 610*a*, 610*b*. For example, two side shells may be connected to one another. In other embodiments, top and bottom shells may be used, or any number and configuration of shells. In some instances, the shells may be completely separable from one another, or may be connected via a hinge. A molded pulp shell body may comprise a hinged pulp shell with multiple pulp shells connected by a hinge, or may comprise multiple pulp shells from multiple pulp shell sides. The multiple pulp shell sides may include a first pulp shell side and a second pulp shell side that may overlap.

The molded pulp shells may integral threads 620 formed thereon. The threads may be formed via molding the fiber integrally with the rest of the shell. Threads may be molded integrally out of pulp fiber. Alternatively, machine tools may be used to form the threads. The threads may be formed on each of two or more side shells to form a smoothly threaded surface when the shells come together. Alternatively, the threads may be formed integrally onto a single shell. The molded pulp threads may be configured to mate with the threads of a screw top. The screw top may be a cap 630 that may screw onto a neck of the container to contain the contents therein. The threads of the cap may directly contact molded pulp threads.

In some embodiments, a thread support ring 640 may be provided. Alternatively, a thread support ring may not be needed. The thread support ring could be form from molded pulp, paper, cardboard, wrapped sheet material, plastic, metal, or any other material described elsewhere herein. The thread support ring may be inserted to contact an interior surface of the molded pulp shell(s). The thread support ring may have a lip or flange that may rest on top of the edge of the shell around the neck. The thread support ring, if inserted from the inside of the opening, may have a lip or a flange that contacts the inner part of the shell to retain the support ring. The thread support ring may add structural support around the neck of the container. The thread support ring may be attached to the shell(s) via adhesive or other techniques. Along the same lines, the container could have an integral feature at the opening for receiving a snap lid or a friction cap. Alternatively support ring (could be other than ring-shapes) could be used to add structural support to the opening in the pulp. The support ring may surround an orifice of a container.

In some instances, the container may have a bottom surface 650. The bottom surface may be the surface opposing the side of the container having the neck and threaded closure. The container may be designed to rest on the bottom surface. The bottom surface may be flat to permit the container to rest upon an underlying surface. Portions of two or more shells may overlap 660 on the bottom surface. For instance, a first pulp shell side may overlap with a second pulp shell side. The shells may overlap flat against one another. The surface formed by the overlapping pulp shell sides may be a substantially uniform surface. The degree of overlap may be greater than, less than, or equal to about 3%, 5%, 10%, 15%, 20%, 25%, 30%, 40%, 50%, 60%, 70%, 80% or 90% of the total bottom surface area.

As illustrated, the overlap 660 may occur on a bottom surface of a container. The bottom surface may be a surface of a container that the container rests upon when upright. The bottom surface may optionally be a surface opposing an orifice or opening. In other embodiments, the overlap may occur on a side surface of the container. Optionally, the overlap may occur at multiple side surfaces of the container. In some instances, overlaps may occur at both the bottom and side surfaces of the container.

Figure 7:
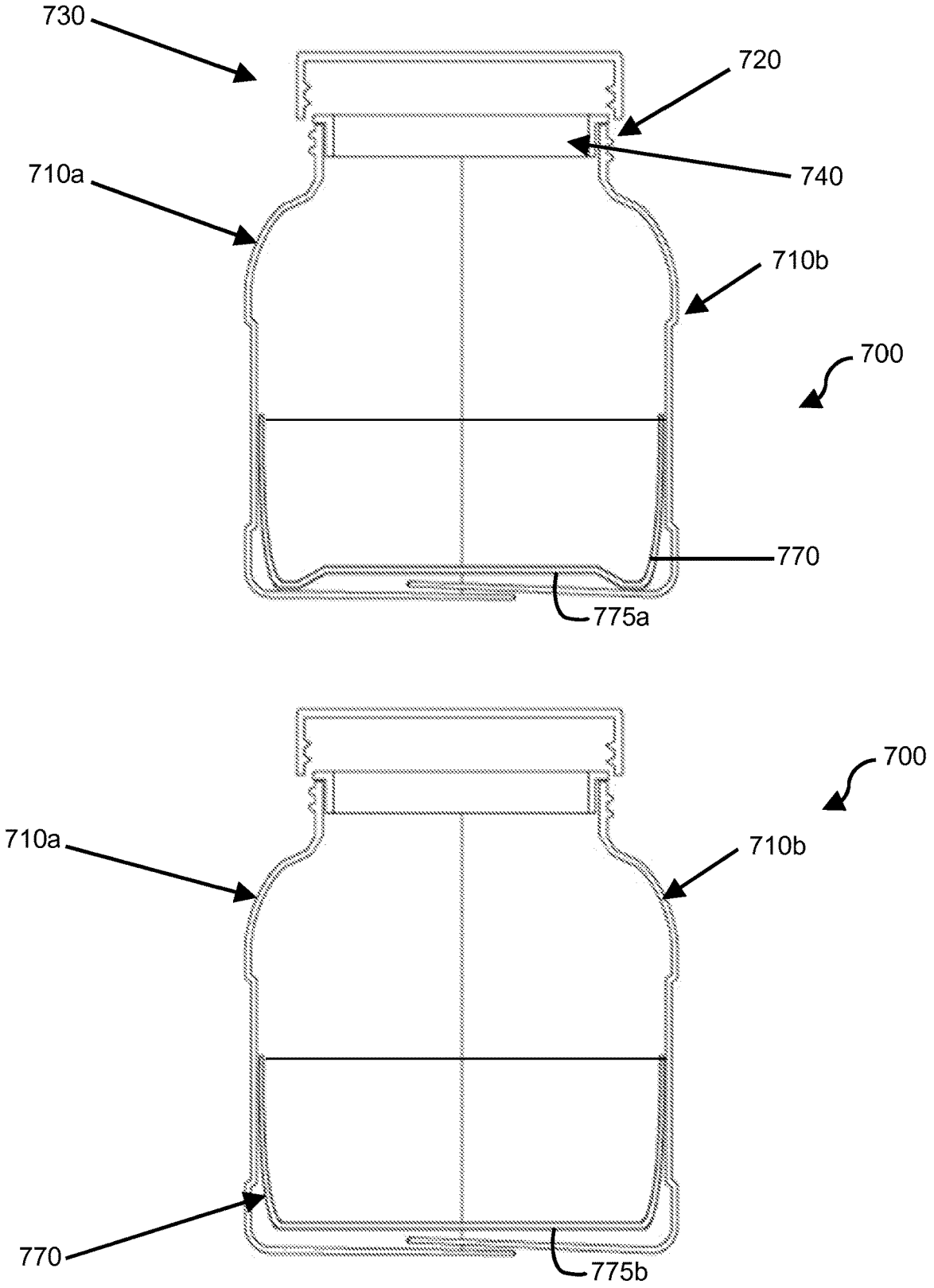
FIG. 7 shows an example of a container having a pan at the bottom in accordance with an embodiment of the invention.

FIG. 7 shows an example of a container 700 with a pan 770 at the bottom. The pan can be formed from molded pulp, polymer, or other material described elsewhere herein. The pan can be formed from the same material as the shells 710*a*, 710*b* of the container, or may be formed from different materials. The pan may be formed from a single integral piece. The pan may be molded. The pan may be provided within a molded container body. The pan may be enclosed within the shells of the container and may rest within an interior bottom surface of the container. The pan may cover an overlap of the shells on the bottom surface of the container. The pan may be mechanically registered with features to the container. Alternately, or in combination, the pan may be glued or sealed into place. The pan may have a raised bottom 775*a* or a flat bottom 775*b*. The pan may substantially cover the entirety of the interior surface of the bottom surface of the container. In another instance, the similar function of containing fine particulates could be performed by a bag that is shaped to substantially fit the interior at the bottom of the container. This bag could be formed of paper, of other biologically derived material. In other embodiments, a bag may be a polymer liner as described elsewhere herein. The bag may be configured to cover some or all of the side walls. Adhesive could be used to control the location of the bag and control the edge of the open bag and the seal to the interior of the container.

The pans could provide extra strength and prevent particulate materials from escaping through openings in the assembled container. The pan could help provide support when the container is lifted to reduce the likelihood of splitting along the parting line.

The container 700 may optionally have a closing mechanism. The closing mechanism may change state between an opened state and a closed state. When open, particulates may pass through an orifice of the container. When closed, the particulates may be contained within the container. The closing mechanism may include molded fiber pulp threads 720 that may engage with a threaded cap 730. Optionally, a thread support ring 740 may be provided.

Figure 8:
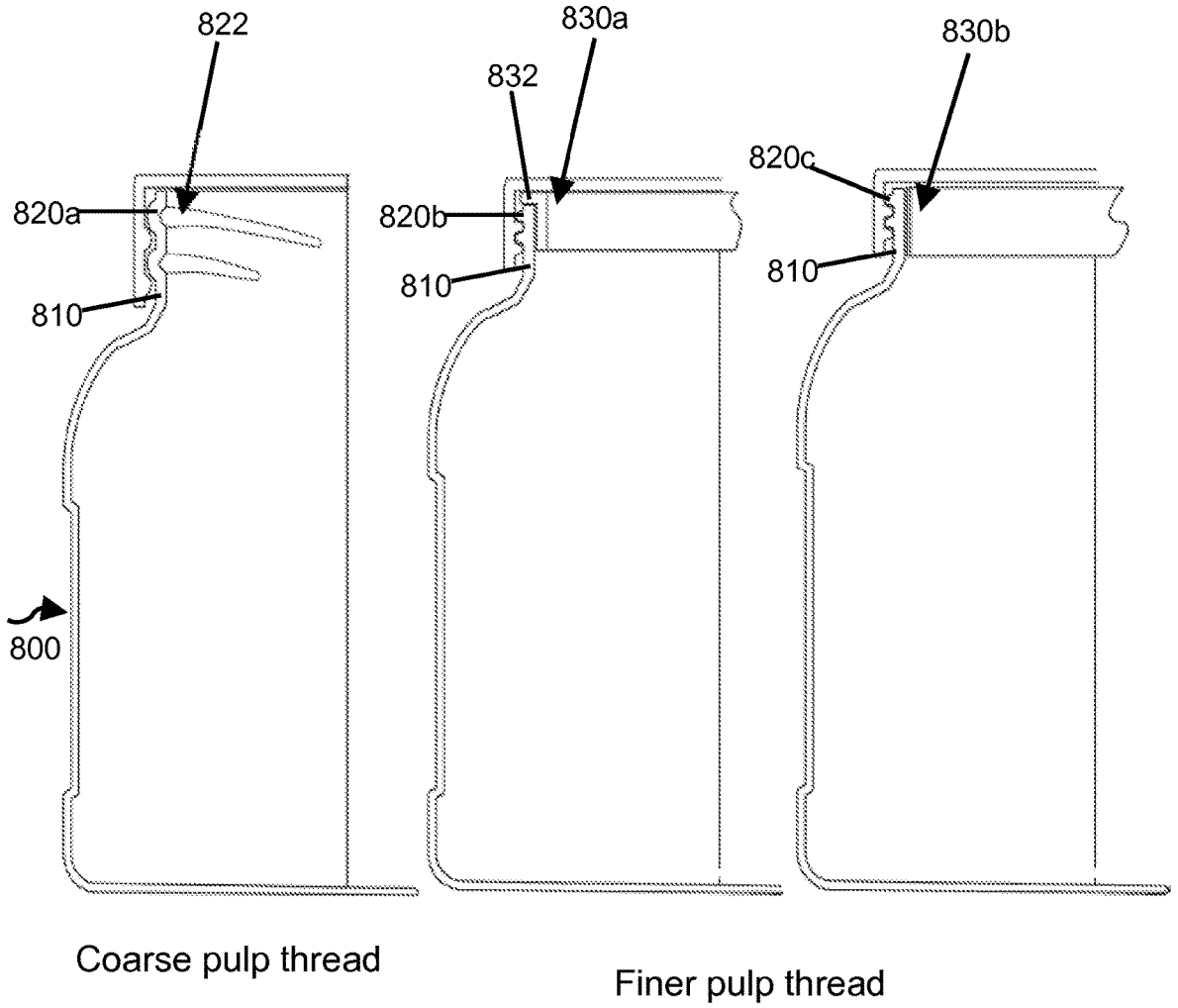
FIG. 8 shows an example of threaded features and supports for containers in accordance with an embodiment of the invention.

FIG. 8 shows examples of threaded features and supports for the containers 800. The container may have a body formed from shells. The container may have an opening or orifice through which the container can be filled with materials, or through which materials contained within the container can be dispensed. A neck 810 of the container may be formed around the orifice. The neck may include threaded features 820*a*, 820*b*, 820*c*. The neck and threaded features may be formed of molded pulp. In some embodiments, coarse molded pulp thread 820*a* could be formed entirely be a molded pulp part. Evidence of the molded threads may show up on an inside of the neck. For instance, the thickness of the molded pulp portions may remain constant (e.g., when the threads protrude on the outer surface of the neck, a corresponding indentation 822 appears on the inner surface of the neck). Alternatively, evidence of molded threads need not show up on the inside of the neck and the inside may be smooth.

The size of the threads of the container may vary. In some instances, the threads may be coarse, while in other instances, the threads may be finer. For instance, the threads may be spaced about 1 cm or less apart, 7 mm or less apart, 5 mm or less apart, 4 mm or less apart, 3 mm or less apart, 2 mm or less apart, 1 mm or less apart, 0.5 mm or less apart. Thread size may vary according to pulp types, assembly, size of fitment/cap, contents, or any other features. Thread size may be selected in accordance with one or more of the factors mentioned.

Optionally, ring inserts 830*a*, 830*b* may be provided at the neck of the container. The ring inserts can be a ring or band formed from various materials such as molded fiber, paperboard, type II molded pulp, thermoformed molded pulp, polymer, compostable polymer, or any other material described elsewhere herein. The ring may be molded. The ring may add structural support to the molded pulp thread or threaded region.

The ring may be inserted into the neck of the container and may contact an inner surface of the neck. The ring may be provided around the entire circumference of the neck. Alternatively, the neck may go around a portion of the neck circumference. The ring 830*a* may have one or more flanges 832. The flange may form a lip that may rest on top of the neck edge. Alternatively, no flange may be needed and the ring 830*b* may lie flush against the inner surface of the neck. In some alternate embodiments, the one or more flange of the ring may mate or interlock with one or more flange receiving regions of the neck. For example, one or more complementary groove or indentation may be provided within the neck that may mate with or accept the flange from the ring.

In some embodiments, no fitment may be required for the container. Alternatively, a fitment may be provided. The fitment may directly contact the molded pulp neck or may contact the support ring. In some instances, the fitment may partially serve the function of the support ring. The fitment may extend beyond the neck and/or may have one or more threaded features. The fitment may be configured to mate with a cap (e.g., screw in with the cap). The fitment may be connected to the molded pulp neck and/or ring via one or more fitment flanges. The fitment flanges may rest on top of the neck and/or ring edge. Alternatively, the fitment flange may be accepted into a complementary flange receiving region of the molded pulp neck or inner ring (e.g., groove). The fitment may interlock with the neck of the container. The interlock may prevent the fitment from moving in an axial direction relative to the container. In some instances, the interlock may or may not prevent the fitment from moving in a radial direction relative to the container. The fitment may be formed from a polymer or any other material described elsewhere herein.

In some instances, no liner is required for the container. The materials within the container may directly contact the interior surface of the container walls. The materials within the container may directly contact an interior surface of an inner load bearing mechanism. The materials within the container may directly contact a molded pulp surface. Alternatively, a liner may be provided. In some instances, the liner may be formed from a polymer or other flexible material. The liner may be a pouch or bag. The liner may be enclosed by the one or more shells of the container. The bottom of the liner may rest on the bottom surface of the container. The liner may contain the materials (e.g., particulate materials) therein. The liner may prevent the materials from directly contacting the shells or other pulp features of the container. The liner may be connected to a fitment, support ring, or any other component of the container. In one example, the liner may be connected to the fitment via welding or adhesives. The liner may have an opening or orifice coextensive with an opening or office of a container body. In some embodiments, liners may not be used with coatings on the shells or mechanical features.

Figure 9:
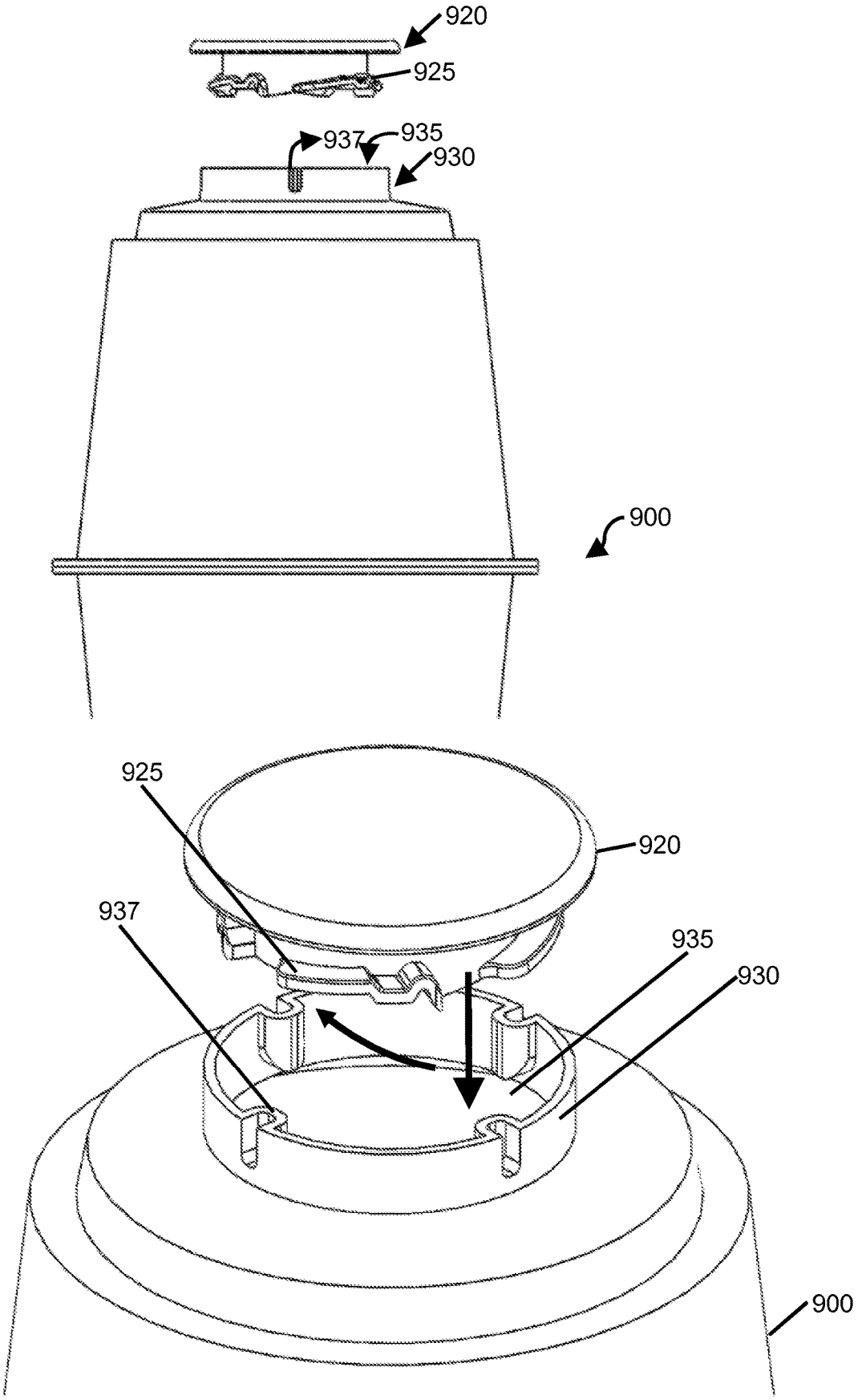
FIG. 9 provides an example of a closure system for a container in accordance with an embodiment of the invention.

FIG. 9 provides an example of a closure system for the container. The closure system may be a turn closure system. For instance, a lid 920 may come into contact with the body of the container 900 and turned to close and/or lock the lid onto the body of the container. A quarter-turn may be sufficient to lock the lid onto the body. In other embodiments, other degrees of turn may be used or required to lock the lid onto the body.

The body of the container 900 may be formed from molded pulp. The container may have a neck 930 surrounding an orifice 935 through which materials held by the container may be dispensed. A twist cap 920 closure system is conceived of where the pulp mold's line of draw is axial through the orifice and the orifice neck is a single part. These constraints drive the conception of features in the pulp that contact the cap to be on the inside of the pulp orifice if simple tooling with no sliding action to accommodate undercuts, is to be used. The neck may have one or more molded pulp features, such as molded nubs 937. The nubs may extend into the orifice of the container. The lid may have features 925 that lock into the molded pulp nubs. For instance, the lid may have one or more protrusion (e.g., undercut features) that may slide in under the nub when the lid is pressed down on the container and turned. The protrusion may also include a rise and fall which may provide a locking sensation and place for the nub to rest. The lid may be formed from a polymer, molded pulp, or any other material described elsewhere herein.

Figure 10:
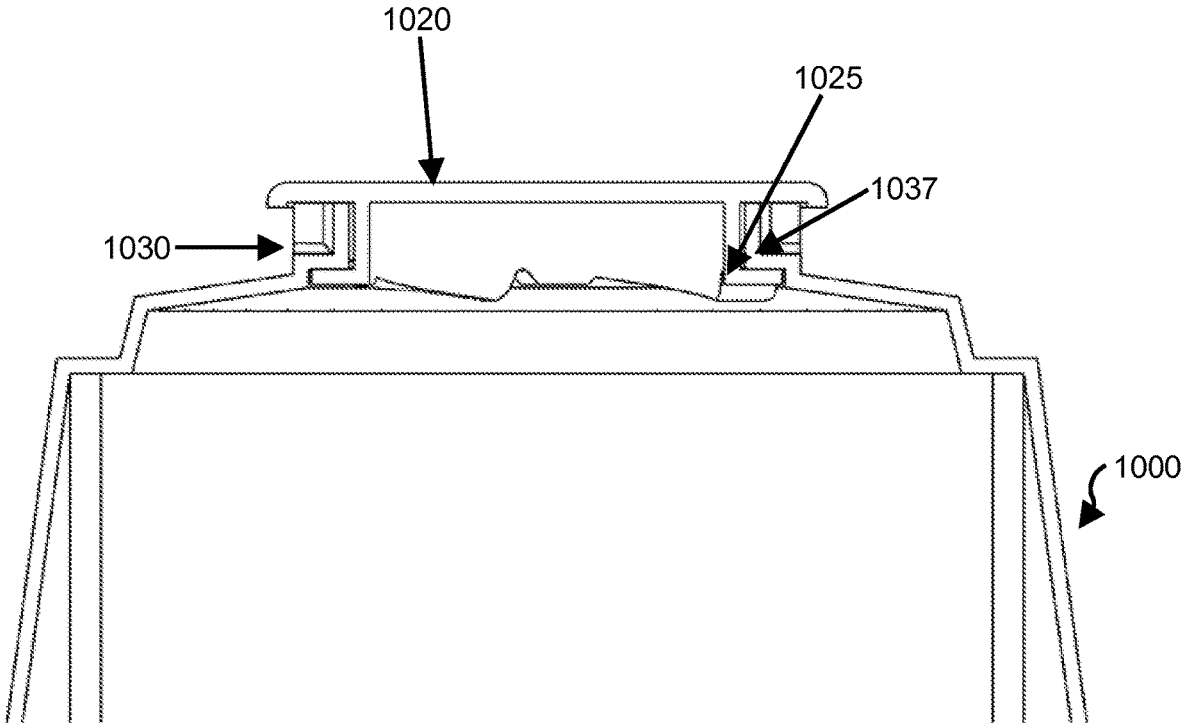
FIG. 10 provides an example of a closure system when a container is closed in accordance with an embodiment of the invention.

FIG. 10 shows an example of the closure system when the container 1000 is closed. As shown, an undercut feature

1025 of the lid 1020 may slide in beneath the molded pulp nub 1037 of the neck 1030. This may keep the lid fixed to the container body.

Figure 11:
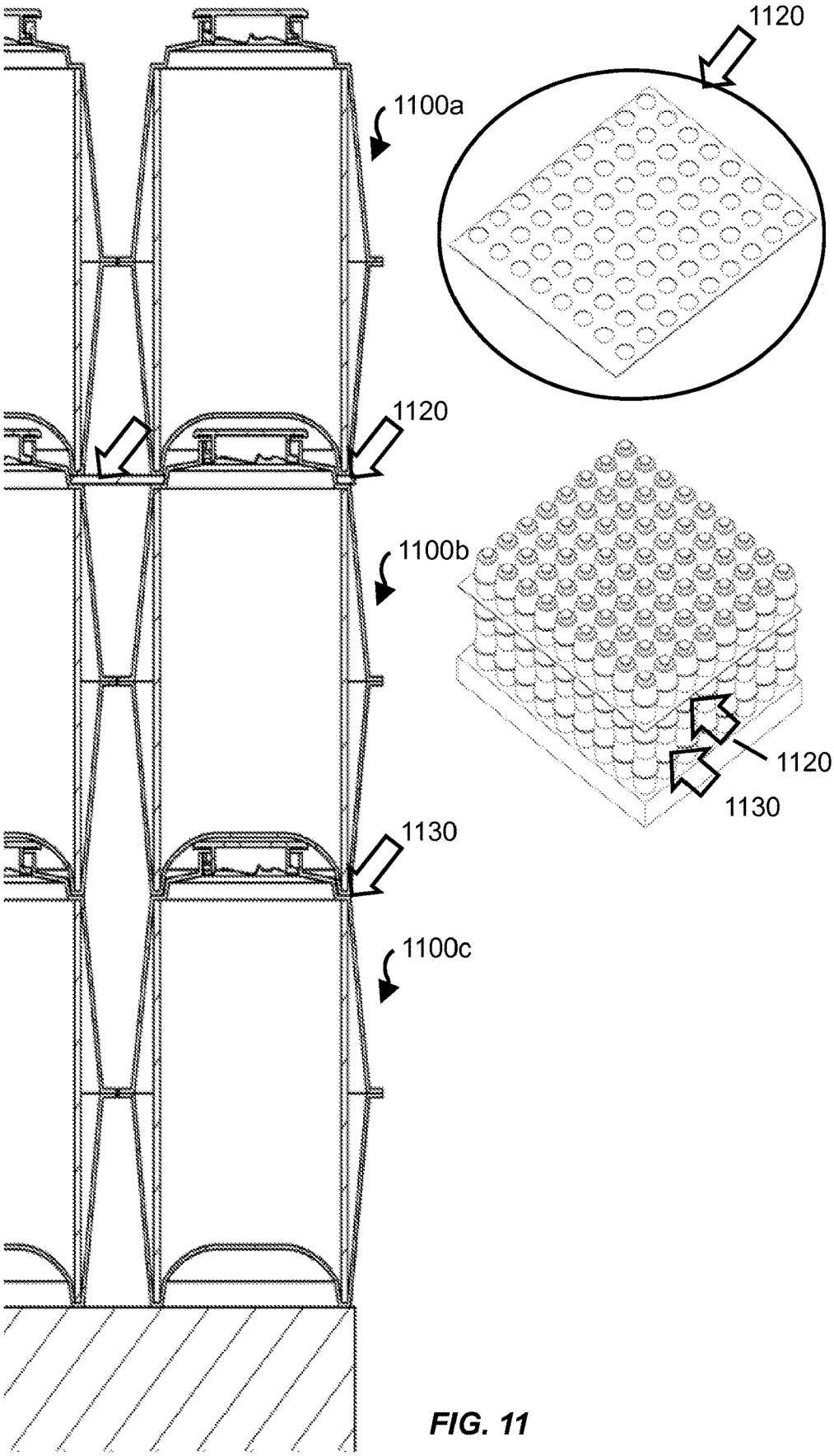
FIG. 11 shows an example of an arrangement of containers in accordance with an embodiment of the invention.

FIG. 11 shows an example of an arrangement of containers 1100*a*, 1100*b*, 1100*c*. One or more containers may be stacked. In some instances, containers may be arranged in one or more rows. The container arrangements may form an array. The containers may be stacked on top of one another to form vertical columns. In some instances, multiple layers of arrays of containers may be stacked on top of one another. Optionally, one or more slip sheet 1120 may be provided to help keep the arrangement of containers together.

A slip sheet may be a sheet with one or more holes corresponding to locations of the containers. For example, if arrays of containers are provided, the slip sheet may have an array of holes corresponding to the array of containers. A slip sheet may be formed from a polymer or any other material described elsewhere herein.

A perforated slip sheet may create a strong palletized load. The slip sheet may lock the top of containers into place. For instance, a slip sheet may be provided between a lower container and an upper container. The slip sheet may lock the top of the lower container in place while allowing a load path from the upper container to align with the lower container. The containers may optionally have inner load bearing structures. In some instances, registration features may be provided between the lower and upper containers (e.g., corresponding protrusions and indentations). The registration features may allow the sleep sheet to connect the containers around the registrations. The registration features may also keep the containers in place when the containers are stacked, even without the slip sheet. The registration features may prevent a lower container from moving laterally with respect to the upper container and vice versa. In some instances, containers may be stacked on top of one another without providing a slip sheet 1030 between them. In some other instances, slip sheets may be provided between stacked containers. In some instances, each layer of containers may have a slip sheet between them. Alternatively, just selected number or arrangement of layers of containers may have a slip sheet between them. The containers may be securely stacked with or without the slip sheet.

Figure 12:
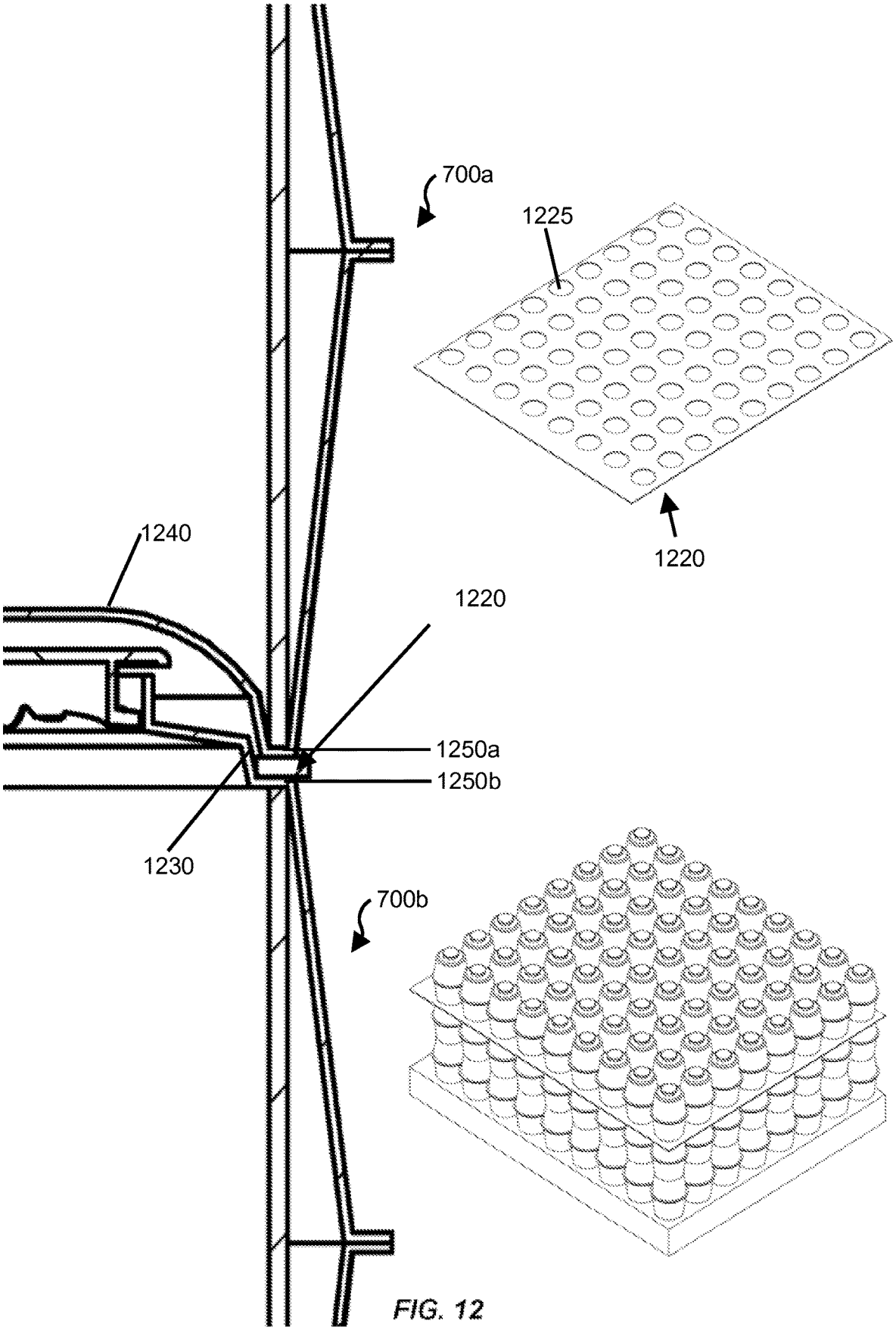
FIG. 12 shows a close-up of an interface between containers in accordance with an embodiment of the invention.

FIG. 12 provides a close up of an interface between an upper container 700*a* and a lower container 700*b* with a slip sheet 1220 between them. A protruding registration feature 1230 of a container may pass through a hole 1225 of the slip sheet. The slip sheet may go around a protruding registration of a container. An indented registration feature 1240 of the other container may accept the protruding registration of the container. In some instances, load bearing portions 1250*a*, 1250*b* of both containers may contact the slip sheet.

Figure 13:
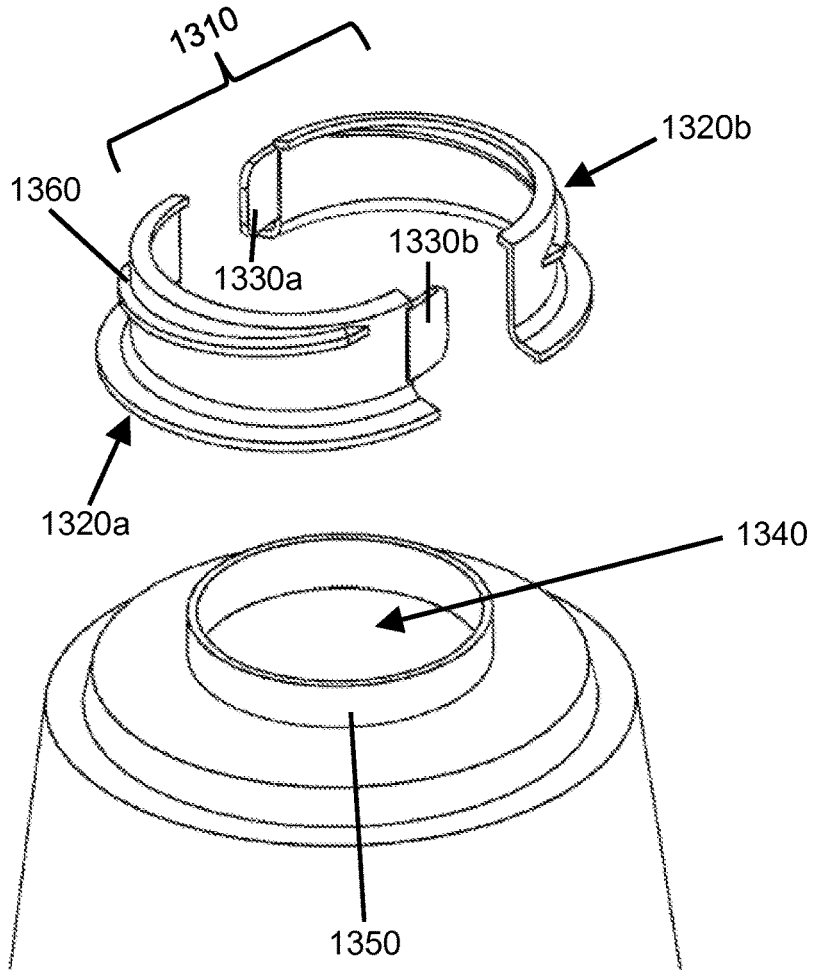
FIG. 13 shows an example of a multi-part fitment for a container in accordance with an embodiment of the invention.
Figure 13:
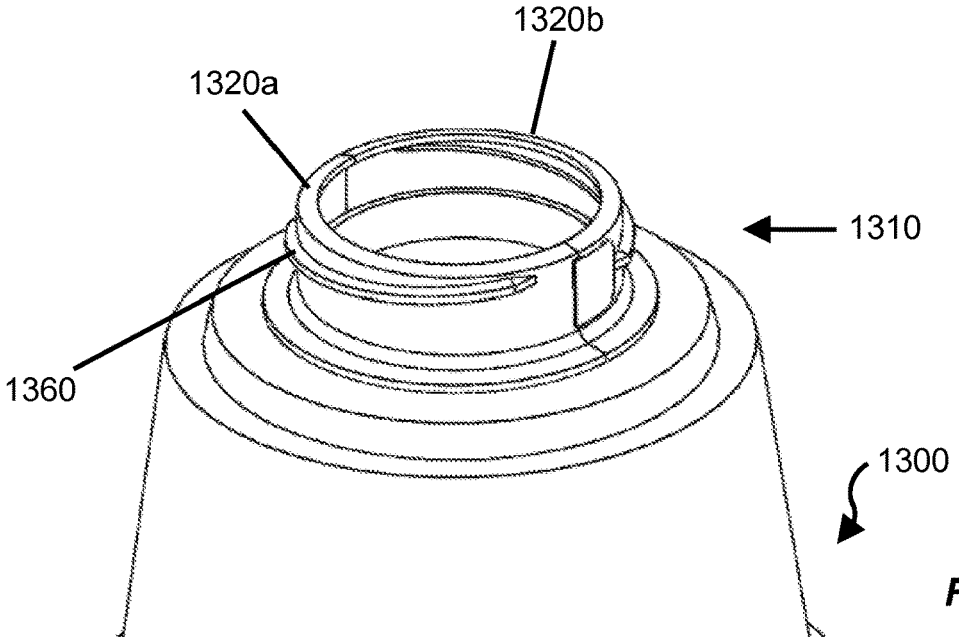

FIG. 13 shows an example of a container having a multi-part fitment 1310. The multi-part fitment may be formed from molded fiber/pulp, or any other material described elsewhere herein. The multi-part fitment may be assembled into a complete fitment. The multi-part fitment may be formed from two, three, four, five or more parts 1320*a*, 1320*b*. The fitment parts can include one or more features 1330*a*, 1330*b* (e.g., flaps, grooves, tabs interlocks, flanges, collars, etc.) to facilitate assembly into the complete fitment. Features may also be provided to facilitate attachment of the fitment parts and/or the complete fitment to the rest of the container. The multi-part fitment may include threads 1360 or other surface shapes that may be continuous when the multiple parts are connected. The threads or other portions of the multi-part fitment may be made from molded pulp fiber, or other materials.

The container may have an orifice 1340. The multi-part fitment may be configured to fit around the orifice. The container may optionally have a neck 1350 or other molded portion. The multi-part fitment may be attached to the neck of the container. The neck of the container may be formed of molded pulp or other material molded to the upper part of the container. The multi-part fitment can be attached to the rest of the container by being inserted through a hole or otherwise attached to the molded upper part. The multi-part fitment may be attached with adhesive, crimps, through a tight-fitting hole, fasteners, tape, snap-lock feature, or any other attachment technique.

In some instances, the parts of the multi-part fitment may be completely separable from one another.

Multiple part fitments may be advantageously used for simplicity of molded-fiber tooling and processing. Undercuts, and action in the tool may be challenging, so multiple parts may be assembled together to create a more complex part.

Figure 14:
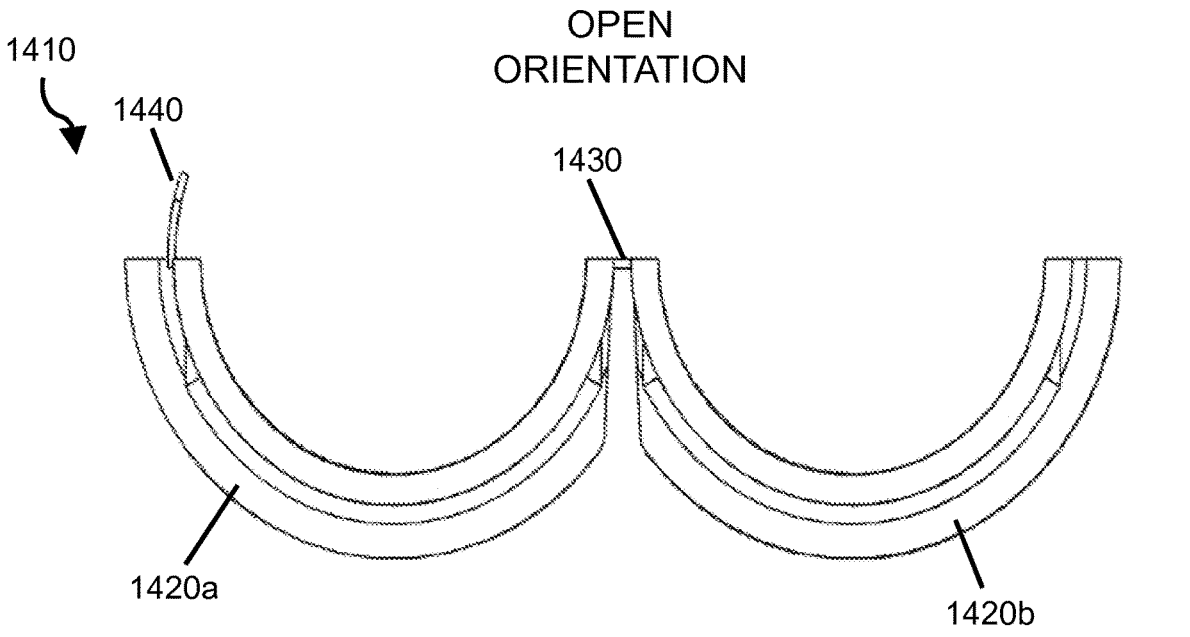
FIG. 14 shows an example of a hinged fitment in accordance with an embodiment of the invention.
Figure 14:
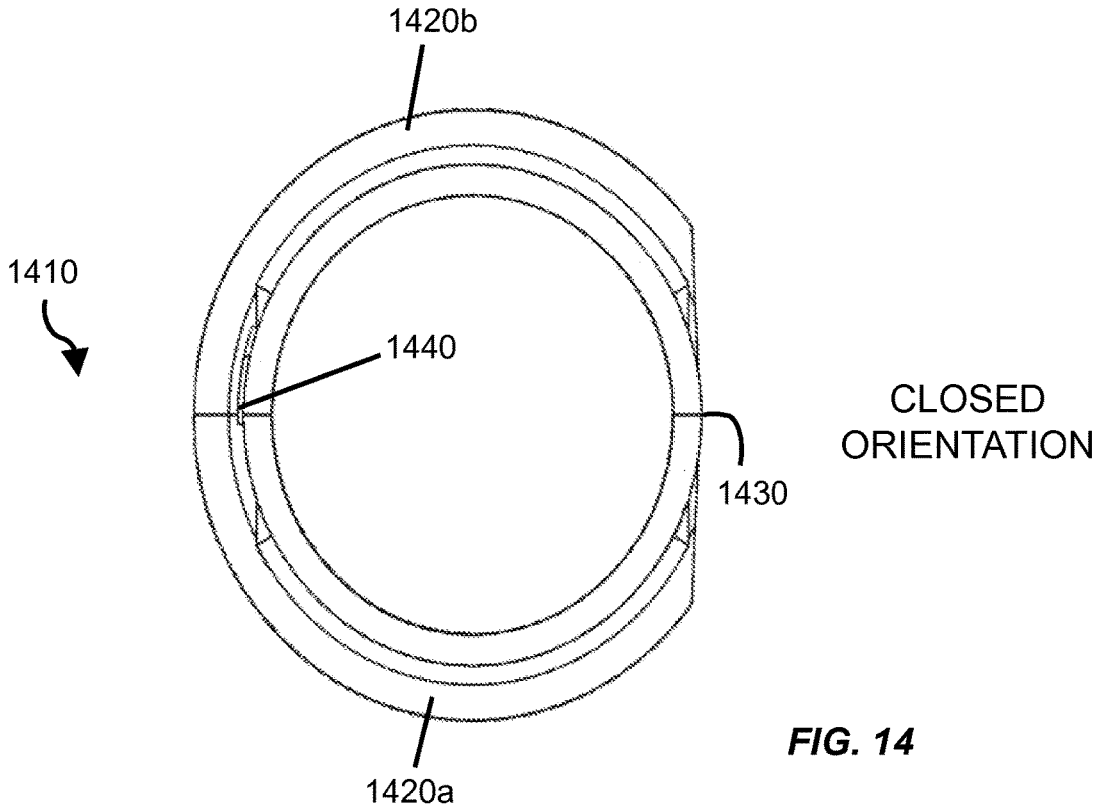

FIG. 14 shows an example of a hinged fitment 1410. The fitment may be hinged so that the parts 1420*a*, 1420*b* of the fitment may move relative to one another about the hinge 1430. The hinged fitment may be formed from molded fiber/pulp or any other material described elsewhere herein. The hinged fitment may advantageously permit simplicity of molded fiber/pulp tooling and processing. For instance, with traditional tooling, undercuts and action in the tool may be challenging. In some embodiments, the molded fiber fitment can be molded in an open state and then assembled into a complete fitment. The fitment part could have features 1440 (e.g., hinges, flaps, grooves, tabs, interlocks, overlaps, flanges, collars, etc.) to facilitate assembly to the other fitment part, or facilitate attachment to the rest of the container. The features used will based on the anticipated force directions that the attached fitment must resist. The hinged fitment may have an open state and a closed state. The features may help keep the fitment closed. The fitment may be molded in an open state and then folded to a closed state for use. The simpler moldable parts may be folded together to create a more complex part.

Figure 15:
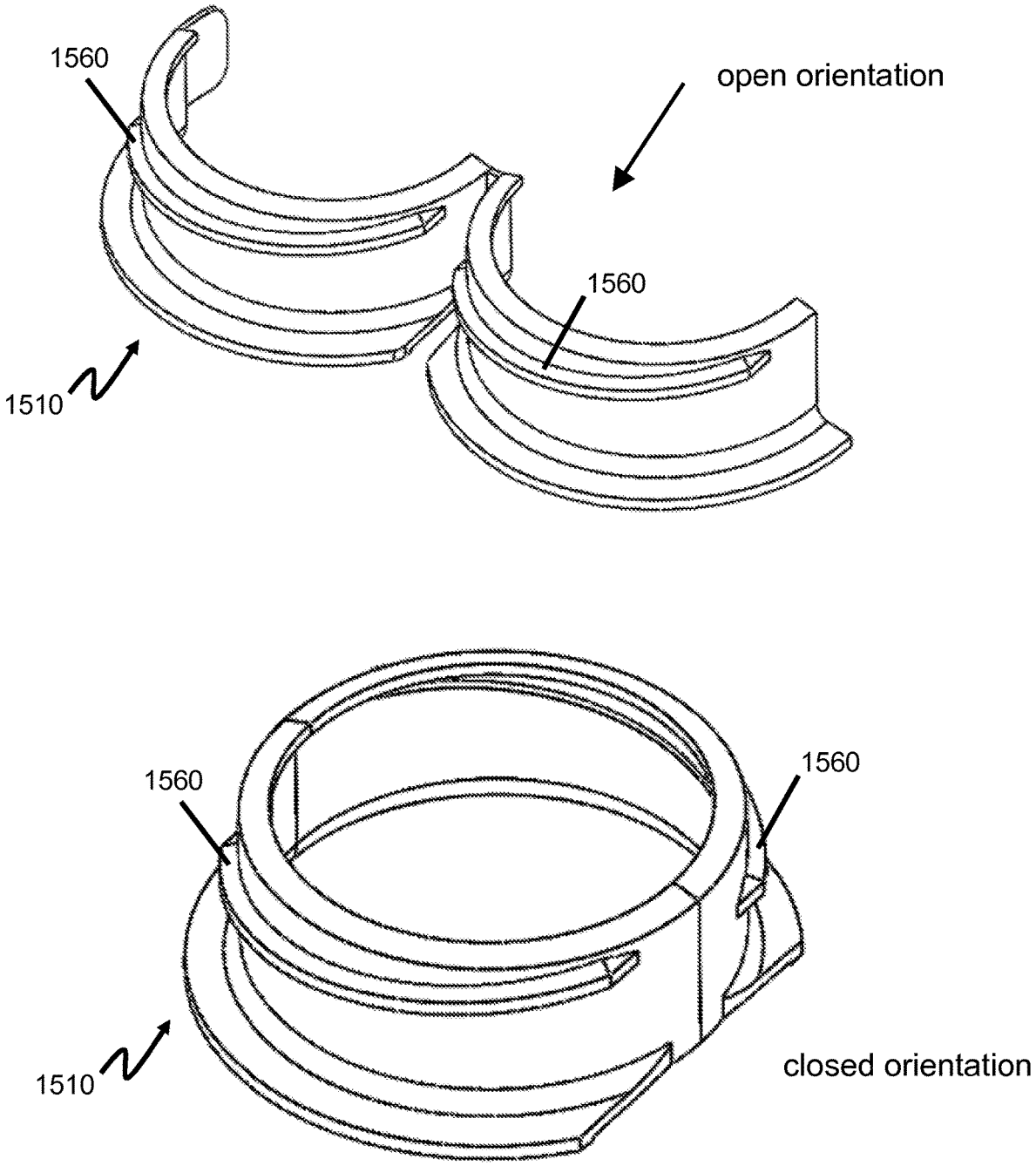
FIG. 15 shows an additional illustration of a hinged fitment in accordance with an embodiment of the invention.

FIG. 15 provides an additional illustration of a hinged fitment 1510. A multi-part or hinged fitment may also include threads 1560 or other features that have been molded thereon. The threads or other features may be formed of molded pulp. When the multi-part fitment is assembled into a complete fitment or the hinged fitment is closed, the threads or other features may be correspondingly shaped to accept a closure, such as a threaded screw cap.

Figure 16:
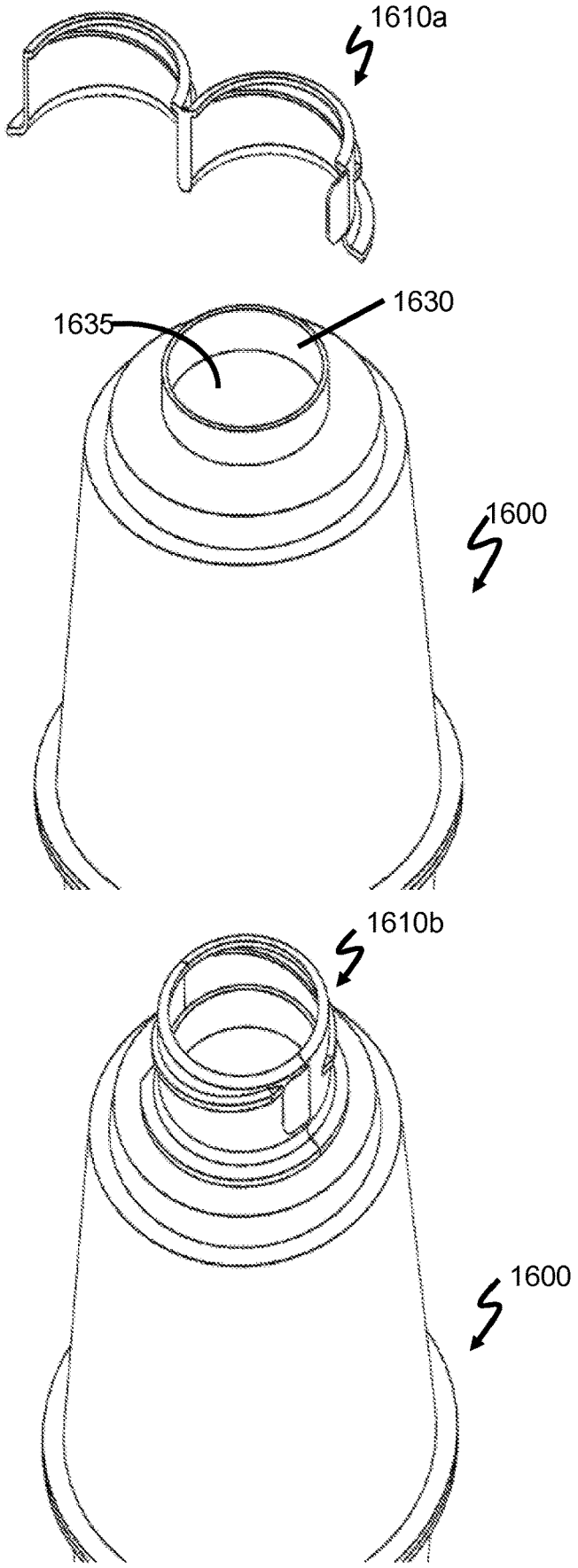
FIG. 16 shows an example of a hinged fitment being attached to a container in accordance with an embodiment of the invention.

FIG. 16 shows an example of a hinged fitment 1610*a*, 1610*b* being attached to the rest of the container 1600. The hinged fitment may be open 1610*a* prior to being attached to the container. The hinged fitment may be closed 1610*b* when attached to the rest of the container. For example, the container may have a neck 1630 surrounding an orifice 1635, and the hinged fitment may be closed around the neck. The hinged fitment may be attached to neck via mechanical pressure, or adhesives, or any other attachment or fastening techniques described elsewhere herein may be used. The fitment may be placed in the container part tool resulting in an over-molded connection between the fitment and container.

Figure 17:
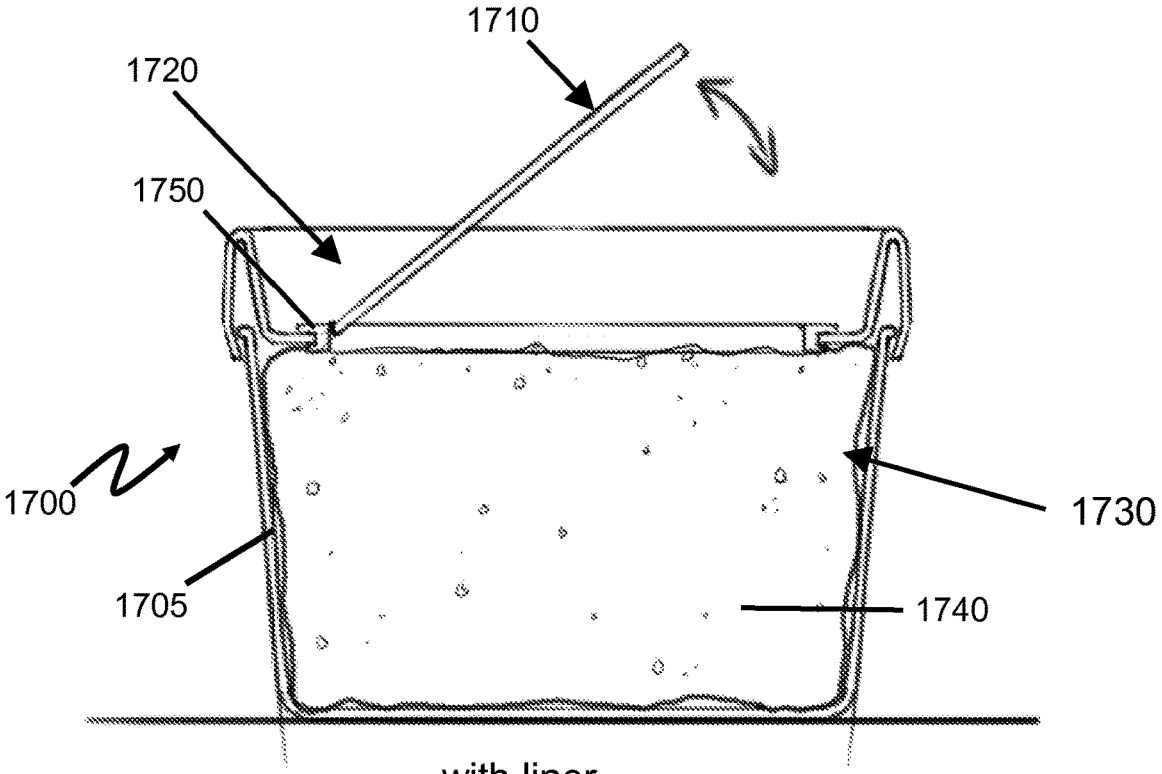
FIG. 17 shows an example of a container with a flip lid in accordance with an embodiment of the invention.
Figure 17:
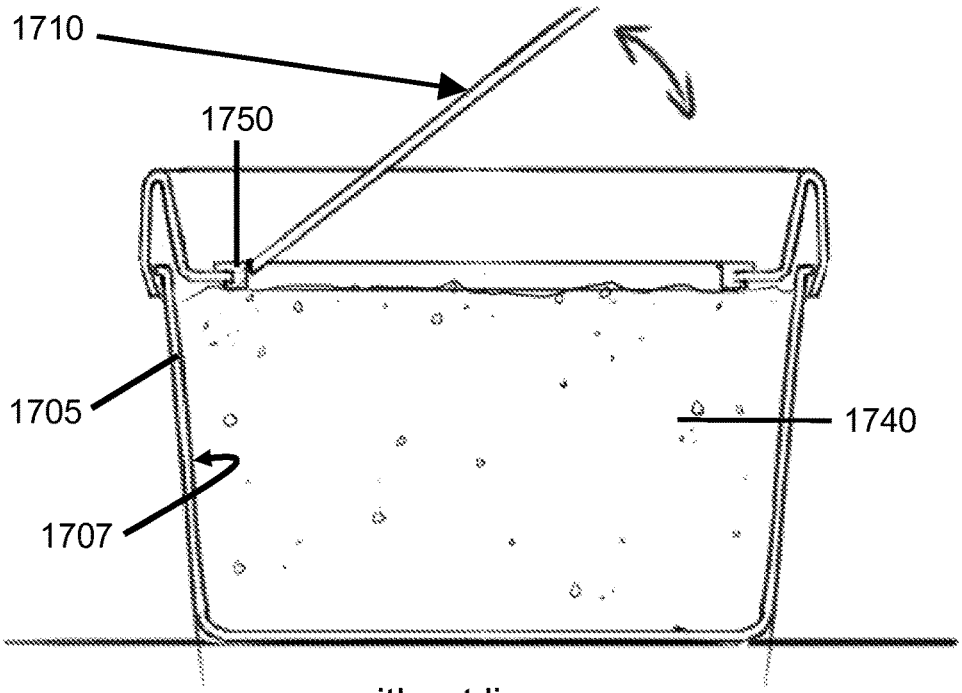

FIG. 17 shows an example of a container 1700 having a flip lid 1710. The container may have a body 1705 formed from molded pulp. The body may be formed from a single molded piece or multiple pieces. Particulate materials 1740 may be held within the body of the container.

A lid frame 1720 may rest on the body 1705 of the container, and may support the flip lid 1710. The lid frame and/or flip lid may be formed from molded pulp, cardboard, paperboard, polymer/plastic, or any other material. The lid frame and flip lid may be formed from the same material. Alternatively, they may be formed from different materials. A hinge 1750 or other mechanism may be provided which may permit the flip lid to open up while still being attached to the lid frame. Alternatively, the flip lid may come off. The flip lid may remain in a closed position with aid of gravity. In some instances, an additional locking mechanism may be provided to keep the flip lid closed. The lid frame may be shaped so that a perimeter of the lid extends upwards, while the flip lid is provided in a lower portion.

Optionally, the container 1700 may have a liner 1730. The liner may contain the particulate materials therein, and may prevent the particulate materials from directly contacting a molded pulp shell of the container. The liner may be formed from a flexible material, such as a polymer. The liner may be attached to the body of the container and/or the lid frame. The liner may be shaped and/or sized so that the weight of the liner and its contents are borne by the bottom surface of the container.

In other embodiments, the container 1700 does not have a liner. The particulate materials may directly contact the container body 1705. An interior surface 1707 of the container body may directly contact particulate materials. In some instances, the container body may be formed from a single piece, which may prevent or reduce the likelihood of particulate materials escaping the container. The container may be configured to be siftless.

Figure 18:
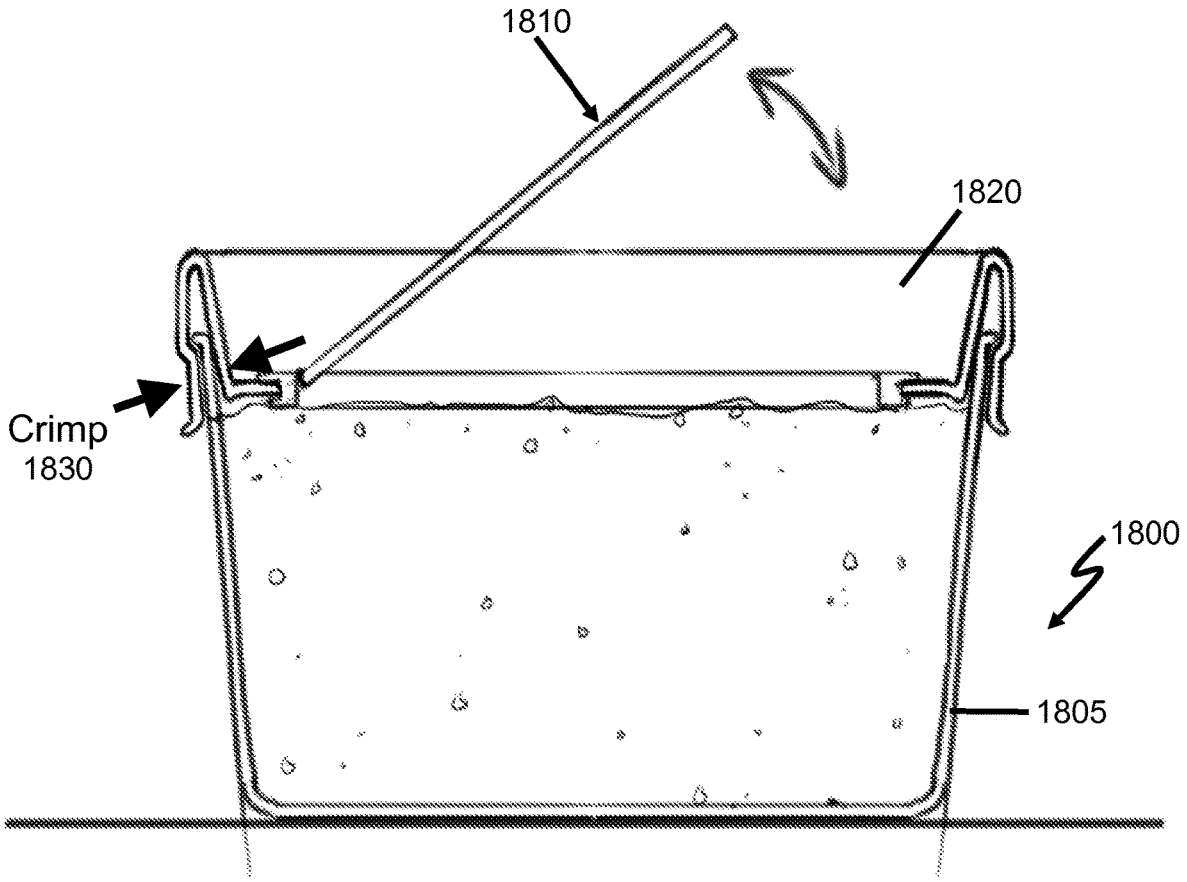
FIG. 18 shows an example of a container with a flip lid and attachment mechanisms in accordance with an embodiment of the invention.

FIG. 18 provides an example of a container 1800 with a flip lid 1810 and attachment mechanisms. A flip lid frame 1820 may be attached to a body 1805 of the container. In some instances, both the flip lid frame and the body of the container may be formed from molded pulp. Alternatively, they may be formed from other materials, and/or may be formed from the same or different materials as one another. In one example, the lid frame may be attached to the body of the container via crimping 1830. The top lid frame can be crimped onto the bottom container body after filling the container with the materials. This may allow the laid to be transferred through the particulate materials when the containers are stacked. The crimp attachment between the top and bottom parts can be supplemented with adhesives, fasteners, tape, perforations, or any other fastening mechanism. Alternatively, any of the other fastening mechanisms may be used as an alternative to crimping.

In some embodiments, the filling/sealing operation of the container may include one or more of the following steps. The lower tub/container body may be filled with particulate material, which may be pressed to achieve optimum density and a flat top surface. The upper part/lid frame may be placed onto the filled lower part. The upper part and lower part may slide or translate relative to one another. The outer walls of the upper lid may register on both sides of the wall from the lower part. The outer walls of the upper part, between which the wall of the lower part engages, may have a gap wider than the wall that is inserted. The upper part may be pressed down so that the upper part is in contact with the pressed particulate materials. The connection conceived between the upper and the lower part allows for a varied range of engagement to be accommodated and will depend upon the height/level of the pressed contents. The upper part may be joined to the lower part in the pressed state. The joining may reduce the gap between the upper walls so that it is tightly joined to the lower container wall. The joined connection could be made with adhesive, mechanical features such as crimping, fasteners, sewn thread, or other methods. When stacked, the heavy load from the containers at the top of the stack may be transferred through the particulate material and not through the molded pulp parts of the container. This may reduce the requirement for the pulp parts to provide enough strength to support the load of heavy particulate materials. This may also increase the potential load that could be handled by the system. The final height of the container would be influenced by the amount of particulate and the degree to which it was pressed/settled. In some instances the upper part may be a single part lid that encloses the lower part and not have a flip lid frame and the lid itself is removed to access the contents, or, a portion of the lid includes a tear away feature to allow partial access to the contents.

Figure 19:
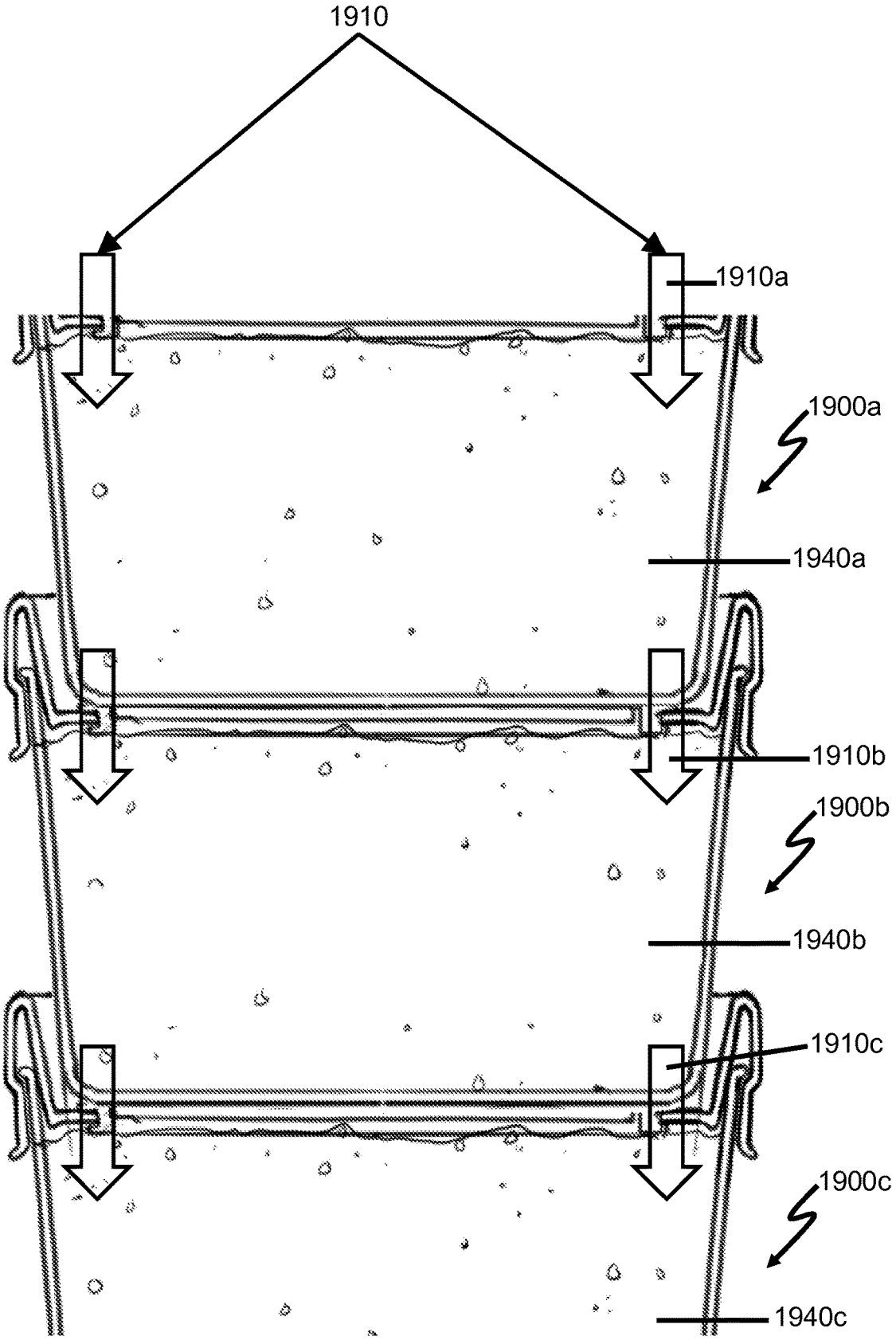
FIG. 19 shows an illustration of stacked containers in accordance with an embodiment of the invention.

FIG. 19 provides an illustration of the stacked containers 1900*a*, 1900*b*, 1900*c*, and shows that the load 1910*a*, 1910*b*, 1910*c* can be transferred through the particulate contents 1940*a*, 1940*b*, 1940*c* when the containers are stacked. The containers may be most likely filled when they are stacked (e.g., during shipping, storage, display) so the pressed particulate contents may be relied upon to provide structural support. Once the containers are sold to a consumer and the consumer starts using the particulate contents therein, there is less likelihood of heavy items stacked on top of the containers.

Figure 20:
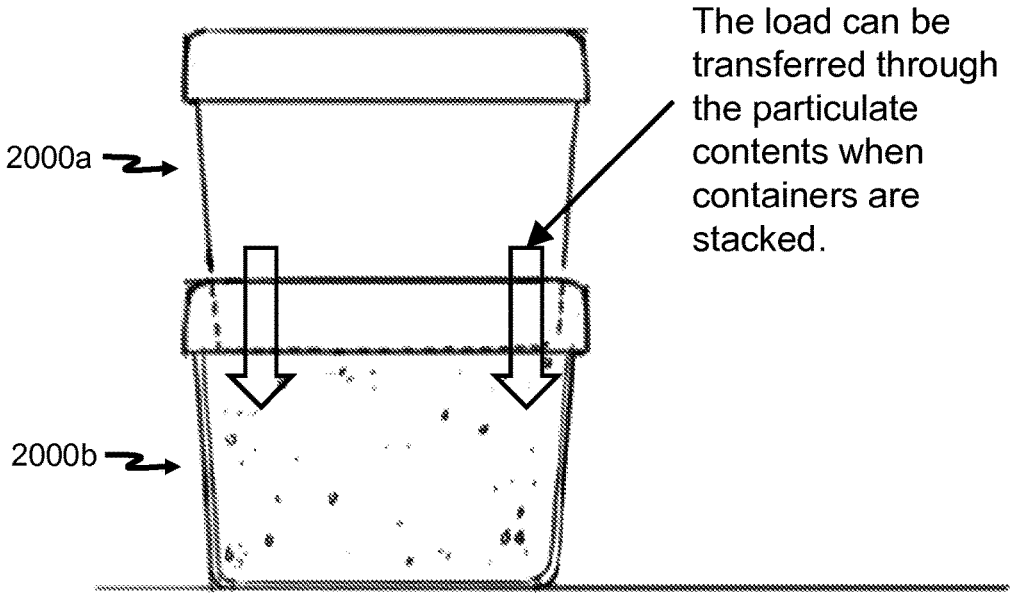
FIG. 20 provides an additional view of containers including handles in accordance with an embodiment of the invention.
Figure 20:
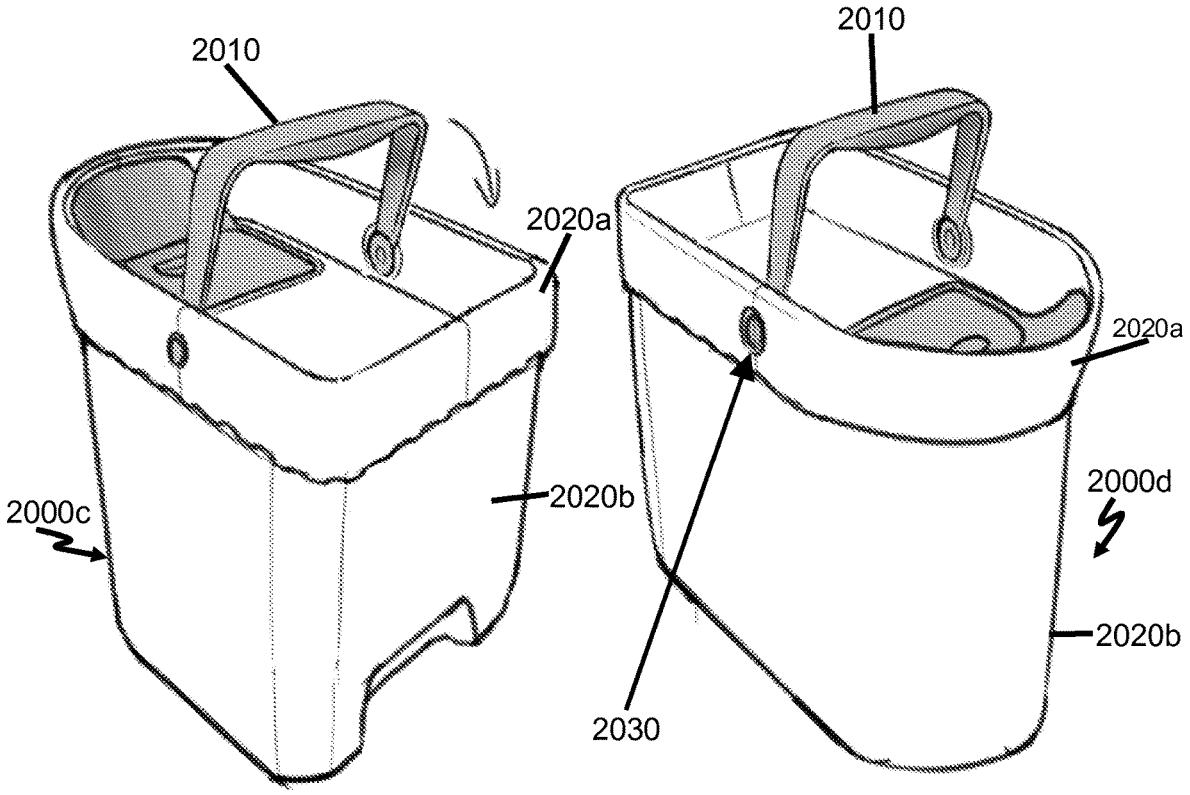

FIG. 20 provides an additional view of the containers 2000*a*, 2000*b*, 2000*c*, 2000*d*. Handles 2010 or other attachments may be provided. The container may be lifted through the handles. In some instances, the handles or other attachments may be installed through both the upper and lower pulp parts 2020*a*, 2020*b*. This may improve strength and capacity for load-bearing. In some embodiments, the handles or other attachments may be installed through the lower portion only, or the upper portion only. In some instances, the handles may encircle the container to pass beneath the container and support the container. In some instances, the handles may pass through a portion of the container. In some instances the handle is joined through the overlapping connection between the upper and lower parts and serves to strengthen the joined connection. Optionally, the upper and lower pulp parts may be crimped together to form a crimped connection.

The handles or other attachments may be pivoted so that they extend out away from the lid when the user is using the handle, and can be pivoted back toward the surface of the lid when the user is not using the handle. When the handle is pivoted back toward the surface, the handle may lie beneath the lid frame (i.e., does not extend beyond the lid frame). In some instances the frame surrounding the lid feature is shaped to improve the dispensing of the contents and to control the pour. The frame can be shaped to provide an optimal exit surface and to protect the container from the exiting contents.

A pivot point 2030 may be provided about which the handle may rotate. The pivot point may pass through both an upper and lower portion for improved strength capacity and load bearing. Alternatively, the pivot point may pass through an upper portion only or a lower portion only. Multiple pivot points may be provided that may support the handle 2010.

Figure 21:
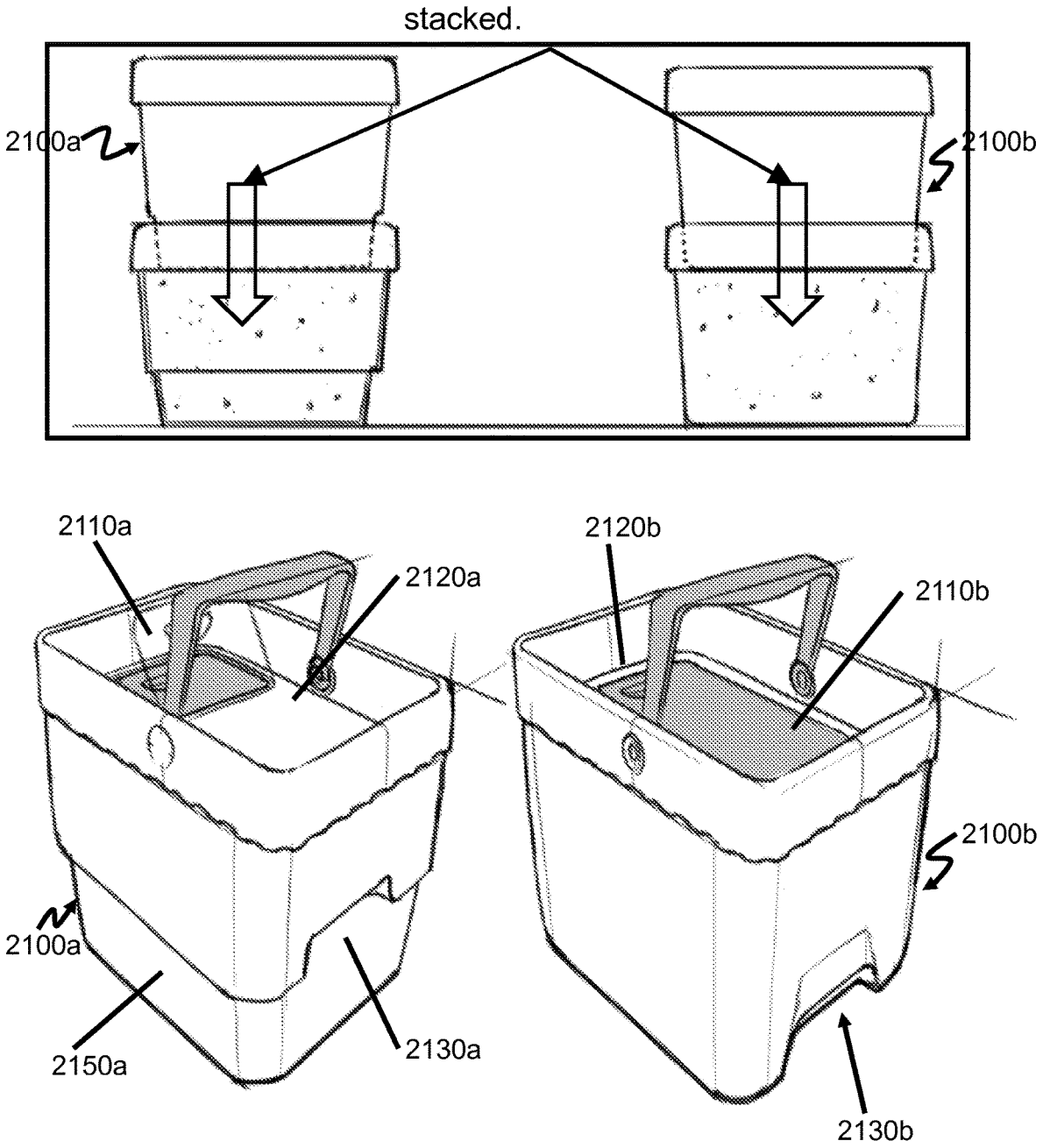
FIG. 21 provides additional examples of closure mechanisms for containers in accordance with an embodiment of the invention.

FIG. 21 provides additional examples of optional closure styles for containers 2100*a*, 2100*b*. In some instances, snap-closure flip-top openings 2110*a*, 2110*b* may be used. The flip-top openings may be hingedly attached to a lid frame 2120*a*, 2120*b* that forms the upper part of the container, or that is fixed to the upper part of the container. The upper part of the container and/or lid frame may be formed from molded pulp. The flip-top opening may or may not be formed from molded pulp. The flip-top opening 2110*b* may cover substantially all of the top surface of the container. Alternatively, the flip-top opening 2110*a* may cover only a portion of the top surface of the container. The flip-top opening may cover greater than, less than, and/or equal to about 90%, 80%, 70%, 60%, 50%, 40%, 30%, 25%, 20%, 15%, 10%, 5% of the top surface of the container.

The container body may have different styles. The container body may be formed from molded pulp, which may be molded to form desired shapes or features. In some instances, a side of the container may be smooth and straight. In some other examples, a side of the container of the container may include one or more ridges, depressions, stepped features, protrusions, or other features 2130*a*, 2130*b*. In one example, a feature may be a grip feature molded into the container to facilitate pouring and lifting. In one example, a bottom portion of the container body 2150*a* may have a smaller cross-sectional area than an upper portion of the container body.

Figure 22:
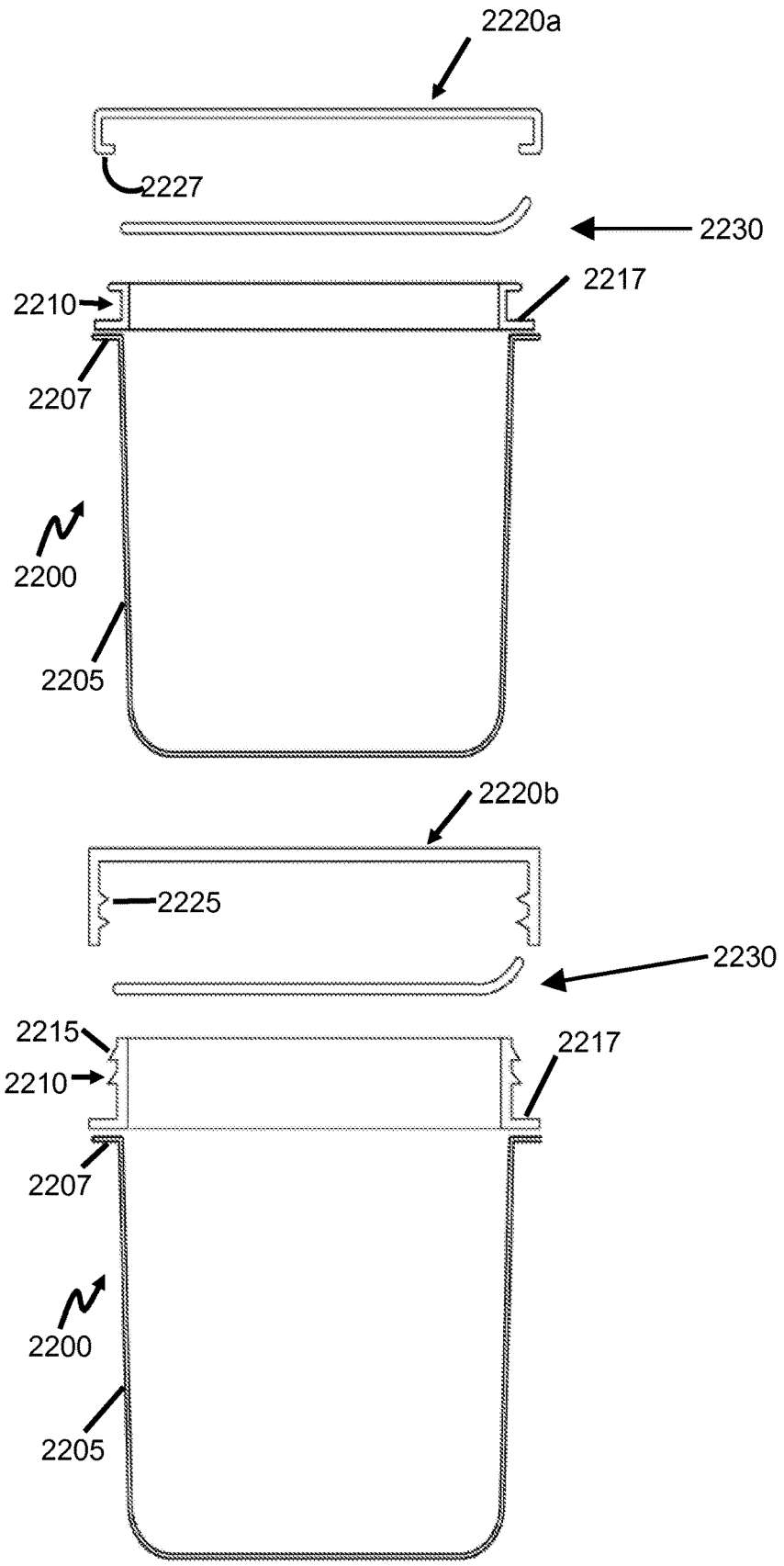
FIG. 22 shows an example of how a fitment may be incorporated into a container in accordance with an embodiment of the invention.

FIG. 22 shows an example of how a fitment 2210 may be incorporated into a container 2200. A container body 2205 may be provided. The container body may be formed from molded pulp or other materials described elsewhere herein. A fitment may be attached to the container body. The fitment may be formed of a polymer (e.g., type 2 or type 3 polymer), molded pulp, or any other material described elsewhere herein.

The fitment 2210 may be attached to the container body 2205. In some instances, the container body may have one or more flange 2207 extending around the circumference of the body. The flange may be directed outward from the outer surface of the body, or inward from the inner surface of the body. The fitment may also have a flange 2217. The flange of the fitment may be directed outward from the outer surface of the fitment or inward from the inner surface of the fitment. The flange of the fitment may contact the flange of the container body. The flange of the fitment may rest on top of the flange of the container body. They may be attached via adhesive, overmolding, heat stakes, crimping, mechanical fastener, or any other attachment mechanism. In alternate embodiments, the fitment may be attached to the container via other techniques as described elsewhere herein. For example, a portion of the fitment may contact an interior surface of the container and be attached via adhesive or other mechanism. In another example, a fitment may have one or more flanges that may interlock with a complementary flange receiving region of the container (e.g., groove). The complementary flange receiving region may encompass both the top and bottom surface of the fitment flange. In some embodiments, a fitment may be connected to the container via one or more mechanism described in the art. See, e.g., U.S. Pat. No. 8,430,262 issued Apr. 30, 2013, which is hereby incorporated by reference in its entirety.

The fitment may have one or more threads 2215 thereon which may be configured to mate with threads 2225 of a screw cap 2220*b*. In other embodiments, the fitment may have nubs, bumps, underlying portions, snap-lock features, grooves, additional flanges, or be completely smooth.

A cap 2220*a*, 2220*b* may be provided. The cap may be configured to close the orifice of the container. The cap may interact with the fitment to provide closure. In one example, the cap 2220*b* may have internal threads 2225, configured to mate with the threads of a fitment. The cap may be a screw cap that may be turned to tighten onto the fitment. The cap 2220*a* may optionally have one or more protrusion, flange, or undercutting portion 2227 that may be configured to slide under a flange or protrusion of the fitment. In some examples, the cap may be a turn-closure, or a snap-lock closure. The cap may be formed from a polymer (e.g., type 2 or type 3 polymer), molded pulp, or any other material described herein.

A membrane seal 2230 may be positioned between the cap and the fitment. In some instances, the membrane seal may be used for freshness and/or tamper evidence. The member may be formed from a polymer, multi-layered polymer, paper, paper with seal layer, foam, or any other material. The membrane may be formed from a flexible and/or fluid-tight material. The membrane may be stretched over the orifice of the fitment. The membrane may be held in place by a cap, or may remain without aid of the cap.

Figure 23:
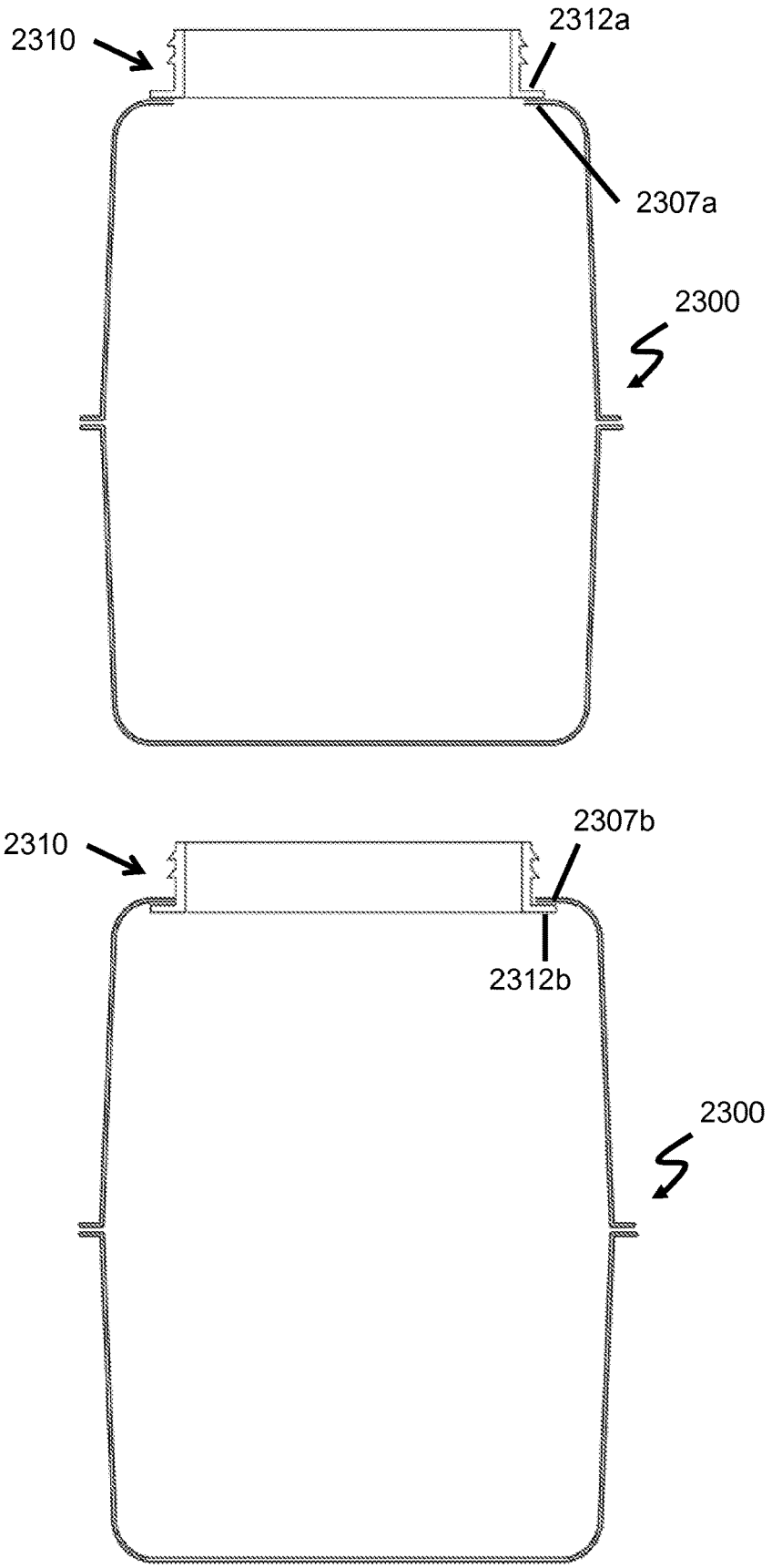
FIG. 23 shows additional examples of how fitments can be attached to a container in accordance with an embodiment of the invention.

FIG. 23 shows additional examples of how fitments 2310 can be attached to a container 2300. The fitment could be attached to the container on the outside. The fitment may have a flange 2312*a* that may rest on top of a neck 2307*a* of the container. The flange may be flush with an upper surface of the container.

The fitment 2310 could be attached to the container 2300 on the inside. The fitment may have a flange 2312*b* that may contact the bottom (i.e. interior) surface of the neck 2307*b* of the container. The flange may be flush with the underside of the upper surface of the container. A threaded portion of the fitment may extend through an orifice in the upper surface of the container.

The fitment may be secured to the container on the outside or inside using an adhesive, welding, heat stakes, overmolding, mechanical fastener, snap-lock, interlock, or any other configuration described elsewhere herein.

Optionally, the fitment may have a threaded finish or any other configuration described elsewhere herein.

Figure 24:
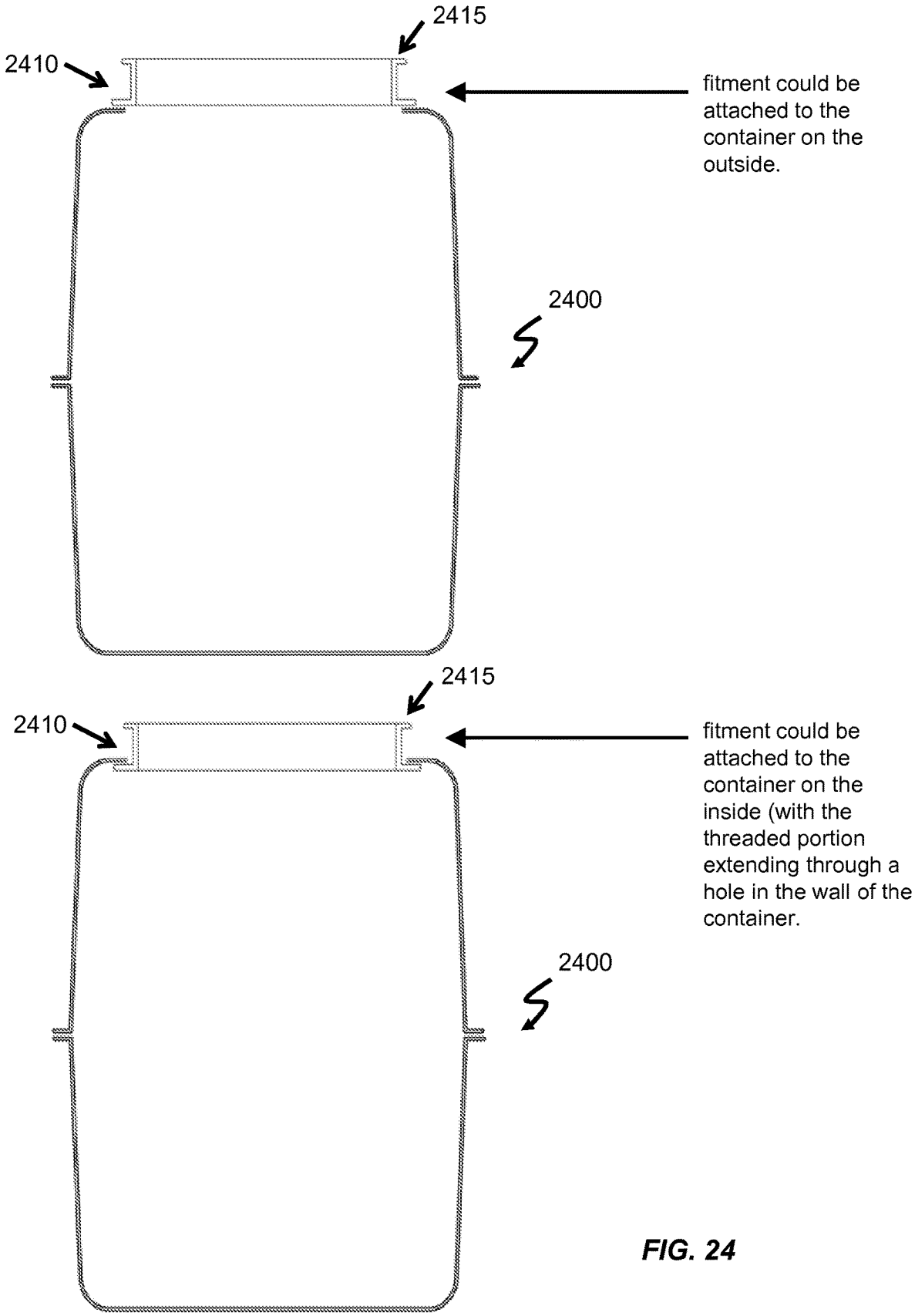
FIG. 24 shows further examples of fitments attached to a container in accordance with an embodiment of the invention.

FIG. 24 shows an additional example of a fitment 2410 that may be attached to a container 2400. The fitment may be attached to the container on the outside or inside. The fitment may terminate with a snap feature 2415, or may have any other configuration described elsewhere herein.

Figure 25:
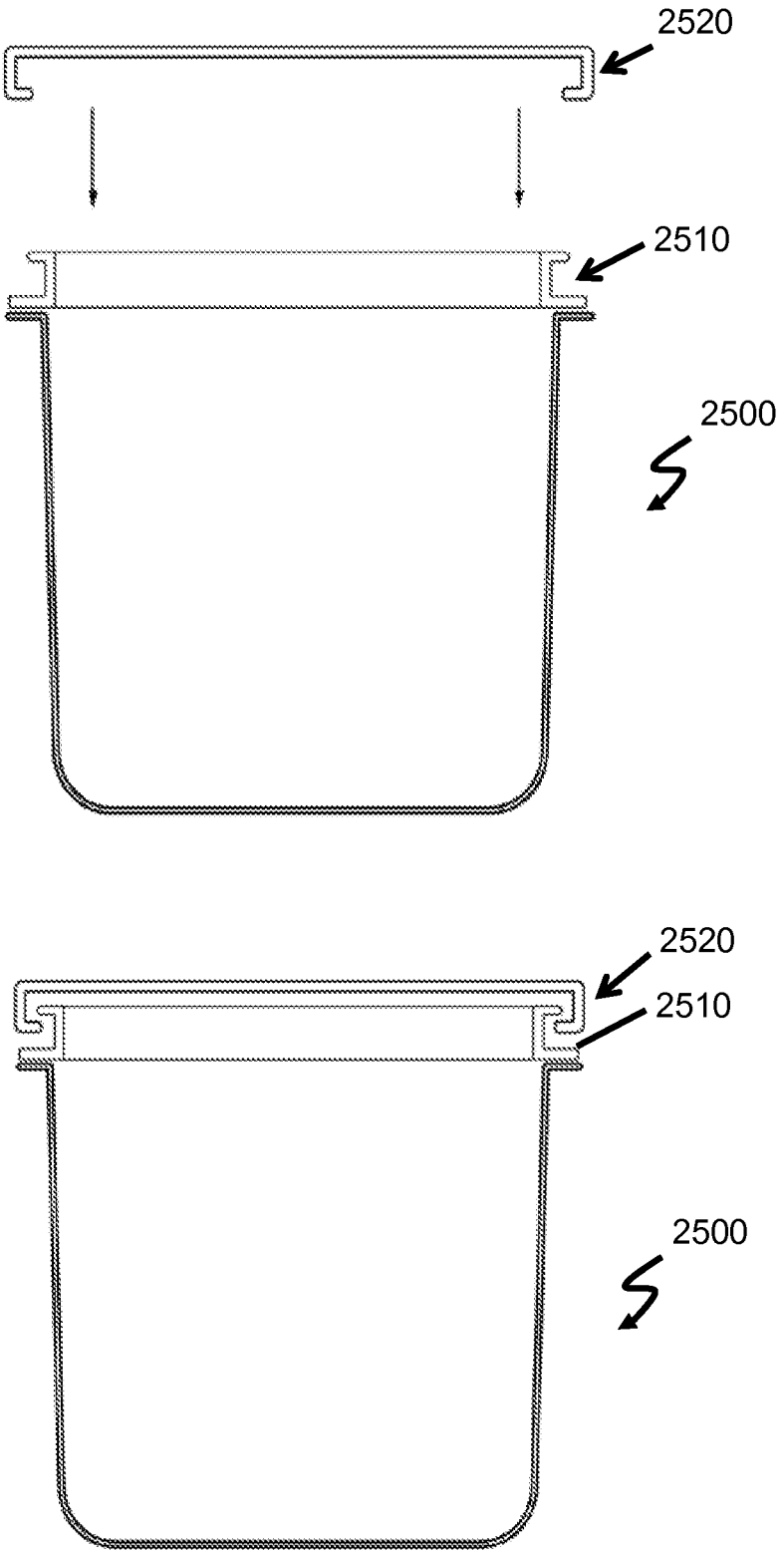
FIG. 25 provides further illustrations of attachments to a container in accordance with an embodiment of the invention.

FIG. 25 provides an illustration of an attachment of a snap cap 2520. The snap cap may be pressed down directly onto a fitment 2510 or other feature of the container 2500 to provide closure. The snap cap may be pried open to reopen the container. In some instances, the snap cap may be pressed directly onto a molded pulp feature of the container.

Figure 26:
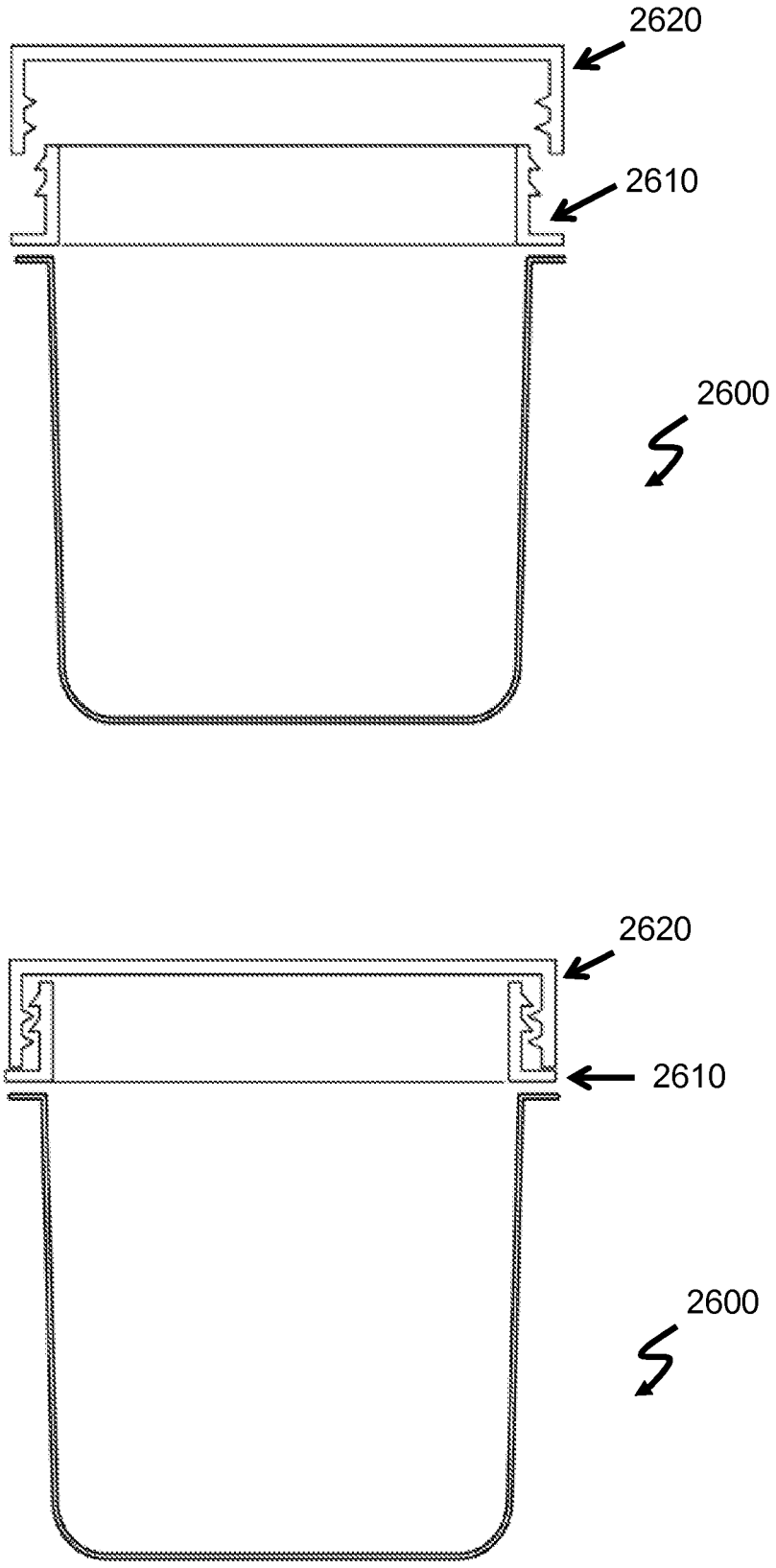
FIG. 26 is another example of an attachment to a container in accordance with embodiments of the invention.

FIG. 26 provides an illustration of an attachment of a screw cap 2620. The screw cap may be pressed down and rotated to be screwed onto the fitment 2610 or other feature of the container 2600 to provide closure. The screw cap may be rotated in the opposite direction to reopen the container. In some instances, the screw cap may be rotated directly onto a molded pulp threaded feature of the container.

Figure 32:
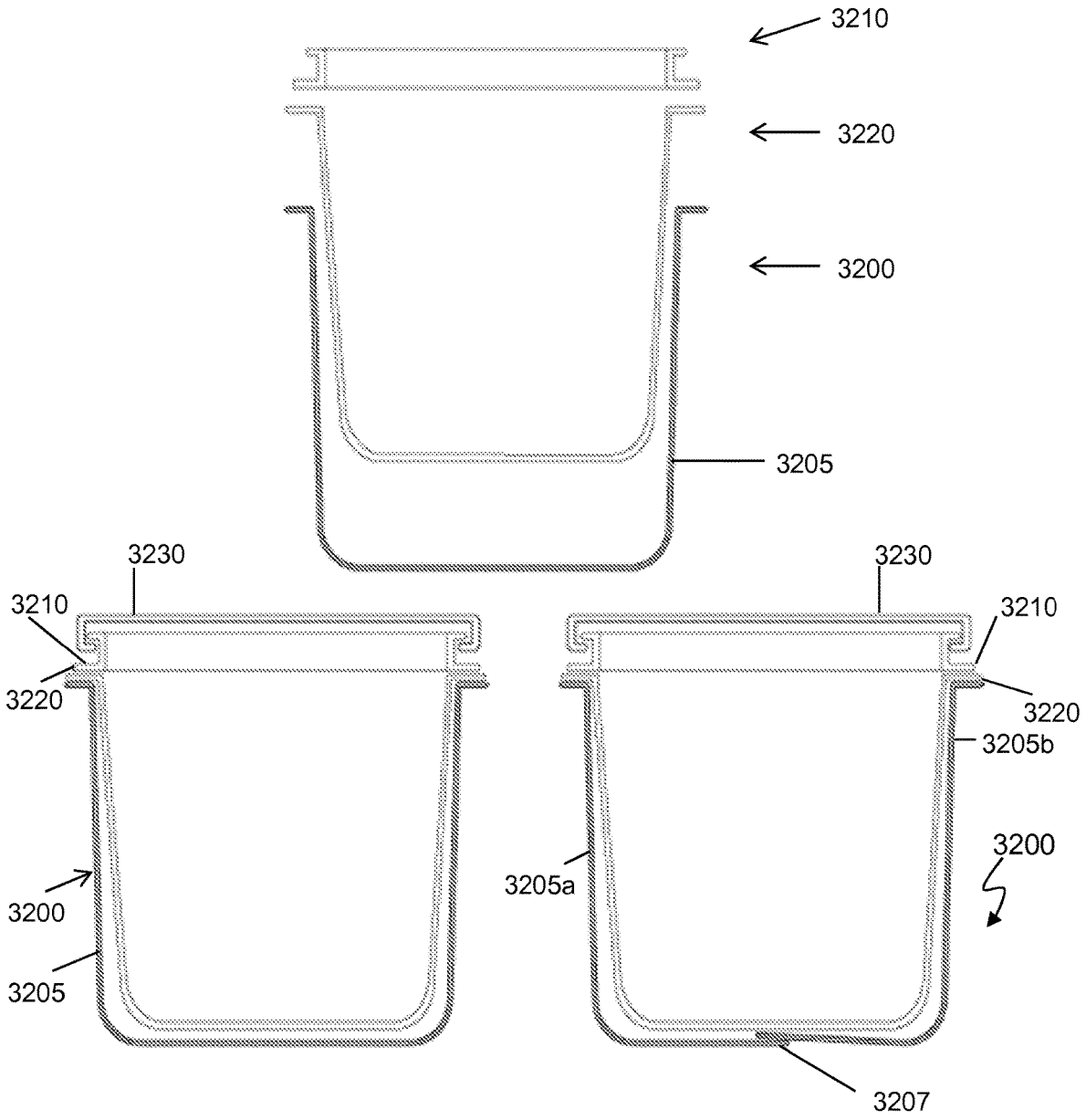
FIG. 32 provides an example of a container with a liner and a fitment in accordance with an embodiment of the invention.

FIG. 32 provides an example of a container 3200 with a liner 3220 and a fitment 3210. The container body 3205 may be formed from molded pulp or any other material described elsewhere herein. The container may be formed from a single integral shell 3205, or from multiple shells 3205*a*, 3205*b* that are attached together. The shells may be attached in a way that they overlap 3207. Alternatively, no overlap may be provided. A fitment 3210 may be formed from a polymer, molded pulp, or any other material described elsewhere herein.

A liner 3220 may optionally be provided. The liner may be formed from a polymer, bioplastic, paper, or may be paper-based. The liner may be formed from a flexible material. Alternatively the liner may be formed from a rigid or semi-rigid material. The liner may or may not be capable of retaining its shape to contain the material without aid of the container body. The liner may or may not be thermoformed. The liner may or may not naturally form a three-dimensional shape or a two-dimensional shape. The liner may be selected to be sized and/or shaped to fit flush against the interior wall of the container. The liner may fit within the body of the container. Materials may be held within the liner. The liner may prevent the materials from directly contacting the container body. The edge of the liner may be provided around a neck of the container. The edge of the liner may rest between the fitment and the container body. In some instances, the edge of the liner may be sandwiched between a flange of the container and flange of the fitment. The liner may be held between the fitment and the container with aid of an adhesive, welding, crimping, mechanical fastener, or any other attachment techniques described herein. In some instances, the liner may be attached to the fitment and/or container without contacting an exterior surface of the container. The liner may protect material from sifting through portions of the container body. For example, if the container body includes multiple pulp pieces, the liner may prevent materials from sifting through between the pulp pieces.

A cap 3230 may fit onto the fitment 3210. A snap closure/lid, flip closure/lid, threaded closure/lid, twist closure/lid, directional funnel, press-fit closure/lid or any other type of closure described elsewhere herein may be used. The closure may be a reclosable closure/lid.

Figure 33:
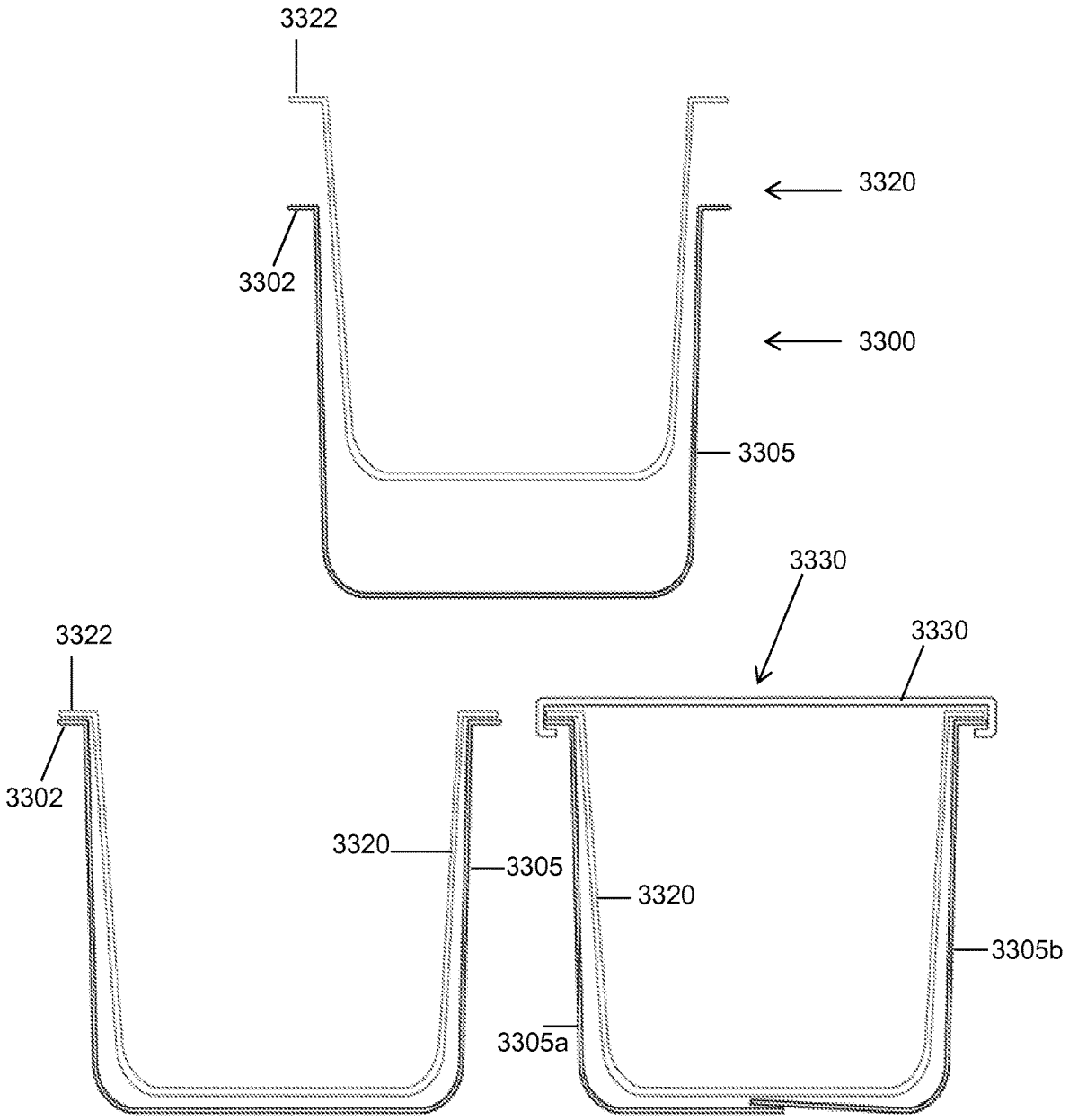
FIG. 33 provides an example of a container with a liner without requiring a fitment in accordance with an embodiment of the invention.

FIG. 33 provides an example of a container 3300 with a liner 3320 but without requiring a fitment. The edge of the liner may be supported by the container body. The edge of a liner may include a flange 3322. The edge of the liner may contact a flange 3302 around a neck of the container. In some embodiments, the edge of the liner may be flexible. Alternatively, the edge of the liner may be rigid or semi-rigid. The edge of the liner may be able to rest on the edge of the container and maintain its structural shape. The cap 3330 may fit directly onto the container body. The cap may fit over the liner and/or come into contact with the liner. In some embodiments an edge or flange of the liner may be sandwiched between the cap and a flange of a neck of the container.

FIG. 35 shows a cap 3530 with a feature 3535 to support the structure of the container 3500. A container may have a container body 3505. The cap may fit over an opening of the container. The container may fit over the container body directly, or may fit over a fitment, liner 3520, or any other feature of the container.

The cap 3530, when installed, may support the neck/orifice area of the container. The cap may have an internal protruding feature 3535 that may contact an inner surface of the container body, or may be provided within the interior of the container body. The internal support feature of the cap may contact a liner of the container, or may directly contact the inner surface of the container body. The internal support feature may be provided about a circumference of the neck/orifice, or may be provided a portion of the circumference of the neck/orifice. The cap configuration may be cost effective since a cap may eliminate or reduce a need for a fitment part. In some instances, the cap may be able to provide functionality without requiring a separate fitment. In some embodiments, fitments may be provided in conjunction with caps.

FIG. 34 shows an example of a container 3400 that can be used to hold particulate materials. Examples of particulate material may include litter or other materials described elsewhere herein. The container may have a bottle design. The bottle may have an orifice 3430 through which the particulate materials can be dispensed. The bottle body 3405 can be formed from molded pulp or other materials described elsewhere herein. The bottle body can be formed from a single integral shell, or multiple shells 3407*a*, 3407*b* that may be completely separable or connected via a hinge. In some instances, an overlap or flap 3408 may be provided. The overlap may occur on a bottom surface of the bottle (e.g., the surface of the bottle opposing the side with the orifice). The overlap may occur along one or more side surface of the bottle.

The bottle may include threaded features around a neck 3420 of the bottle. The threaded features may be integrally formed on the bottle body. Alternatively, a separate piece may be used with threaded features. The threaded features may be formed from molded pulp or other materials. Alternatively, a fitment may be provided with threaded or other shaped features.

The bottle may include a handle 3440. The handle feature may improve the user ability to carry and pour contents from the container. The handle can go right through the container, creating a hole. Alternatively, indentations or other shaped features may be provided for ease of gripping the bottle.

Figure 27:
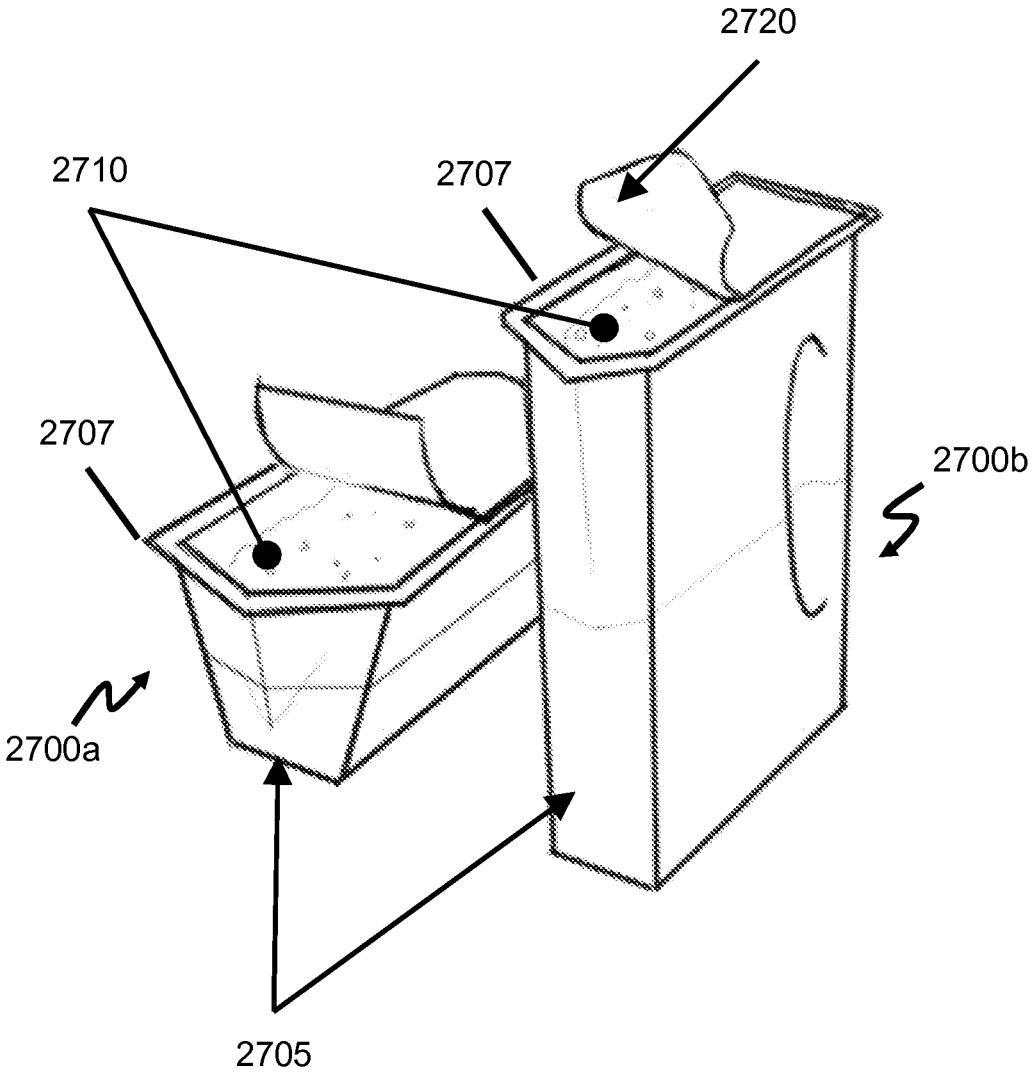
FIG. 27 provides an example of a container that may be a refill pack in accordance with an embodiment of the invention.

FIG. 27 provides an example of a container 2700*a*, 2700*b* that may be a refill pack. In some instances, the container may hold particulate material 2710 such as litter. A litter refill pack may be provided in a molded pulp/fiber material. The litter refill pack may be used to refill other containers. A container body 2705 may be formed of a molded pulp/fiber shell. The shell may optionally have an open face. The open face may be directed upwards so that contents of the container remain in the container.

In some embodiments, the open face of the shell may have a flange 2707. The flange may extend outwards away from the outer surface of the shell, or may extend inwards from an interior surface of the shell.

The shell may have any type of shape or configuration. For example, the shell may be thin and tall, short and squat, rounded, faceted, have sharp corners or edges, or have rounded corners or edges. The shell may have a bucket-like shape, bowl-like shape, bottle-like shape, box-like shape, loaf-like shape or any others shape. In some instances, more elaborate shapes, such as bunny, clown, snowman, animal, jug, trough, may be formed from molded pulp or fiber for the shell. The shell may be shaped to appeal to consumers, pets, or children. Optionally, the shell could become a toy after the litter or particulate matter within the shell is emptied from the shell. The shell shape may function as a scooping device.

The container may have a cover 2720. The cover may interface with the open face of the shell. The cover may completely cover the open face of the shell. The cover may be a lidding material. In some instances, a paper or coated paper seal may be used to cover the opening. Optionally a molded cover may be used to cover the shell. The molded cover may be formed from molded pulp/fiber and/or may be formed of the same material as the shell. Alternatively, the molded cover may be formed from a different material as the shell. The molded cover may have a perforated track to allow it to be opened. The cover may be a one-time open cover that may not be re-sealed or closed. Alternatively, the cover may be repeated opened or closed/sealed.

The shell may become a toy after the litter or particulate is emptied from the shell. The shell shape may function as a scooping device. The scooping device may be used to scoop litter, waste, or other particulate materials.

Figure 28:
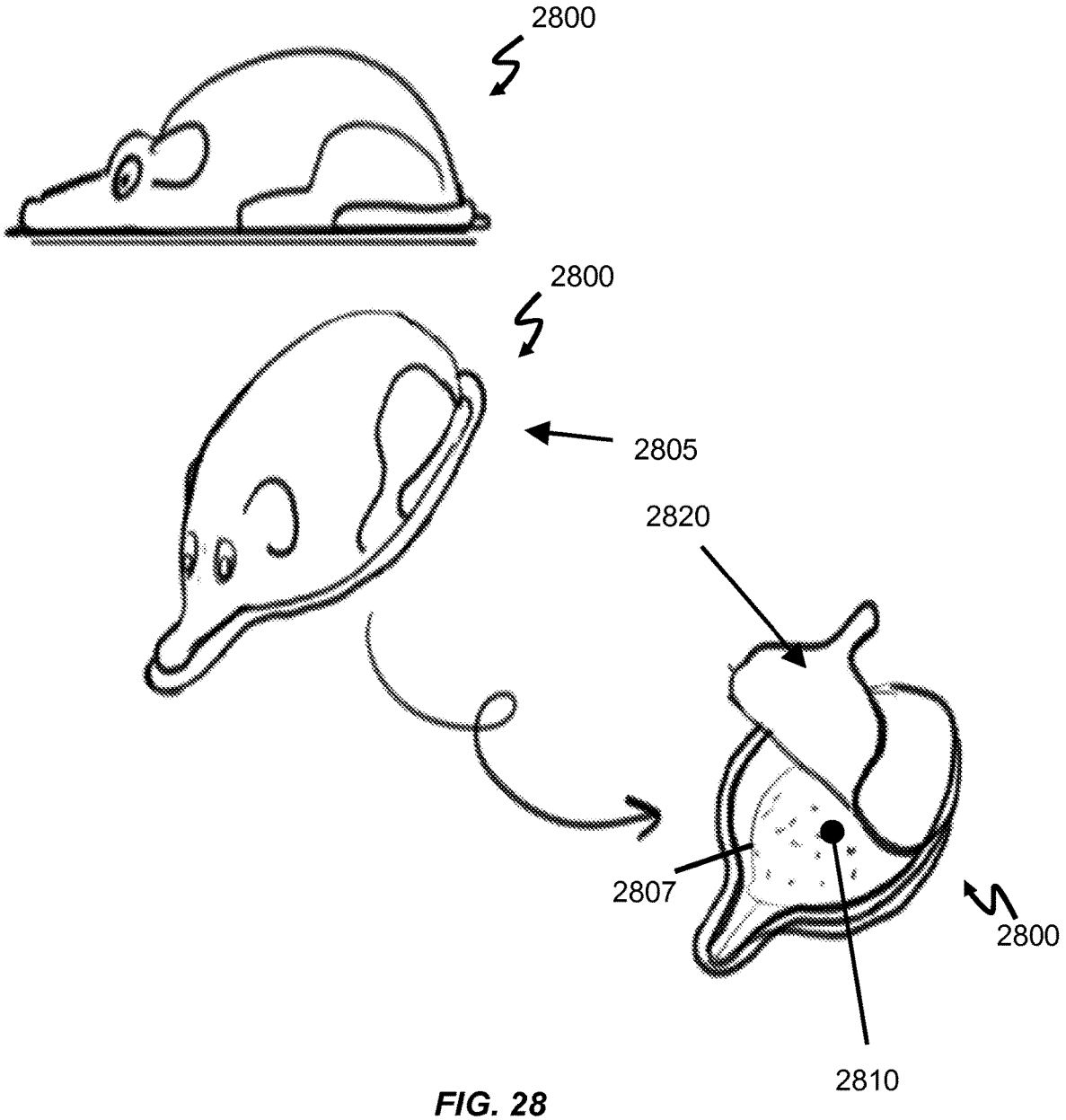
FIG. 28 provides an additional example of a refill pack in accordance with embodiments of the invention.

FIG. 28 shows another example of a refill pack 2800. The refill pack may be shaped like an animal, such as a rodent (e.g., mouse, bunny, rat, guinea pig), cat, dog, or other animal. The refill pack shape may be of a shape to appeal to an animal or serve as a toy of an animal. The refill pack shape may be any other shape such as a clown, snowman, jug, geometric shape, plant-shape, human-shape, inanimate-object shape, or any other shape. The refill pack may be formed from a molded pulp/fiber. The molding of the pulp/fiber may permit the formation of detailed or varied shapes. The moldings may be a shell of the refill pack. A single integral shell 2805 may be provided or multiple shells.

The refill pack may have an open face which may be covered with a lidding material 2820. The open face may include a peripheral flange 2807 circumscribing the opening. The lidding material may be peeled away to expose the contents 2810 within the refill pack. In some instances, the side of the container with the lidding material may be flat, so that the refill pack may rest on the flat surface, and show the shape of an animal on the exposed surface. The refill pack may be inverted so the lidding material is exposed to open the pack. The lidding material may be peeled away to open the pack. The lidding material may be attached to the flange with an adhesive or other material. Optionally, the animal shaped refill pack may be a toy for the pet, children and/or others. The animal shaped refill pack may function as a scoop.

Figure 29:
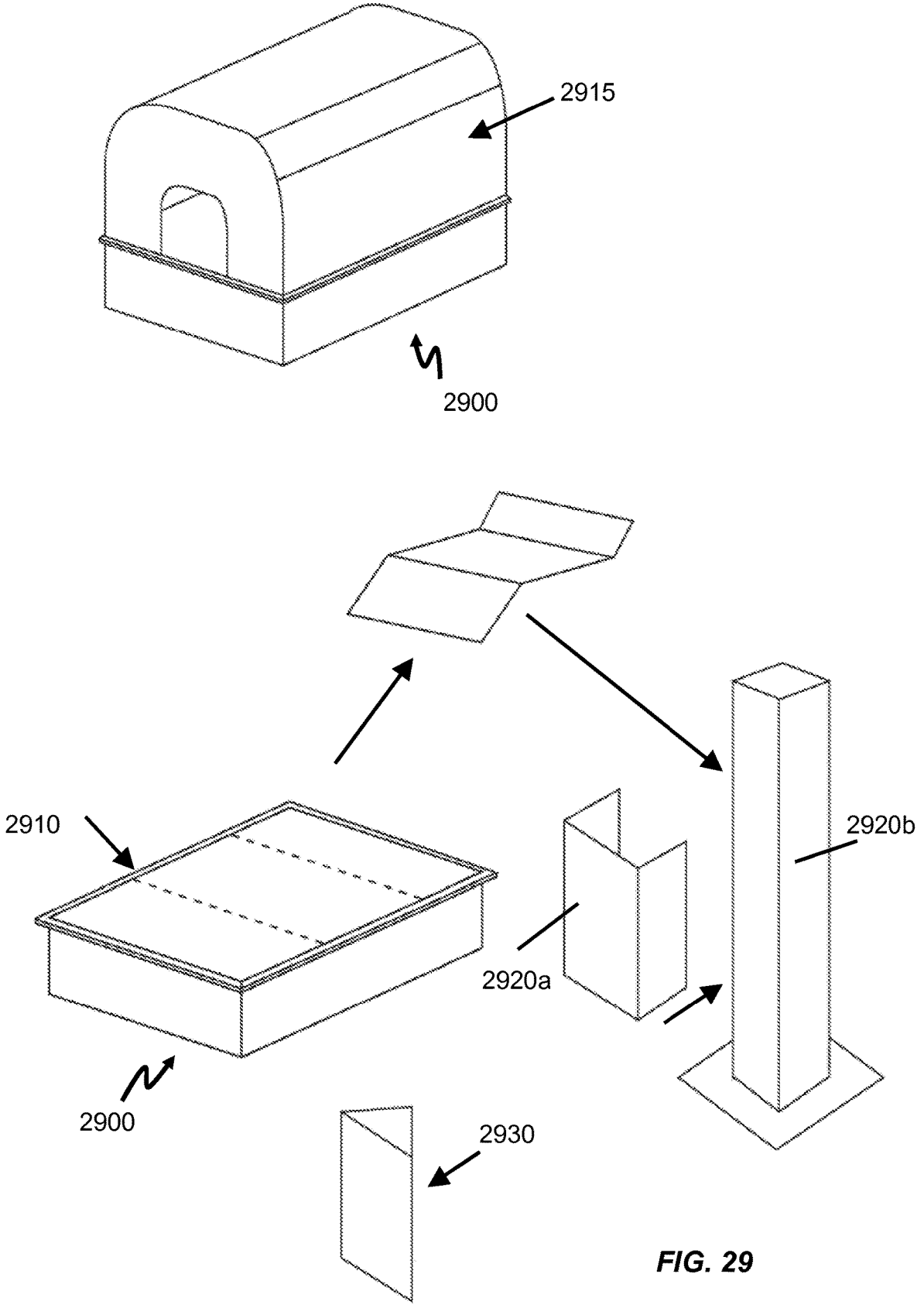
FIG. 29 shows additional functionality that may be provided for a container in accordance with embodiments of the invention.

FIG. 29 shows examples of additional functionality to litter or particulate dispensing containers 2900. For example, a lid 2910 may function as a cover 2915 for privacy and/or scent control. A lid can be fashioned from an outer tray of a double tray system.

Portions of the container 2900 may be repurposed. The portions of the container may be repurposed after the contents of the container have been used and/or emptied. In some instances, the container may be repurposed as a pet toy, scratch post, enclose to hide within, or a hanging. The repurposing may be particular useful for cats, dogs, birds, rodents, reptiles, snakes, or other pets. In some instances, portions of the container not soiled by litter or urine may be provided with the feature that may permit it to be repurposed. The portions of the containers may include perforations, flaps, folds, tear-aways, or other feature to assist with converting the portions of the container to their new purpose. For instance, a portion of the container may be folded into a new configuration. In one example, a lid of a container may become a scratching post 2920*a*, 2920*b*. In another example, the lid or other portion of the container may become another toy, such as a triangular shaped house 2930.

Figure 30:
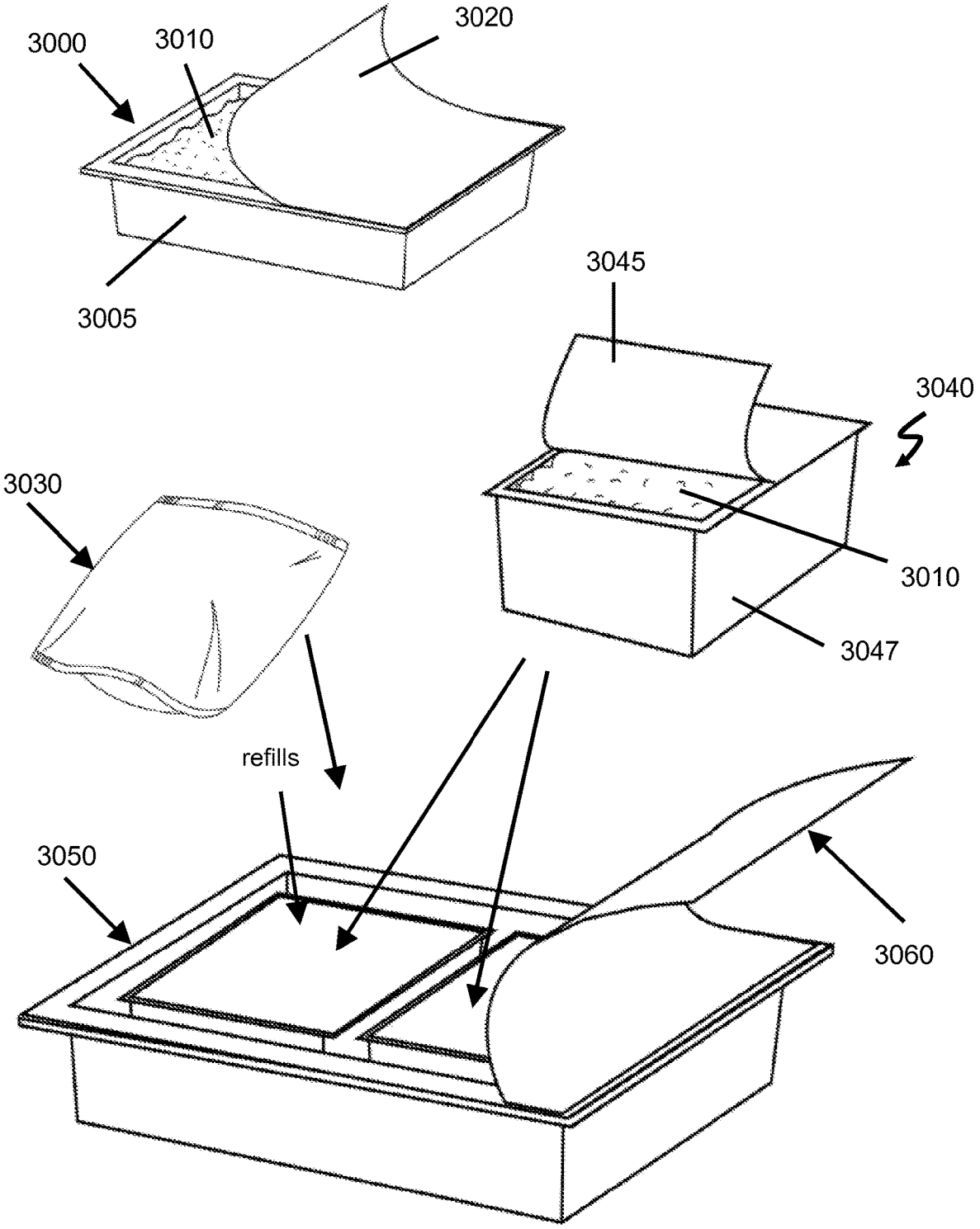
FIG. 30 shows an example of a litter tray kit in accordance with an embodiment of the invention.

FIG. 30 shows an example of a litter tray kit 3000. The litter tray kit may contain particulate materials 3010, such as pet litter. The litter tray kit may include a container body 3005 formed from molded pulp/fiber. The container body may be formed as a tray. The molded tray may or may not have a treated surface. For example, the tray may be PLA lined, spray coated, or dipped with a moisture resistant material, anti-scent material, or anti-bacteria material. The container body may come with the litter and may be compostable and/or biodegradable. A lidding 3020, such as tear-away lidding may be provided. The lidding may or may not be compostable and/or biodegradable as well.

In some instances, a refill pack may include a paper pouch 3030. In some instances, an envelope may be provided. The envelope may be formed of paper-based product or polymer. The refill pack may be formed of molded pulp/fiber. The molded container 3040 may include a lidding 3045. The lidding may be attached to a body 3047 of the refill pack.

A multi-pack kit tray 3050 may be provided. In some instances, one, two, or more refills may be provided within the multi-pack tray kit. The tray may be formed from molded pulp/fiber. A kit sealing lid 3060 may be provided. The one or more refill packs may be contained within the tray and lid. Multi-pack kit trays may carry multiple packs of litters. The refills may be dosed according to the size of the tray. Each refill pack may be individually sealed and/or closed. In some instances, each refill pack in the tray may contain the same type of litter. In alternative embodiments, different types of litter may be held in the refill packs. Scent may or may not be added to the tray, refill packs and/or particulate materials.

Figure 31:
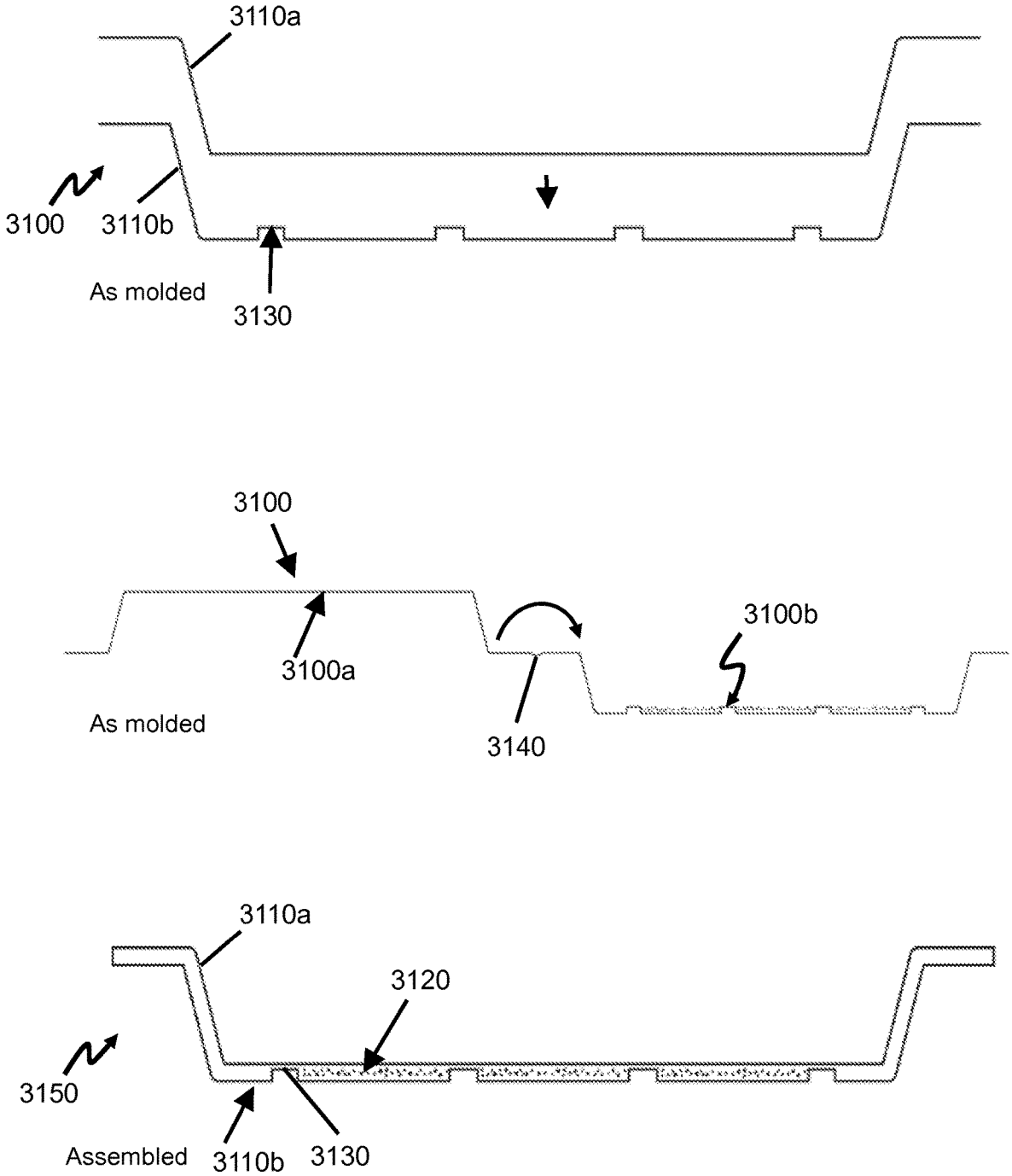
FIG. 31 shows an example of a tray formed from molded parts in accordance with an embodiment of the invention.

FIG. 31 shows an example of a tray 3100 formed from molded parts 3110*a*, 3110*b*. Parts may fit together with gaps 3120 in places. The parts may be connected (e.g., mechanically, adhesively, or other techniques described elsewhere). Multiple layers of parts may be provided. For example, a first part may overlay a separate second part. This may provide structure and stiffness. A stiffening feature 3130 may be provided. In some examples, stiffening features may include one or more channels on a part.

In some embodiments, a top and bottom layer may be integral and molded with a hinge 3140. The arrow may show a rotation about the hinge.

In some instances, more than two parts may be provided (e.g., separate or hinged parts). The multiple parts may be layered on top of one another or may at least partially overlap one another. It should be noted that the same principle can be applied to a bottle or container where the container walls are each two part. This could add rigidity and the benefit of having an interior space. The two part wall can also function allow gripping features or through handles to have increases strength and structure. In some instances, the two-part wall may have one or more feature as described in PCT Publication No. WO 2013/036695, which is hereby incorporated by reference in its entirety.

An assembled multi-part tray 3150 may be shown. For example, two shell layers 3110*a*, 3110*b* may be provided. One, two, or more shell layers may have stiffening features 3130. The spacing between the layers may be filled with materials 3120. Some examples of filler materials may include powder to reduce scent, cat nip, or absorbent materials, pellets, powder, media.

The tray may be formed from molded pulp/fiber or any other material described elsewhere herein. The tray may be biodegradable and/or compostable. The tray may be formed from recycled and/or recyclable material. In some instances, the tray may be infused with a material. For example, the tray may be infused with an odor control material or an absorbent material. In some instances, the tray may be coated or infused with moisture resistant material or water repellant materials. In some embodiments, the tray may be formed from a digestible and/or edible material.

It should be understood from the foregoing that, while particular implementations have been illustrated and described, various modifications can be made thereto and are contemplated herein. It is also not intended that the invention be limited by the specific examples provided within the specification. While the invention has been described with reference to the aforementioned specification, the descriptions and illustrations of the preferable embodiments herein are not meant to be construed in a limiting sense. Furthermore, it shall be understood that all aspects of the invention are not limited to the specific depictions, configurations or relative proportions set forth herein which depend upon a variety of conditions and variables. Various modifications in form and detail of the embodiments of the invention will be apparent to a person skilled in the art. It is therefore contemplated that the invention shall also cover any such modifications, variations and equivalents.

What is claimed is:

1. A container for holding materials comprising:

a thermoformed molded pulp shell body comprising (1) a hinged first pulp shell and second pulp shell that are foldable to form an enclosed body, or (2) multiple pulp shells including a first pulp shell and a second pulp shell joined together to form the enclosed body;

wherein the thermoformed molded pulp shell body is configured to contain materials within the enclosed body;

wherein the first pulp shell forms a top part of the pulp shell body, and the second pulp shell forms a bottom part of the pulp shell body;

an orifice in the top part of the pulp shell body configured to permit passage of the materials through the orifice into or out of the thermoformed molded pulp shell body, wherein at least a portion of the first pulp shell forms an overlap or an attachment with the second pulp shell; and a separate structure removably coupled to the thermoformed molded pulp shell body at a neck of the thermoformed molded pulp shell body, wherein at least a portion of the structure comprises (a) a support ring that contacts an interior surface of a vertical portion of the neck or (b) an attachment structure having walls to be registered on both an inner side and an outer side of the vertical portion of the neck.

2. The container of claim 1, wherein the overlap is located at a base of the container or at a side wall of the container.

3. The container of claim 1, wherein the structure comprises one or more flanges thereby forming a surface that rests on top of the vertical portion of the neck of the thermoformed molded pulp shell body.

4. The container of claim 3, wherein the structure is formed from one or more of the following: pulp fiber, cardboard, plastic, or metal.

5. The container of claim 1, wherein the structure is formed from thermoformed molded fiber.

6. The container of claim 1, further comprising an internal liner attached to the structure and is disposed within the enclosed body.

7. The container of claim 1, wherein the overlap is connected with aid of an adhesive selected from one or more of the following: hot melt adhesive, latex contact adhesive, or pressure cure adhesive.

8. The container of claim 7, wherein the adhesive permits the overlap to form a secure connection to form the molded pulp shell body that contains the materials therein.

9. The container of claim 1, further comprising a pulp pan contained within the thermoformed molded pulp shell body.

10. The container of claim 1, wherein the thermoformed molded pulp shell body comprises shaped features configured for easy gripping of the container.

11. The container of claim 1, wherein the thermoformed molded pulp shell body is configured to receive a reclosable lid.

12. The container of claim 11, wherein an internal liner is secured to the container when the reclosable lid is locked to the container.

13. The container of claim 11, wherein the reclosable lid is selected from one or more of the following: a cap, a flip lid, a snap lid, a directional funnel, a threaded cap, or a press fit lid.

14. The container of claim 13, wherein the reclosable lid is formed from molded pulp.

15. The container of claim 1, further comprising a bag disposed within the enclosed body.

16. The container of claim 1, further comprising at least one inner load bearing part configured to align vertically with another inner load bearing part of another container when the container and the other container are vertically stacked.

17. The container of claim 16, wherein:

the at least one inner load bearing part is made from a corrugate, a molded pulp material, or a paperboard material; and the at least one inner load bearing part is formed in a square shape, a rectangular shape, a hexagonal shape, a cylindrical shape, or an elliptical shape.

18. The container of claim 1, wherein the walls of the structure are separated by a gap to receive the vertical portion of the neck.

19. The container of claim 18, wherein the gap is wider than the thickness of the vertical portion of the neck.

20. The container of claim 1, wherein a bottom surface of the thermoformed molded pulp shell body includes a recess that accommodates an upper protruding portion of an underlying container, wherein at least some of the load from the container on the underlying container bypasses the upper protruding portion.

21. A system for holding containers comprising:

a plurality of containers of claim 1; and a slip sheet comprising a plurality of holes that locate the top of the plurality of containers in place.

22. A container for holding materials comprising:

a molded pulp shell comprising a plurality of pulp shells including comprising a top part and a bottom part that are joined together, or are hinged and foldable to form an enclosed body, wherein the molded pulp shell body is configured to contain a separable liner contained within the enclosed body, wherein the separable liner includes an edge that contacts a flange of a neck of the container and the separable liner is secured to the container when a reclosable lid is locked to the container to be in contact with the edge of the liner;

molded pulp threads integrally formed on the molded pulp shell; and a threaded closure configured to mate with the molded pulp threads, the threaded closure having an internal protruding feature configured to contact an inner surface of the liner when the threaded closed is mated with the molded pulp threads.

23. The container of claim 1, wherein the structure is coupled to the vertical portion of the neck of the thermoformed molded pulp shell body with aid of an adhesive.

24. The container of claim 1, wherein the structure comprises one or more flanges, and the neck of the thermoformed molded pulp shell body comprising one or more flange receiving region that interlocks with the one or more flanges.

25. A container for holding materials comprising:

a molded pulp shell comprising a plurality of pulp shells including comprising a top part and a bottom part that are joined together, or are hinged and foldable to form an enclosed body;

molded pulp threads integrally formed on the molded pulp shell;

a separate structure removably coupled to the thermoformed molded pulp shell body at a neck of the thermoformed molded pulp shell body;

a threaded closure configured to mate with the molded pulp threads; and wherein the molded pulp shell is configured to contain a separable liner contained within the enclosed body, wherein the separable liner includes an edge that is positioned between a flange of a neck of the container and the separate structure.

* * * * *